US007221885B2

(12) United States Patent
Sato

(10) Patent No.: US 7,221,885 B2
(45) Date of Patent: May 22, 2007

(54) IMAGE FORMING DEVICE, SYSTEM, CONTROL METHOD, PROGRAM AND MEMORY MEDIUM UTILIZING OPERATION HISTORY

(75) Inventor: Eiichi Sato, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 255 days.

(21) Appl. No.: 10/992,691

(22) Filed: Nov. 22, 2004

(65) Prior Publication Data

US 2005/0111866 A1 May 26, 2005

(30) Foreign Application Priority Data

Nov. 26, 2003 (JP) ..... 2003-395849
Apr. 15, 2004 (JP) ..... 2004-120454

(51) Int. Cl.
*G03G 15/00* (2006.01)

(52) U.S. Cl. ..... 399/81; 399/83

(58) Field of Classification Search ..... 399/8, 399/80, 81, 83, 85

See application file for complete search history.

(56) References Cited

U.S. PATENT DOCUMENTS 5,115,273 A * 5/1992 Ujiie et al. ..... 399/83
6,151,464 A * 11/2000 Nakamura et al. ..... 399/79
6,181,893 B1 * 1/2001 Collard et al. ..... 399/80
6,356,721 B1 * 3/2002 Motoyoshi et al. ..... 399/82
6,507,716 B2 * 1/2003 Nomura et al. ..... 399/80
6,698,950 B2 * 3/2004 Nishii ..... 400/63
6,701,095 B1 3/2004 Fujimoto et al. ..... 399/9
6,898,389 B2 * 5/2005 Osada ..... 399/81
6,978,096 B2 * 12/2005 Maeshima ..... 399/82
7,034,954 B1 * 4/2006 Utsunomiya ..... 358/1.16

FOREIGN PATENT DOCUMENTS

JP 10079819 A * 3/1998
JP 2000-231309 8/2000
JP 2003208291 A * 7/2003

* cited by examiner

*Primary Examiner*—Robert Beatty
(74) *Attorney, Agent, or Firm*—Fitzpatrick, Cella, Harper & Scinto

(57) ABSTRACT

Drawbacks in the prior technology, such as operation histories of other persons having a low possibility of re-use are also displayed and the operation history of the operator himself becomes difficult to find and an older operation history is deleted by an operation of another person when the memory of the operation history reaches an upper limit of the memory, can be resolved. To enable the operator to easily select and re-use a desired operation history, a main controller executes an individual authentication for authenticating an operator, an operation history based on an input operation instruction is stored in an HDD for each authenticated individual, then an operation history of an authenticated individual is displayed on an LCD panel from thus memorized individual operation histories, an arbitrary operation history is selected from such display and an image forming device is set based on the selected operation history.

48 Claims, 30 Drawing Sheets

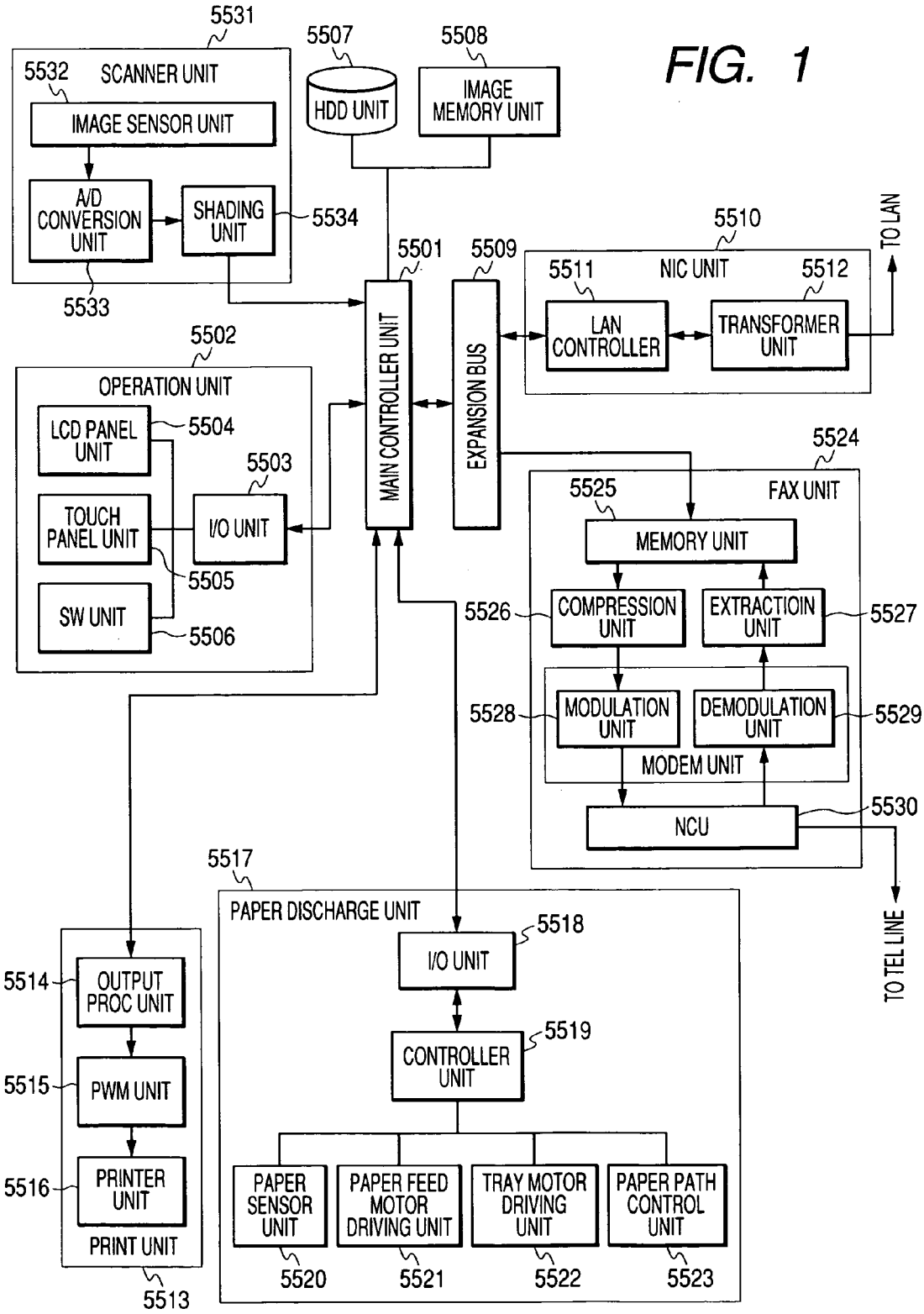
FIG. 1
5531
SCANNER UNIT
5532
IMAGE SENSOR UNIT
A/D CONVERSION UNIT
SHADING UNIT
5534
5533
5507
HDD UNIT
5508
IMAGE MEMORY UNIT
5501
MAIN CONTROLLER UNIT
5509
EXPANSION BUS
5510
NIC UNIT
5511
LAN CONTROLLER
5512
TRANSFORMER UNIT
TO LAN
5502
OPERATION UNIT
LCD PANEL UNIT
5504
5503
TOUCH PANEL UNIT
I/O UNIT
5505
SW UNIT
5506
5524
FAX UNIT
5525
MEMORY UNIT
5526
COMPRESSION UNIT
EXTRACTIOIN UNIT
5527
5528
MODULATION UNIT
DEMODULATION UNIT
5529
MODEM UNIT
NCU
5530
TO TEL LINE
5517
PAPER DISCHARGE UNIT
I/O UNIT
5518
CONTROLLER UNIT
5519
PAPER SENSOR UNIT
PAPER FEED MOTOR DRIVING UNIT
TRAY MOTOR DRIVING UNIT
PAPER PATH CONTROL UNIT
5520
5521
5522
5523
5514
OUTPUT PROC UNIT
5515
PWM UNIT
5516
PRINTER UNIT
PRINT UNIT
5513

FIG. 8

501

| USER ID | PASSWORD |
|---|---|
| 0123 | 0000 |
| 1111 | 9090 |
| 0101 | 1111 |
| 9999 | 1234 |

⋮ ⋮

FIG. 9

USER ID: 9999

USER ID: 0101

USER ID: 1111

USER ID: 0123

| HISTORY NUMBER | OPERATION DATE AND HOUR | MAGNIFICATION | PAPER SIZE | NUMBER OF COPY |
|---|---|---|---|---|
| 1 | 2003/5/30 15:14 | 100% | A4 | 1 |
| 2 | 2003/5/25 10:10 | 50% | A3 | 99 |
| 3 | 2003/3/20 23:59 | 120% | A4R | 25 |
| 4 | 2002/1/1 00:01 | 100% | A5 | 1 |

FIG. 10

UNAUTHENTICATED OPERATION HISTORY MEMORY TABLE

| HISTORY NUMBER | OPERATION DATE AND HOUR | MAGNIFICATION | PAPER SIZE | NUMBER OF COPY | ------ |
|---|---|---|---|---|---|
| 1 | 2003/5/30 15:14 | 100% | A4 | 1 | ------ |
| 2 | 2003/5/25 10:10 | 50% | A3 | 99 | ------ |
| 3 | 2003/3/20 23:59 | 120% | A4R | 25 | ------ |
| 4 | 2002/1/1 00:01 | 100% | A5 | 1 | ------ |
| ⋮ | ⋮ | ⋮ | ⋮ | ⋮ | |

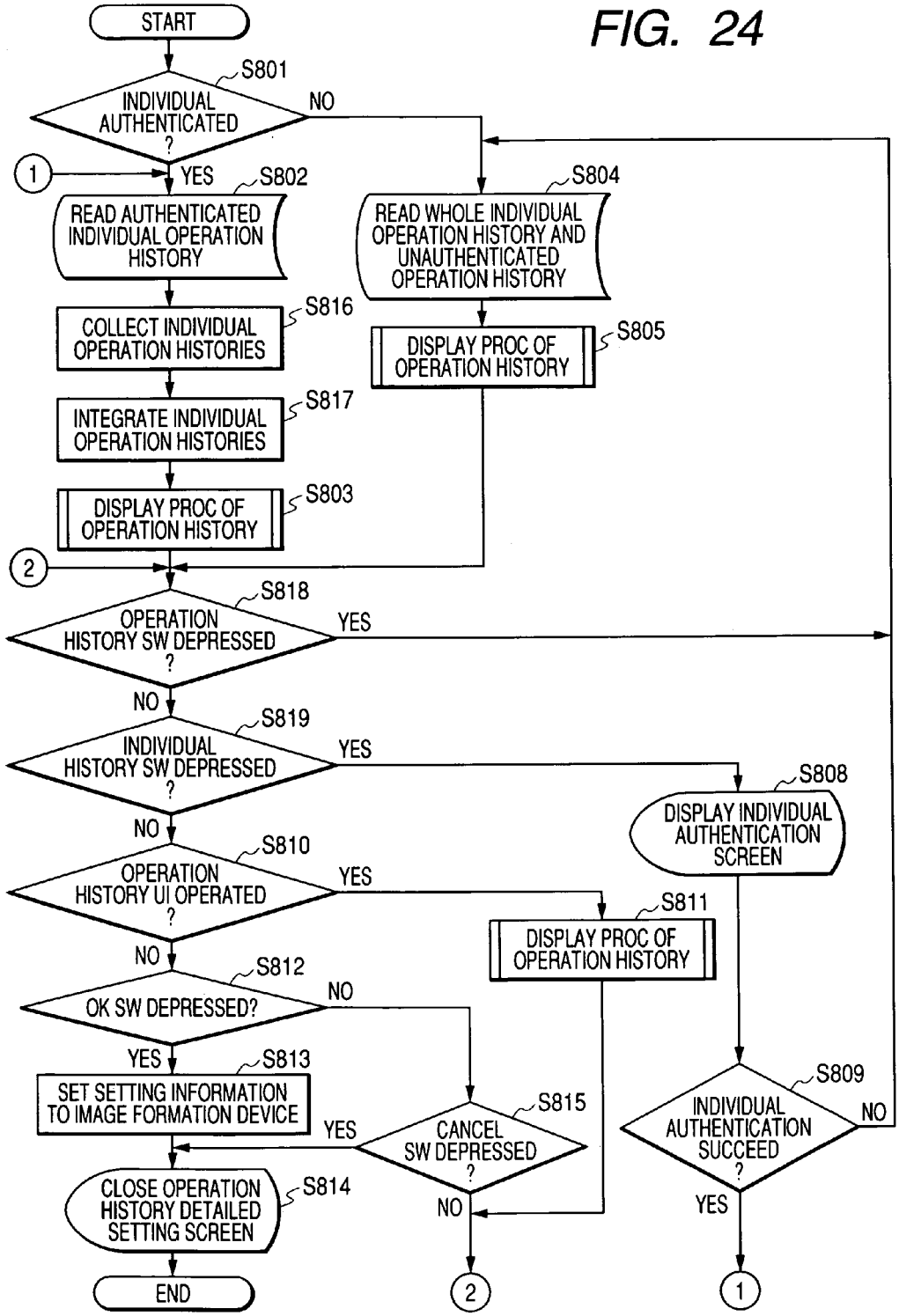
FIG. 24
START
S801
INDIVIDUAL AUTHENTICATED ?
NO
YES
1
S802
READ AUTHENTICATED INDIVIDUAL OPERATION HISTORY
S804
READ WHOLE INDIVIDUAL OPERATION HISTORY AND UNAUTHENTICATED OPERATION HISTORY
S816
COLLECT INDIVIDUAL OPERATION HISTORIES
S805
DISPLAY PROC OF OPERATION HISTORY
S817
INTEGRATE INDIVIDUAL OPERATION HISTORIES
S803
DISPLAY PROC OF OPERATION HISTORY
2
S818
OPERATION HISTORY SW DEPRESSED ?
YES
NO
S819
INDIVIDUAL HISTORY SW DEPRESSED ?
YES
S808
DISPLAY INDIVIDUAL AUTHENTICATION SCREEN
NO
S810
OPERATION HISTORY UI OPERATED ?
YES
S811
DISPLAY PROC OF OPERATION HISTORY
NO
S812
OK SW DEPRESSED?
NO
YES
S813
SET SETTING INFORMATION TO IMAGE FORMATION DEVICE
S815
CANCEL SW DEPRESSED ?
YES
S809
INDIVIDUAL AUTHENTICATION SUCCEED ?
NO
YES
S814
CLOSE OPERATION HISTORY DETAILED SETTING SCREEN
NO
END
2
1

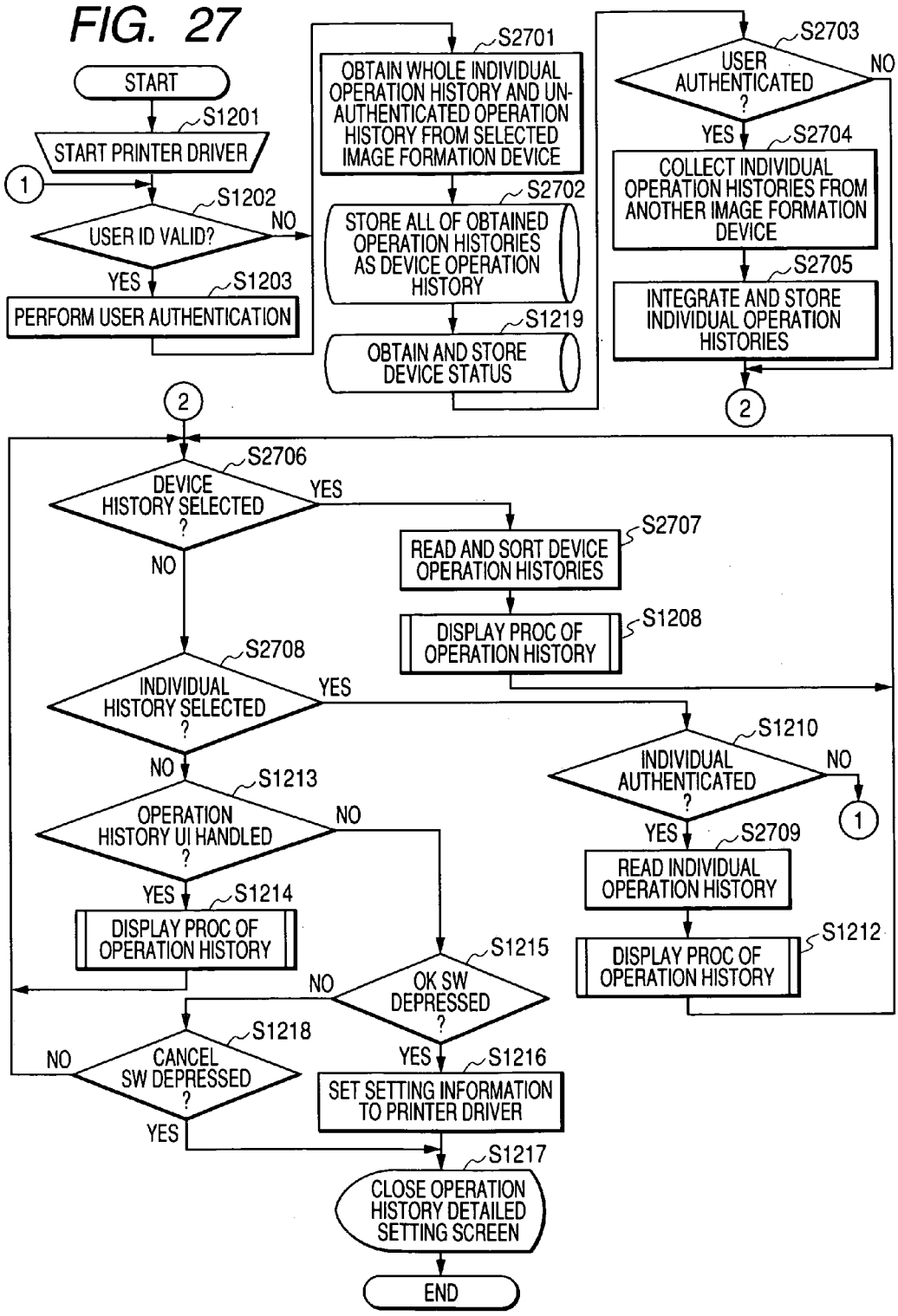
FIG. 27
START
S1201
START PRINTER DRIVER
1
S1202
USER ID VALID?
NO
YES
S1203
PERFORM USER AUTHENTICATION
S2701
OBTAIN WHOLE INDIVIDUAL OPERATION HISTORY AND UN-AUTHENTICATED OPERATION HISTORY FROM SELECTED IMAGE FORMATION DEVICE
S2702
STORE ALL OF OBTAINED OPERATION HISTORIES AS DEVICE OPERATION HISTORY
S1219
OBTAIN AND STORE DEVICE STATUS
S2703
USER AUTHENTICATED ?
NO
YES
S2704
COLLECT INDIVIDUAL OPERATION HISTORIES FROM ANOTHER IMAGE FORMATION DEVICE
S2705
INTEGRATE AND STORE INDIVIDUAL OPERATION HISTORIES
2
2
S2706
DEVICE HISTORY SELECTED ?
YES
NO
S2707
READ AND SORT DEVICE OPERATION HISTORIES
S1208
DISPLAY PROC OF OPERATION HISTORY
S2708
INDIVIDUAL HISTORY SELECTED ?
YES
NO
S1210
INDIVIDUAL AUTHENTICATED ?
NO
1
YES
S2709
READ INDIVIDUAL OPERATION HISTORY
S1212
DISPLAY PROC OF OPERATION HISTORY
S1213
OPERATION HISTORY UI HANDLED ?
NO
YES
S1214
DISPLAY PROC OF OPERATION HISTORY
S1215
OK SW DEPRESSED ?
NO
YES
S1216
SET SETTING INFORMATION TO PRINTER DRIVER
S1218
CANCEL SW DEPRESSED ?
NO
YES
S1217
CLOSE OPERATION HISTORY DETAILED SETTING SCREEN
END

FIG. 28

STORAGE MEDIUM SUCH AS FD, CD-ROM, OR THE LIKE

| DIRECTORY INFORMATION |
| --- |
| 1ST DATA PROC PROGRAM<br>PROGRAM CODE GROUP CORRESPONDING TO STEPS IN FLOW CHARTS OF FIGS. 11 AND 12 |
| 2ND DATA PROC PROGRAM<br>PROGRAM CODE GROUP CORRESPONDING TO STEPS IN FLOW CHARTS OF FIGS. 18 AND 19 |
| 3RD DATA PROC PROGRAM<br>PROGRAM CODE GROUP CORRESPONDING TO STEPS IN FLOW CHART OF FIG. 21 |
| 4TH DATA PROC PROGRAM<br>PROGRAM CODE GROUP CORRESPONDING TO STEPS IN FLOW CHART OF FIG. 24 |
| 5TH DATA PROC PROGRAM<br>PROGRAM CODE GROUP CORRESPONDING TO STEPS IN FLOW CHART OF FIG. 27 |
| |

MEMORY MAP OF STORAGE MEDIUM

IMAGE FORMING DEVICE, SYSTEM, CONTROL METHOD, PROGRAM AND MEMORY MEDIUM UTILIZING OPERATION HISTORY

BACKGROUND OF THE INVENTION

1. Field of the Invention

The present invention relates to an image forming device, an image forming system, a control method for an image forming device, a control method for an image forming system, a program and a memory medium for executing an individual authentication, controlling display information to be displayed on a display unit based on the authenticated individual information and setting a device utilizing an operation history.

2. Related Background Art

In the following there will be given an explanation on display means and a utilizing method of an operation history in a prior image forming device.

At first, an operation sequence of a copying operation in a prior image forming device will be explained with reference to a flow chart shown in FIG. 29.

FIG. 29 is a flow chart showing an example of an operation sequence in a copying operation on a prior image forming device, wherein S3301–S3310 indicate process steps.

At first, an operator selects a function (S3301). It is assumed that a copy function selecting switch is depressed to select a copy function. Thus an LCD panel of an operation unit displays a user interface corresponding to the copy function.

Then the operator executes, on the user interface, a copy magnification setting by a same size switch or a magnification switch (S3302), a size selection of a copy paper by a paper size switch (S3303), and a setting of a number of copies by numeral keys (S3304). Contents of such setting in the steps S3302–S3304 are displayed on a status display of the operation unit, so that the operator can confirm the current setting.

Subsequently, if necessary, the operator depresses a sorter switch to set a sorting method (S3305), then a two-side switch to select a two sided mode (S3306), a density setting switch to set a copy density (S3307) and an application mode switch to set an application mode (S3308).

In these steps S3305–S3308, in response to the depression of each switch, a new user interface image is displayed on the LCD panel for enabling detailed setting, but portions not relating to the features of the present invention will not be explained (except for the setting of the application mode in the step S3308, which will be explained later).

As a copying operation becomes ready by the aforementioned setting operations, the operator depresses a copy start switch thereby giving a copy start instruction to the image forming device (S3309). Upon detecting such instruction, the image forming device executes a copy process (S3310), whereby a copying operation is completed.

Then, a prior method of utilizing an operation history, provided as a function of the application mode, will be explained in the following.

When an operation history switch is depressed in the application mode, the LCD panel provides a popup display of a prior operation history detailed setting screen as shown in FIG. 30.

FIG. 30 is a schematic view showing an example of an operation history detailed setting screen in a prior image forming device.

In FIG. 30, there are shown a history information display screen 3202 for displaying information set in a copy operation in the past, a one-previous switch 3203 for displaying a first previous operation history, a two-previous switch 3204 for displaying a second previous operation history, and a three-previous switch 3205 for displaying a third previous operation history.

A cancel switch 3206 is used for closing the operation history detailed setting screen 3201 without reflecting the set information, displayed in the history information display screen 3202, on the image forming device. An OK switch 3207 is used for closing the operation history detailed setting screen 3201 after reflecting the set information, displayed in the history information display screen 3202, on the image forming device.

The operator, in case for example of wishing to refer to setting information in a second previous operation history, depresses the two-previous switch 3204, whereby the history information display screen 3202 displays information set in a second previous copy operation as the operation history.

In case the operator depresses the OK switch 3207 in this state to utilize the setting information, such setting is automatically set on the image forming device and the operation history detailed setting screen 3201 is automatically closed.

The aforementioned setting function for the copy operation based on the operation history utilizing the history information display screen 3202 allows to significantly simplify (step saving) the setting process for the copy operation explained in the flow chart shown in FIG. 29.

An image forming device utilizing the operation history is described in a patent reference 1:

Patent Reference 1: Japanese Patent Application Laid-open No. 2000-231309.

However, in such prior image forming device in which all the operations thereof are memorized and re-used as operation history of a same level, it is anticipated, in case the image forming device is commonly utilized by plural persons, that also the operation history of other persons having a low possibility of re-use are displayed and the operation history of the operator himself becomes difficult to find.

Also in case the memory of the operation history reaches an upper limit of the memory, namely when three operation histories are memorized in the example shown in FIG. 30, an older operation history is deleted at a subsequent operation thereafter. It is therefore anticipated that the operation history of the operation of the operator in the past may be lost not only by an operation of the operator himself but also by an operation of other persons, and it may be difficult to maintain a convenience of use.

Also since such operation history is retained for each individual image forming device, the re-use of the operation history has only been possible in an image forming device that has been used before. Therefore, in case of using an image forming device that has not been used before, the setting of functions has to be made from the beginning even in an image forming device of a same type as the image forming device that has been used before, and the convenience of use cannot be called of a satisfactory level.

Furthermore, as the operation history in the aforementioned prior image forming device is automatically set on the image forming device by the operations of the one-previous switch 3203, the two-previous switch 3204 or the three-previous switch 3205 for displaying the operation history and the OK switch 3207, the operator may not easily notice a situation where such automatic setting is unusable at the time of setting.

Therefore the operator may notice an improper setting for the first time by an error message displayed on the image forming device, at the start of the actual copy operation after the copy setting with the operation history, and may therefore have to repeat the setting again, and such configuration may constitute a productivity deteriorating factor.

SUMMARY OF THE INVENTION

The present invention is to provide an image forming device, an image forming system, a control method for an image forming device, a control method for an image forming system, a program and a memory medium capable of resolving the aforementioned drawbacks.

An object of the present invention is to provide an image forming device, an image forming system, a control method for an image forming device, a control method for an image forming system, a program and a memory medium, capable of providing an image forming environment which can easily simplify setting operations by an operation history utilizing environment, excellent from the standpoint of the operator taking a situation of use by plural users and a status of the device at the operation into consideration.

Also an object of the present invention is to provide an image forming device, an image forming system, a control method for an image forming device, a control method for an image forming system, a program and a memory medium, capable of solving prior drawbacks that even operation histories of other persons having a low possibility of re-use are also displayed and the operation history of the operator himself becomes difficult to find and that an older operation history is deleted by an operation of another person when the memory of the operation history reaches an upper limit of the memory, whereby the operator can easily select and re-use a desired operation history.

Also an object of the present invention is to provide an image forming device, an image forming system, a control method for an image forming device, a control method for an image forming system, a program and a memory medium, enabling an operator, even when using an image forming device that has not been operated before (not storing an operation history), in case such image forming device is capable of communication with an image forming device of a same type which the operator has operated (storing an operation history therein), to utilize the operation history stored in the image forming device of the same type in the image forming device which the operator has not operated, thereby alleviating the works of all the setting from the beginning even in an image forming device to be used for the first time and solving the drawback that the image forming device used for the first time requires all the setting from the beginning as the operation history in another image forming device cannot be utilized, whereby the operator can easily select and re-use a desired operation history, thus improving the operability and the productivity through effective utilization of the operation history stored in each image forming device.

Also another object of the present invention is to provide an image forming device, an image forming system, a control method for an image forming device, a control method for an image forming system, a program and a memory medium, capable of solving a prior drawback that the operator does not easily notice a situation where an operation set with a past operation history is not usable at the time of setting or where a setting in another image forming device is not usable in the image forming device to be used, but notices an improper setting for the first time by an error message displayed on the image forming device, at the start of the actual copy operation, and executes the setting again thus resulting in a deteriorated productivity, and capable of securely preventing an erroneous setting of an unusable operation history by the operator thereby avoiding a deterioration of productivity by a re-setting, and further capable of providing an image forming environment which can easily simplify setting operations by an operation history utilizing environment, excellent from the standpoint of the operator taking a situation of use by plural users and a status of the device at the operation into consideration.

Also an object of the present invention is to provide an image forming device, an image forming system, a control method for an image forming device, a control method for an image forming system, a program and a memory medium, enabling an operator, in case of image formation from any of image forming devices available from an information processing device, to easily select and re-use a desired operation history from the operation histories of the image forming devices.

Furthermore, an object of the present invention is to provide an image forming device, an image forming system, a control method for an image forming device, a control method for an image forming system, a program and a memory medium, capable, in case of image formation from any of image forming devices available from an information processing device, of securely preventing an operator from an erroneous setting of an operation history not usable at the time of setting or an operation history of another image forming device not usable in the image forming device to be used, thereby avoiding a deterioration in the productivity resulting from a re-setting.

Still other objects of the present invention, and features and advantages thereof, will become fully apparent from the following description, which is to be taken in conjunction with the accompanying drawings.

BRIEF DESCRIPTION OF THE DRAWINGS

FIG. 1 is a block diagram showing a structure of an image forming device constituting a first embodiment of the present invention;

FIG. 8 is a view showing a user ID table stored in an HDD unit (or an unillustrated non-volatile memory) for memorizing user authentication information in the image forming device of the present embodiment;

FIG. 9 is a view showing an individual operation history memory table stored in an HDD unit (or an unillustrated non-volatile memory) for memorizing an operation history of each authenticated individual in the image forming device of the present embodiment;

FIG. 10 is a view showing an unauthenticated operation history memory table stored in an HDD unit (or an unillustrated non-volatile memory) for memorizing an operation history of individually unauthenticated operations (unauthenticated operation history) in the image forming device of the present embodiment;

FIG. 24 is a flow chart showing an example of a fourth control process sequence in the present invention;

FIG. 27 is a flow chart showing an example of a fifth control process sequence in the present invention;

FIG. 28 is a view showing a memory map of a memory medium (storage medium) storing various data processing programs readable with the image forming device or the information processing device of the present invention;

Figure 2:
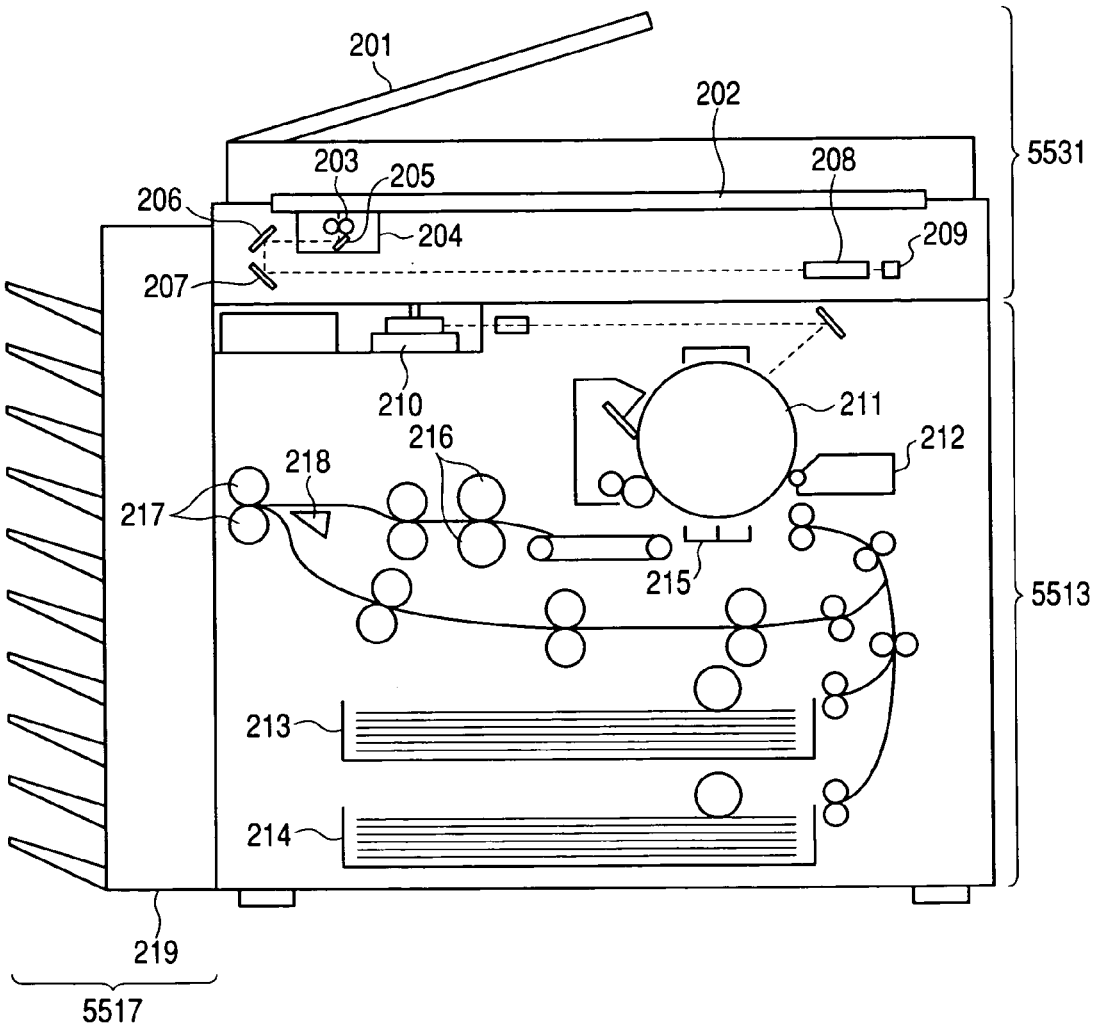
FIG. 2 is a cross-sectional view showing a mechanical structure of a scanner unit, a print unit and a paper discharge unit shown in FIG. 1.

DESCRIPTION OF THE PREFERRED EMBODIMENTS (First Embodiment)

FIG. 1 is a block diagram showing a constitution of an image forming device constituting a first embodiment of the present invention, particularly corresponding to an image forming device having a copy function, a fax function, a print function and the like (also called a digital multi-function device).

Referring to FIG. 1, a main controller unit 5501 is provided therein with a CPU, a RAM, a ROM and the like, and controls the entire image forming device by the execution, by the CPU, of a program stored in the ROM or in another recording medium. An operation unit 5502 serves to accept an operation of an operator to the image forming device and to provide the operator with information such as a state of the device.

An I/O unit 5503 serves for a communication between the operation 5502 with the main controller unit 5501. An LCD panel 5504 provides the operator with information and displays a switch generated by a software. A touch panel unit 5505 detects an operation on the software switch displayed on the LCD unit 5504. A switch unit 5506 is provided physically in order to accept an operation from the operator.

An HDD unit 5507 is utilized for storing print data and programs and as a data cache area. An image memory unit 5508 is used for developing or processing a print image.

An expansion bus 5509 is used for a functional expansion of the image forming device. An NIC (network interface card) unit 5510 is attached to the image forming device, utilizing the expansion bus 5509. A LAN controller 5511 monitors communication packets passing on a LAN and executes a control of receiving a data packet relating to the image forming device and transmitting a data packet generated in the image forming device to the LAN. A transformer unit 5512 executes a voltage conversion for realizing a physical communication between the image forming device and the LAN.

A print unit 5513 executes printing of an image on a paper constituting a recording medium. An output process unit 5514 executes an image processing such as a gamma correction, an edge enhancement and a smoothing, in order to correct image data, transmitted by the main controller unit 5501, into data suitable for printing.

A PWM unit 5517 converts the image data after the image processing into a signal for driving a laser beam. A printer unit 5516 is used for printing an image on paper, based on a signal provided by the laser beam.

A paper discharge unit 5517 discharges a printed paper, prepared in the print unit 5513, to the exterior of the image forming device. An I/O unit 5518 is used for a communication between the paper discharge unit 5517 and the main controller unit 5501. A controller unit 5519 controls the paper discharge unit 5517.

A paper sensor unit 5520 monitors a flow of the paper in the paper discharge unit 5517. A paper feed motor driving unit 5521 drives a motor for conveying the paper. A tray motor driving unit 5522 drives a paper discharge tray. A paper path control unit 5523 control the paper flow.

A fax unit 5524 is attached to the image forming device, utilizing the expansion bus 5509. A memory unit 5525 temporarily stores data to be transmitted or received by the fax unit. A compression unit 5526 executes a compression process on the transmission data at a fax transmission.

An extension unit 5527 executes an extension process on the reception data in a fax reception. A modulation unit 5528 executes a D/A conversion and a modulation process on the transmission data at a fax transmission. A demodulation unit 5529 executes a demodulation and an A/D conversion on the reception data at a fax reception. An NCU unit 5530 is constituted of a voltage conversion unit, a surge protection unit and the like for connecting a modem unit (constituted by the modulation unit 5528 and the demodulation unit 5529) and a public telephone line.

A scanner unit 5531 reads an original for copying. An image sensor unit 5532 converts an optical signal into an electrical signal. An A/D conversion unit 5533 executes a gain regulation, an offset regulation and an A/D conversion on an input signal. A shading unit 5534 executes a known shading correction utilizing a signal read from a reference white board.

In the present embodiment, there will principally be explained an information transmission device constructed as so-called multi-function device having plural operation modes such as a local copy mode for printing job data (also called image data) entered from the scanner unit of the own device by the print unit of the own device through the image memory unit of the own device, a remote copy mode for printing job data (also called image data) entered from the scanner unit of the own device by the print unit of another device, an external copy mode for printing job data entered from an external device such as a host computer or a partner facsimile device by the aforementioned print unit through the aforementioned image memory unit, a box mode for temporarily storing job data, outputted from the scanner unit of the own device and/or the scanner unit of an external device in a box (a recording area provided in a hard disk for each user) of the aforementioned memory unit, and a transmission mode for transmitting job data entered from the scanning unit of the own device to an external device, but the present embodiment is not limited to such configuration and is also applicable to an information processing device of single function (also called single function peripheral: SFP) having at least a copy mode among these plural operation modes.

Also as to the structure of the device, the present embodiment will explain so-called integral device in which the scanner unit and the print unit are integrated, but the present embodiment is also applicable to so-called separate structure device in which the units described in the present embodiment or a part thereof are in separate casings.

FIG. 2 is a cross-sectional view showing a mechanical structure of the scanner unit 5531, the print unit 5513 and the paper discharge unit 5517 shown in FIG. 1.

In the scanner unit 5531 shown in FIG. 2, an original feeder 201 conveys originals, stacked on an original feed table, onto a platen glass 202 one by one starting from a last page, and discharges the original on the platen glass 202 after an original reading operation. The original feed table of the original feeder 201 is equipped with an unillustrated sensor for detecting that an original is placed thereon.

When the original is conveyed onto the platen glass 202, a lamp 203 is turned on and a scanner unit 204 starts a movement, thereby scan exposing the original. A reflected light from the original is guided through mirrors 205, 206, 207 and a lens 208 to a CCD image sensor (hereinafter called CCD) 209.

An image on thus scanned original is read by the CCD 209. Image data thus inputted into the image sensor unit 5532 are supplied to the A/D conversion unit 5533 for a gain regulation and an offset regulation therein, then converted into 8-bit digital data in the A/D converter and supplied to the shading unit 5534. The data are subjected to a known shading correction by the shading unit 5534 utilizing a signal read from a reference white board, and then supplied to the main controller unit 5501.

The main controller unit 5501 sends the image data to the print unit 5513 and requests a print process.

The image data inputted to the output process unit 5514 of the print unit 5513 are subjected to a gamma correction, a sharpness process and a smoothing process for conversion into density data matching density characteristics of a toner, and supplied to the PWM unit 5515. The PWM unit 5515 generates a laser driving signal, which is an analog signal, based on the inputted digital signal.

The laser driving signal drives a laser beam emission unit 210, which emits a laser beam corresponding to such signal. The laser beam irradiates a photosensitive drum 211, thereby forming a latent image corresponding to the laser beam. A developer is deposited by a developing device 212 onto the photosensitive drum 211 in a portion of the latent image. Separately, at a timing in synchronization with the start of irradiation of the laser beam, a recording paper is fed from either of cassettes 213, 214 and is conveyed to a transfer unit 215, where the developer deposited on the photosensitive drum 211 is transferred onto the recording paper. The recording paper bearing the developer is conveyed to a fixing unit 216, in which the developer is fixed to the recording paper by an application of heat and pressure in the fixing unit 216.

The recording paper after passing the fixing unit 216 is discharged by discharge rollers 217 to a paper discharge unit 5517.

In case a two-sided recording is selected, the recording paper is conveyed to the position of the discharge rollers 217, and is then guided to a re-feed conveying path by a reverse rotation of the discharge rollers 217 and by a function of a flapper 218. Also in case a multiple recording is selected, the recording paper is not conveyed to the position of the discharge roller 217 but to the re-feed conveying path by a function of the flapper 218. The recording paper guided to the re-feed conveying path is fed to the transfer unit 215 at a timing explained above.

In the paper discharge unit 5517, the recording sheets discharged from the print unit 5513 are sorted by a paper discharge unit or a sorter 219 into respective bins.

The sorter 219 stores the recording papers in an uppermost bin in case a sorting is not selected.

The foregoing is a process sequence in an ordinary copy operation.

FIG. 2 shows a case where the printer unit 5513 utilizes a laser beam method, but the present invention is likewise applicable to an electrophotographic process (for example LED method) other than laser beam method, a liquid crystal shutter method, an ink jet process, a thermal transfer process, a dye sublimation process or any other process.

Figure 3:
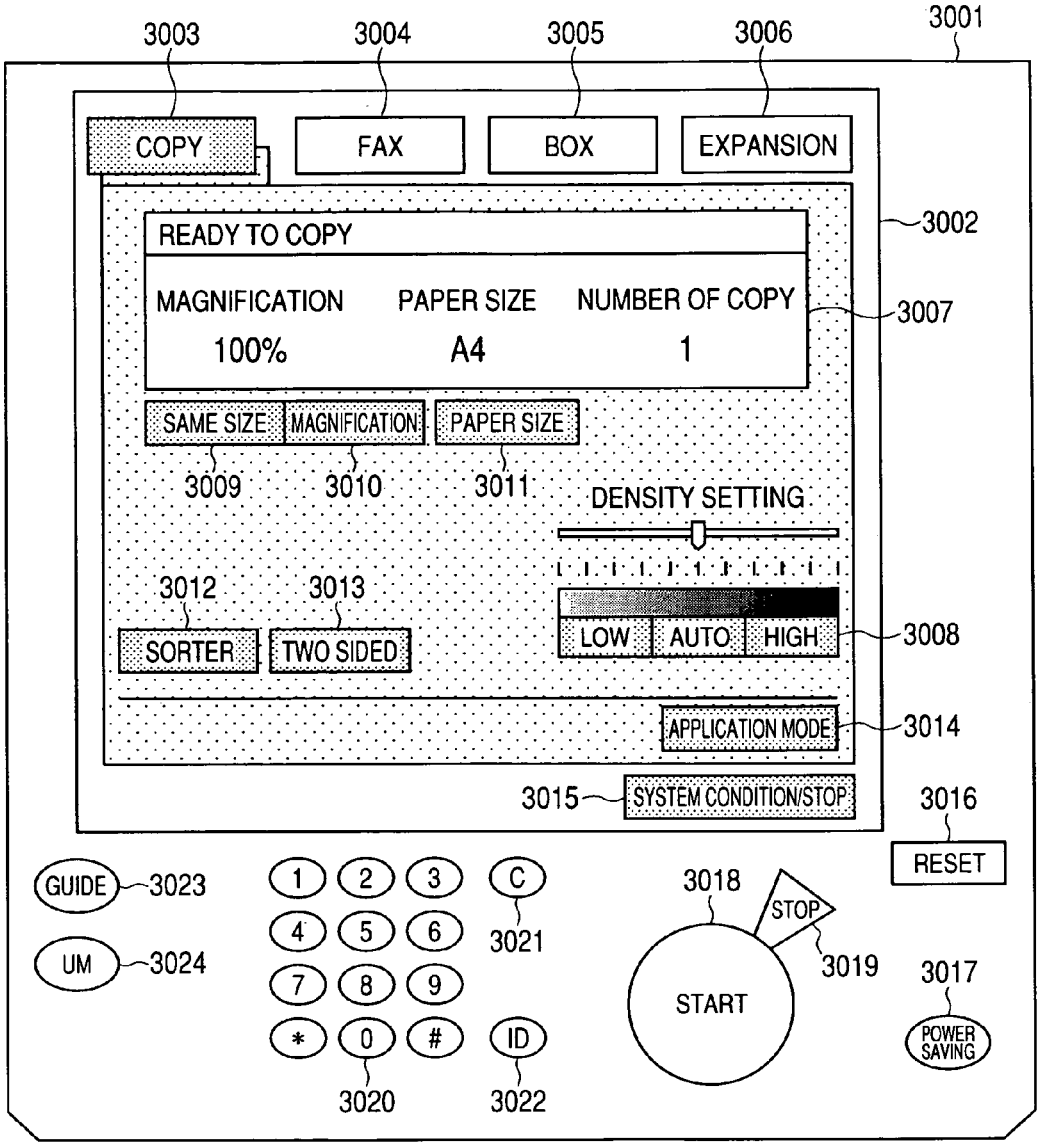
FIG. 3 is a plan view showing a structure of an operation unit shown in FIG. 1.

FIG. 3 is a plan view showing a structure of the operation unit 5502 shown in FIG. 1.

Referring to. FIG. 3, there are provided an operation panel 3001 and an LCD panel 3002 (included in the LCD panel unit 5504 shown in FIG. 1) constituting a display unit positioned on the operation panel 3001. Also a touch panel (included in the touch panel unit 5505 shown in FIG. 1) is provided on the LCD panel 3002 and is utilized for detecting an operation on a software switch displayed on the LCD panel 3002.

In the following description, 3003–3015 correspond to switches and display units displayed by a software on the LCD panel 3002.

A copy function selecting switch 3003 is used for selecting a copy function. A fax function selecting switch 3004 is used for selecting a fax function. A box function selecting switch 3005 is used for selecting a box function. An expansion function selecting switch 3006 is used for utilizing an expansion function, provided for example by an option device.

A state display unit 3007 displays a current set state and a current operation state of the image forming device. A density setting switch 3008 is used for setting a print density. A same size switch 3009 is used for setting a same size print magnification. A magnification switch 3010 is used for setting a print magnification. A paper size switch 3011 is used for selecting a paper size.

A sorter switch 3012 is used for setting a sorter mode in the sorter. A two-side switch 3013 is used for setting a two-side print mode. An application mode switch 3014 is used for selecting an application function usable in the copy. A system condition/stop switch 305 is used for confirming a system condition or utilizing a function of interrupting copy operation.

In the following description, 3016–3024 correspond to switches provided as hardware on the operation panel 3001, and are included in the switch unit 5506 shown in FIG. 1.

A reset switch 3016 is used for initializing a setting. A power saving switch 3017 is used for setting or canceling a power saving mode. A start switch 3018 is used for instructing a start of a copy operation or a fax transmission.

A stop switch 3019 is used for stopping for example a copy operation. Numeral keys 3020 is used for inputting a fax number or a number of copies. A clear key 3021 is used for canceling an inputted number or an inputted character. An ID key 3022 is used for setting an ID number. A guide key 3023 is used displaying an operation guide on the LCD panel 3002. A user mode key 3024 is used for setting specification of the image forming device.

When the operator executes any operation to the image forming device, it is necessary at first to select, among plural functions, any one to be utilized. When the operator wishes to utilize the copy function, the operator depresses the copy function selecting switch 3003 displayed on the LCD panel 3002.

In response the LCD panel 3002 displays a screen as shown in FIG. 3 providing a user interface necessary for utilizing the copy function. Similarly the fax function selecting switch 3004 for the fax function, the box function selecting switch 3004 for the box function, or the expansion function selecting switch 3006 for the expansion function is depressed and a user interface displayed in response on the LCD panel 3002 is to be utilized.

In the following there will be explained a method of utilizing an operation history provided as a function of the application mode.

Figure 4:
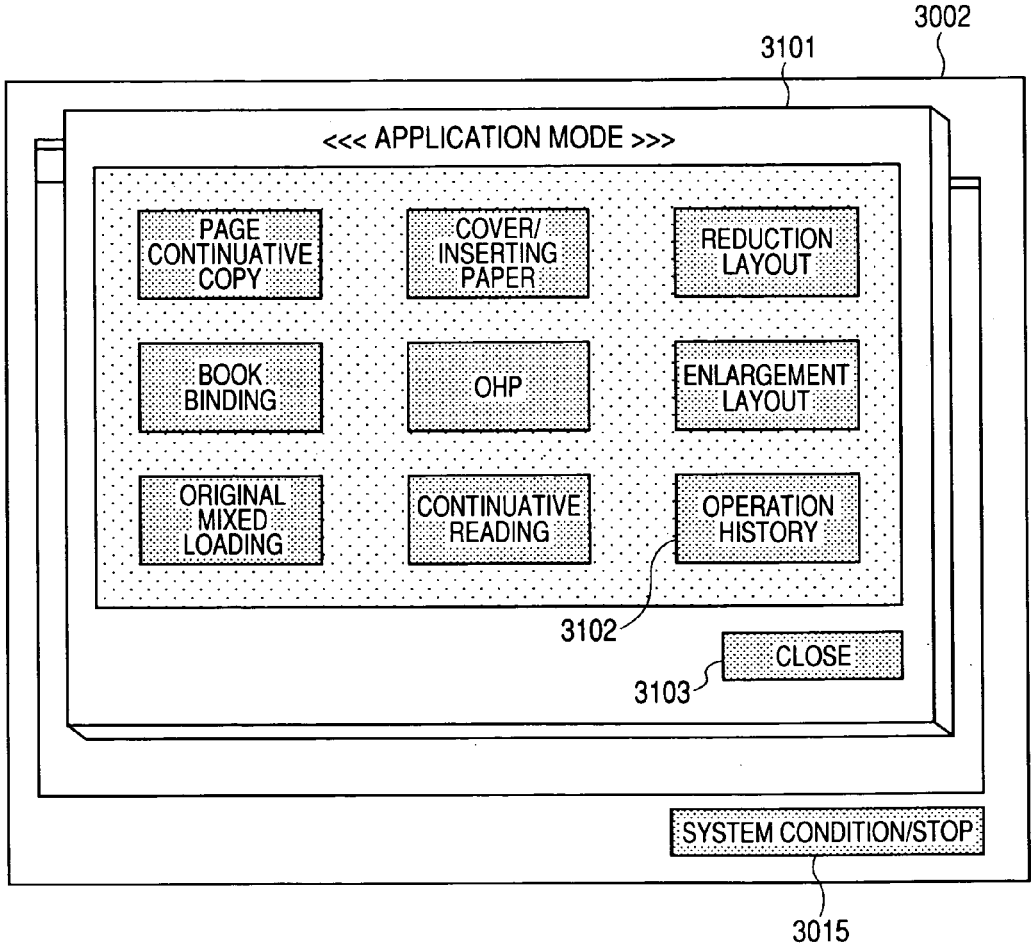
FIG. 4 is a schematic view showing an example of an application mode details setting screen, popup displayed on an LCD panel shown in FIG. 3.

When the application mode switch 3014 is depressed, under a control from the main controller unit 5501, an application mode details setting screen 3101 shown in FIG. 4 is popup displayed on the LCD panel 3002.

FIG. 4 is a schematic view showing an example of an application mode details setting screen which is popup displayed on the LCD panel 3002 shown in FIG. 3, wherein components same as those in FIG. 3 are represented by same symbols.

In FIG. 4, an application mode details setting screen 3101 has an operation history switch 3102, which has to be depressed for utilizing the operation history. A close switch 3103 is used for closing the popup displayed application mode details setting screen 3101.

Figure 5:
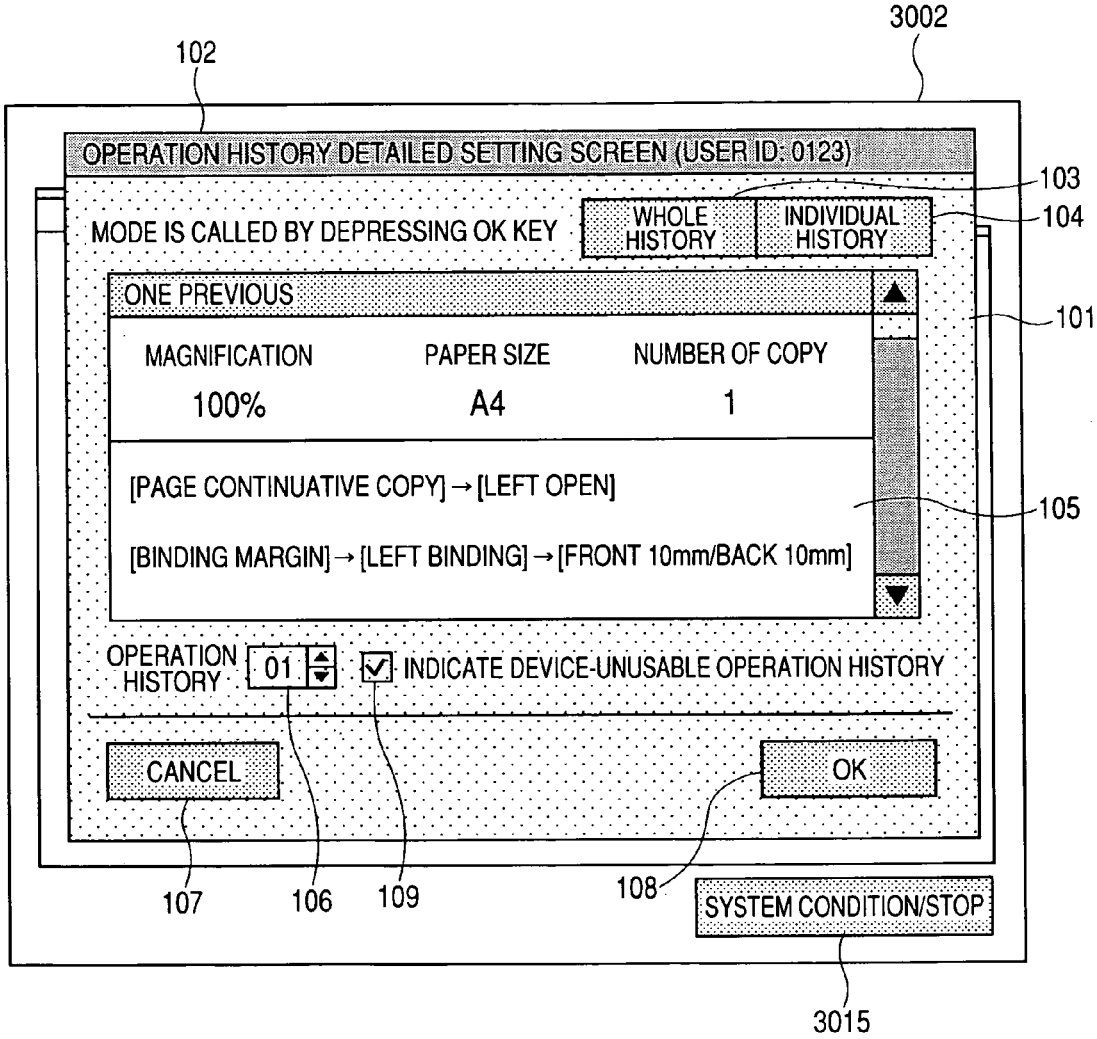
FIG. 5 is a schematic view showing a structure of an operation history details setting screen, popup displayed on the LCD panel shown in FIG. 3.

When the operation history switch 3102 is depressed (touched), under a control from the main controller unit 5501, an operation history details setting screen 101 shown in FIG. 5 is popup displayed on the LCD panel 3002.

FIG. 5 is a schematic view showing a structure of an operation history details setting screen which is popup displayed on the LCD panel 3002 shown in FIG. 3, wherein components same as those in FIG. 3 are represented by same symbols.

In FIG. 5, a display 102 indicates a user ID of the operator who has a current individual authentication, displayed to the right of a title display "operation history details setting screen" and corresponding to "USER ID:0123" in the example shown in FIG. 5.

A whole history switch 103 is used for setting the operation history of the entire device as the object of utilization (namely setting the history mode at a whole history mode). An individual history switch 104 is used for setting the operation history of a person currently subjected to an individual authentication as the object of utilization (namely setting the history mode at an individual history mode). A history information display screen 105 displays setting information which is set when a copy operation was executed in the past, and includes setting information relating to one or more image forming conditions of date and time of operation, an image quality, an image drawing method, a print speed, a fixing process, a paper feeding process, and a paper discharging process.

In case an individual authentication is already made at the time of display of the operation history details setting screen 101, an individual history is set in the operation history, but in case an individual authentication is not yet made, a whole history is set in the operation history, and these are made switchable by the whole history switch 103 and the individual history switch 104.

Also in case the whole history is displayed on the history information display screen 105 (in case of whole history mode), an operation user name, indicating the user who has made the operation, may also be displayed on the history information display screen 105.

An operation history selecting UI 106 is used for specifying an operation history from plural operation histories. A cancel switch 107 is used for canceling the operation on the operation history details setting screen 101 and closing the screen.

An OK switch 108 is used for reflecting the setting information, displayed on the history information display screen 105, on the operation screen shown in FIG. 3 and closing the operation history details setting screen 101. In response, the main controller unit 5501 causes the setting information, based on the operation history selected in the operation history details setting screen 101, to be displayed on the operation screen shown in FIG. 3. 109 indicates a control UI for setting whether to activate or to deactivate a function of indicating an operation history a device unusable operation history to the operator (indicating function).

Figure 6:
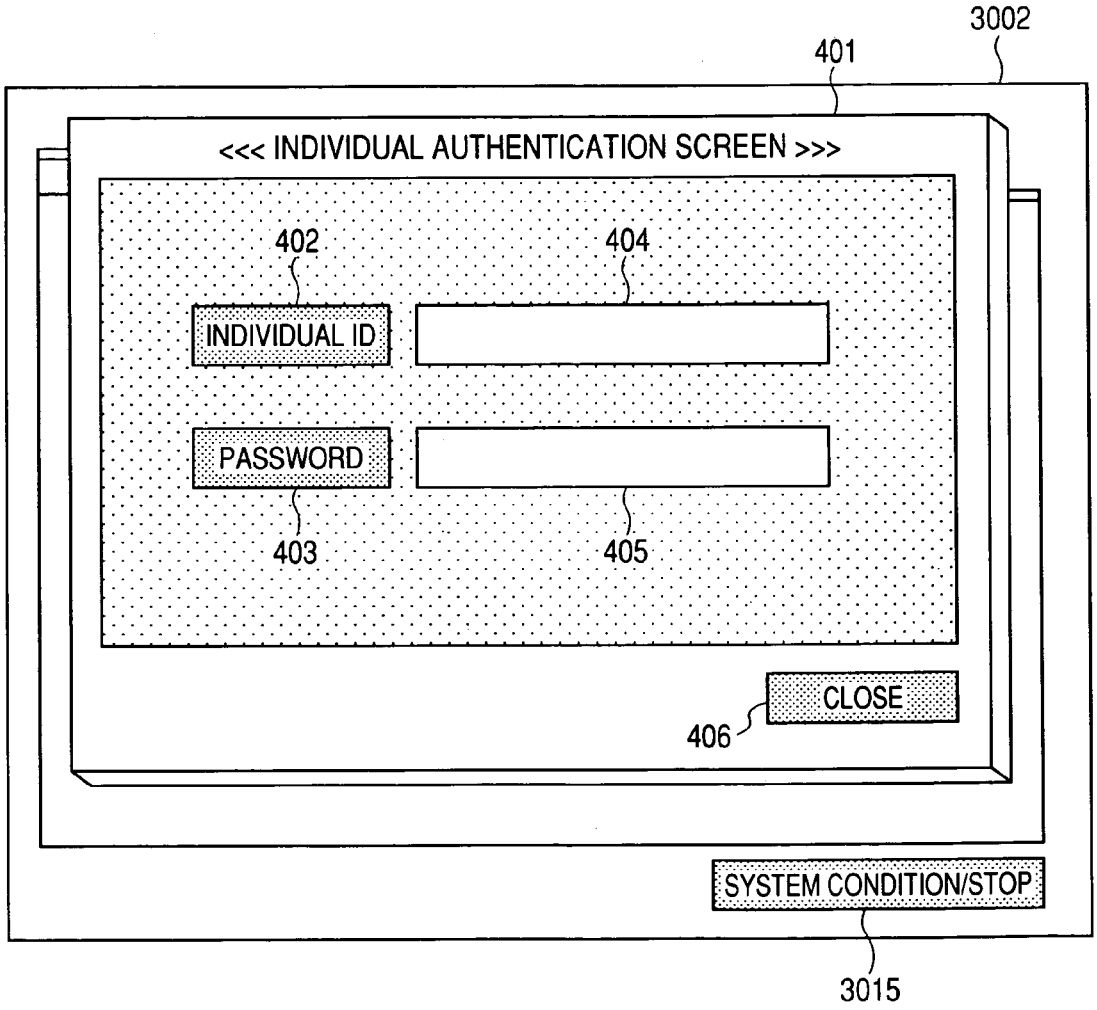
FIG. 6 is a schematic view showing a structure of an individual authentication screen, popup displayed on the LCD panel shown in FIG. 3.

When the individual authentication switch 104 is depressed (touched), under a control from the main controller unit 5501 shown in FIG. 1, an individual authentication details setting screen 401 shown in FIG. 6 is popup displayed on the LCD panel 3002.

Also in case an authenticated user designates a specified operation history within the operation history of such authenticated user or a whole operation history of such authenticated user and actuates an unillustrated history deleting button, the main controller unit 5501 detects such operation and deletes thus designated history information from the HDD unit 5507. It is thus rendered possible to rearrange the individual histories according to the necessity or to delete all the individual histories to an initial state.

Also a priority may be made selectable in order to preferentially display a predetermined operation history.

Furthermore a title desired by the user may be made settable to a predetermined operation history.

Also in case an authenticated manager designates a specified operation history within the whole operation history or a whole operation history and actuates an unillustrated history deleting button, the main controller unit 5501 detects such operation and deletes thus designated history information from the HDD unit 5507. It is thus rendered possible to rearrange the individual histories or the unauthenticated operation histories according to the necessity or to delete all the individual histories to an initial state.

It is also possible to store a frequency of re-use of each operation history in the HDD unit 5507 at every re-use of the operation history and to cause the main controller unit 5501 to delete each operation history based on the frequency of re-use of each operation history, at a predetermined period (for example a period of about 1 month). More specifically, it is possible to delete an operation history of a frequency of re-use lower than a predetermined threshold value or an operation history that has not been re-used for a predetermined period.

FIG. 6 is a schematic view showing a structure of an individual authentication screen which is popup displayed on the LCD panel 3002 shown in FIG. 3, wherein components same as those in FIG. 3 are represented by same symbols.

In FIG. 6, an individual ID switch 402 is used for setting an individual ID input mode, and a depression thereof enables an input of an individual ID into an individual ID input unit 404 with the numeral keys 3020.

A password switch 403 is used for setting a password input mode, and a depression thereof enables an input of a password into a password input unit 405 with the numeral keys 3020.

A close switch 406 is used for closing the popup displayed individual authentication screen 401.

The individual authentication screen 401 is popup displayed when the an original for copying is set on the original feed table of the original feeder 201, also in case the ID switch 3022 is depressed by the operator.

Now a process sequence in an ordinary copy operation in the aforementioned constitution will be explained with reference to a flow chart shown in FIG. 7.

Figure 7:
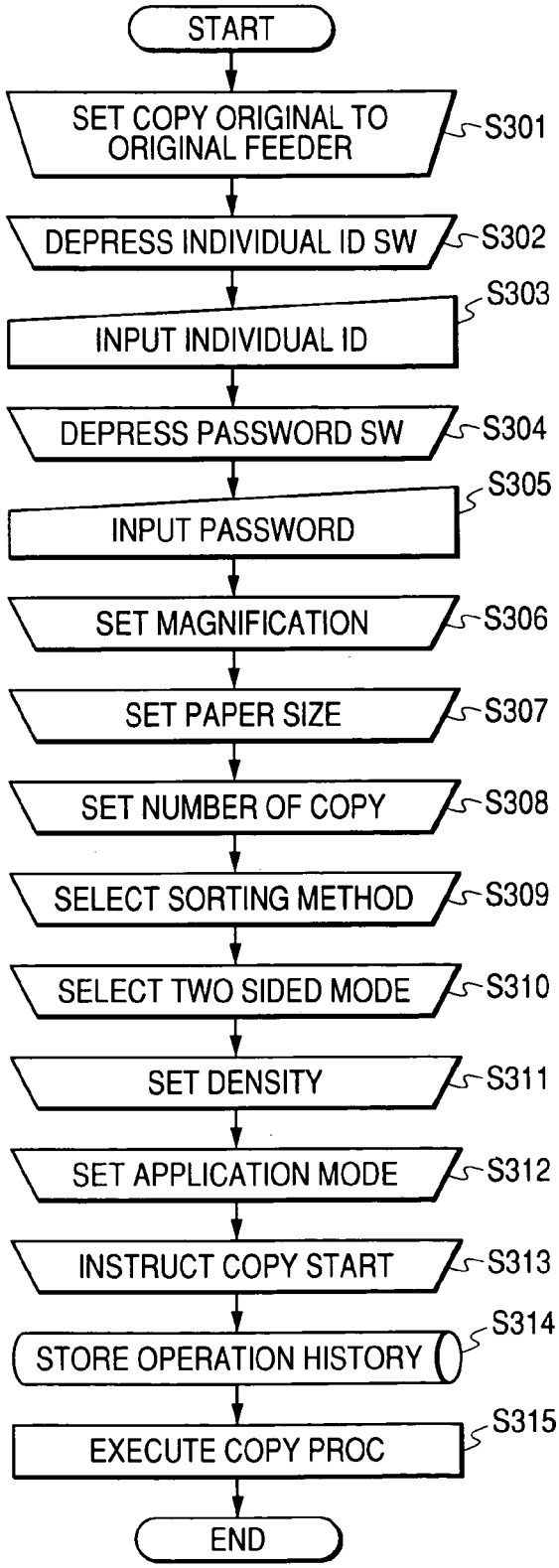
FIG. 7 is a flow chart showing an operation sequence and a process sequence in case of a copy operation with an image forming device of the present invention.

FIG. 7 is a flow chart showing an example of an operation sequence and a process sequence in case of a copy operation with the image forming device of the present invention, wherein S301–S315 indicates process steps in which steps S301–S315 correspond to operation sequences of the operator while steps S314 and S315 are executed by the main controller unit 5501 shown in FIG. 1, according to program stored in the HDD unit 5507, the ROM in the main controller unit 5501 or another recording medium.

In case of a copy operation with the image forming device of the present invention, the operator has to set an original for copying on the original feeder 201 or on the platen glass 202, and a case of setting it on the original feeder 201 will be explained in the following.

When the operator sets a copy original on the original feed table of the original feeder 201, an unillustrated original sensor provided in the original feeder 201 detects such setting of the copy original and this information is transmitted to the main controller unit 5501.

The main controller unit 5501, upon detecting the setting of the copy-original (S301), communicates with the I/O unit 5503 of the operation unit 5502 and instructs a display of the individual authentication screen shown in FIG. 6. The individual authentication screen 401 is displayed on the LCD 3002 provided on the operation panel 3001 and can be viewed by the operator. On the other hand, in case the copy original is set on the platen glass 202, the aforementioned automatic detection of the copy original is not executed, but the operator can depress the ID switch 3022 to intentionally display the individual authentication screen 401 on the LCD panel 3002.

When the individual authentication screen 401 is displayed, the operator usually depresses the individual ID switch 402 (S302) to set the details setting ID input mode and then inputs an individual ID in the individual ID input unit 404 with the numeral keys 3020 (S303). Then the operator depresses the password switch 403 (S304) to set the password input mode and then inputs a password in the password input unit 405 with the numeral keys 3020 (S305). However, the operator, in case of not wishing an individual authentication or not given an individual authentication ID from the manager of the image forming device, can skip the individual authentication by depressing the close switch 406 without inputting the individual ID and the password. Nevertheless, in such case, the operator cannot enjoy a part of the services that are made available by the individual authentication.

After the individual ID and the password are inputted according to the normal flow, the operator closes the close switch 406 to establish the inputs.

The depression of such switch displayed by a software on the LCD panel 3002 is detected by the touch panel unit 5505 and is transmitted through the I/O unit 5503 to the main controller unit 5501. In response to the input information of the individual ID switch 402 and the password switch 403, the main controller unit 5501 sets the individual ID input mode and the password input mode.

Also the main controller unit 5501, in response to the input information transmitted from the touch panel unit 5505 (depression information of the close switch 406), obtains the inputted individual ID and the password, and executes a comparison with a user ID table 501 (shown in FIG. 8 to be explained later) stored in the HDD unit 5507 shown in FIG. 1 (or in an unillustrated non-volatile memory).

FIG. 8 shows a user ID table stored for memorizing the authentication information of the user in the image forming device of the present embodiment, in the HDD unit 5507 (or in an unillustrated non-volatile memory).

Based on the information of the user ID table 501, the main controller unit 5501 confirms whether the inputted individual ID and password are proper, and, if identified proper, closes the individual authentication screen 401 and displays a copy operation screen shown in FIG. 3 on the LCD panel 3002.

On the other hand, in case the individual ID and the password are identified ineffective, the main controller unit 5501 does not close but continues to display the individual authentication screen 401 in order to request re-input of the individual ID and the password. However, in case the operator does not wish the individual authentication for any reason, it is also possible to forcedly close the individual authentication screen 401 by depressing the ID switch 3022 or the reset switch 3016.

When the copy operation screen shown in FIG. 3 is displayed on the LCD panel 3002, the operator executes operations of following steps S306–S312 according to the necessity, for various setting for the copy operation.

In case a change in the copy magnification is necessary, the same size switch 3009 and the magnification switch 3010 are operated for setting a copy magnification (S306). Upon detecting the depression of the magnification switch 3010, the main controller unit 5501 display a details setting screen for setting the magnification on the LCD panel 3002, but such screen will not be explained.

Also in a similar manner, in case a change in the paper size is necessary, the paper size switch 3011 is operated to display a details setting screen and a selection of the paper size is executed (S307). In case a change in the number of copies is necessary, the numeral keys 3020 are operated for setting a number of copies (S308). In case a change in the sorting method is necessary, the sorter switch 3012 is depressed to display a details setting screen and a sorting method is selected (S309). In case a change to the two-sided mode is necessary, the two sided switch 3013 is depressed to display a details setting screen and a two-sided mode is selected (S310). In case a change in the density is necessary, the density setting switch 3008 is operated to set a density (S311). In case the use of an application mode is desired, the application mode switch 3014 is depressed to display a details setting screen and a setting is executed for each application mode (S312).

When the preparation for starting the copy operation is completed by the aforementioned operations, the operator depresses the start switch 3018 to instruct the start of the copy operation to the image forming device (S313). The depression of the start switch 3018 is detected by the switch unit 5506 of the operation unit 5502 and is transmitted to the main controller unit 5501 through the I/O unit 5503.

The main controller unit 5501, at the timing of detection of the depression of the start switch 3018, executes a process of memorizing the operation history in an operation history table (shown in FIGS. 9 and 10 to be explained later) (S314).

FIG. 9 shows an individual operation history memory table stored in the HDD unit 5507 (or in an unillustrated non-volatile memory) for memorizing the operation history of each individual having an individual authentication.

As shown in FIG. 9, the individual operation history memory table is provided for each user.

In case the authentication for the person currently operating the image forming device has been completed by the procedure of the steps S302–S305, the setting items set in the current copy operation are memorized in the individual operation history memory table provided for such person.

FIG. 9 shows an example where the setting information includes a magnification, a paper size and a number of copies in addition to a number of the operation history and time and date of operation, but it is naturally possible to memorize and re-use later any and all the setting items relating to the copy operation, such as an image quality, an image drawing method, a print speed, a finishing process, a paper feed process, a paper discharge process or the like. Also the present embodiment only refers to a copy operation, but it is naturally possible to memorize and re-use later, as the operation history, any and all the setting items relating to a fax function, a print function, a box (data server) function, a scanner function, a data transmission function and the like that may be provided in a digital multi-function device.

FIG. 10 shows an unauthenticated operation history memory table stored in the HDD unit 5507 (or in an unillustrated non-volatile memory) for memorizing the operation history of an operation not having an individual authentication (unauthenticated operation history).

All the operation histories of an operator not having an individual authentication are stored in the unauthenticated operation history memory table shown in FIG. 10.

After the completion of the process for memorizing the operation history in the operation history table (S314), a copy process explained in FIGS. 1 and 2 is executed under the control of the main controller unit 5501 (S315).

In the following, there will be explained a process sequence of the copy operation utilizing the operation history of the present invention.

The operation history becomes usable by a depression of the application mode switch 3014 at the timing of the step S312 shown in FIG. 7. In response to the depression of the application mode switch 3014, an application mode details setting screen 3101 is popup displayed on the LCD panel 3002 and the operation history switch 3102 becomes operable.

In response to a depression of operation history switch 3102, an operation history details setting screen 3101 shown in FIG. 5 is popup displayed on the LCD panel 3002 and the use of the operation history becomes possible.

In the following there will be explained, with reference to flow charts shown in FIGS. 11 and 12, a process sequence of the copy function in case an operation history is used in the image forming device of the present invention.

Figure 11:
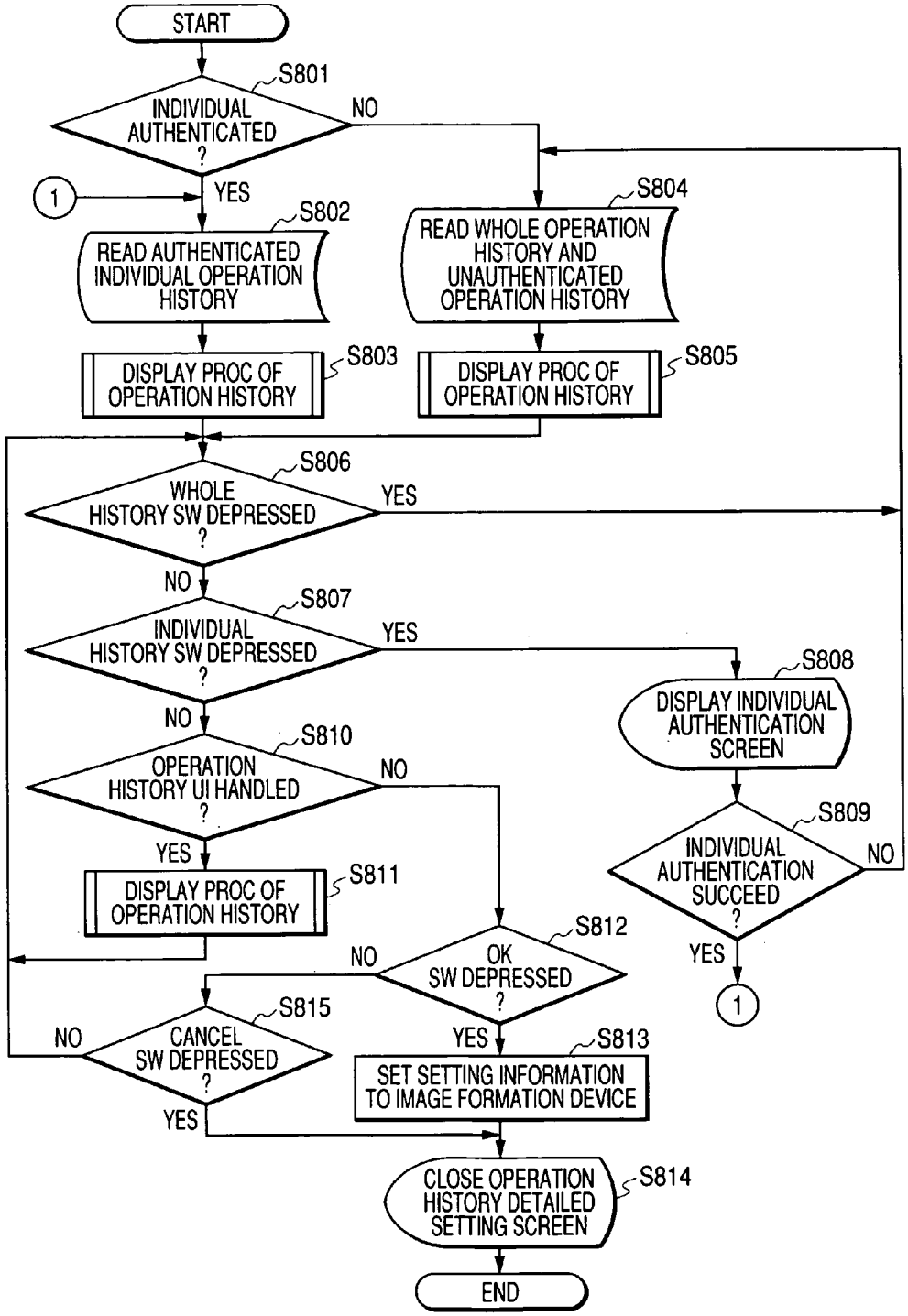
FIG. 11 is a flow chart showing an example of a first control process sequence in the present invention.
Figure 12:
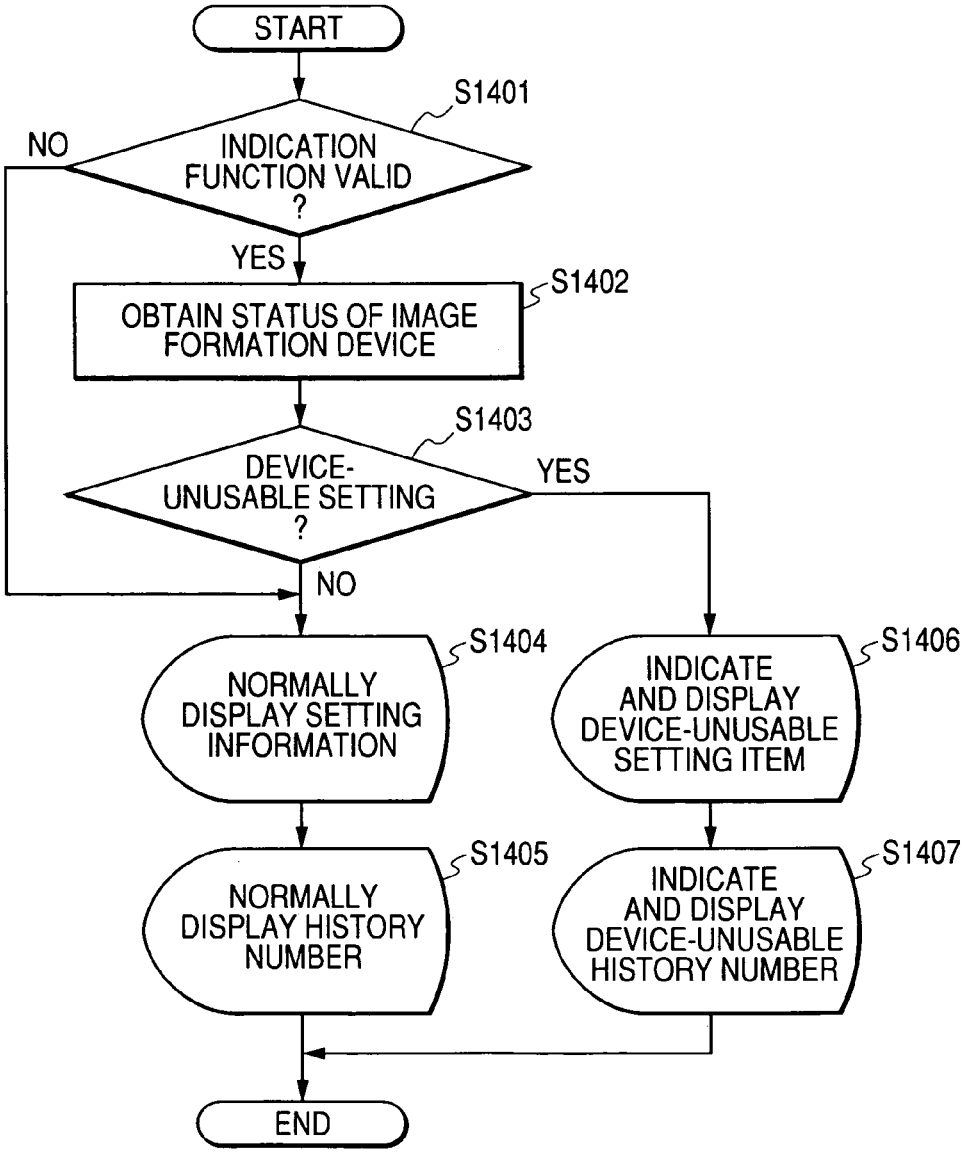
FIG. 12 is a flow chart showing an example of a first control process sequence in the present invention.

FIGS. 11 and 12 show flow charts indicating an example of a first control sequence in the present invention, executed by the main controller unit 5501 shown in FIG. 1, based on a program stored in the HDD unit 5507, in a ROM in the main controller unit 5501 or in another recording medium. S801–S815 in FIG. 11 and S1401–S1407 in FIG. 12 indicate process steps.

The main controller unit 5501 shown in FIG. 1, upon detecting a depression of the operation history switch 3102 in the application mode screen shown in FIG. 4, starts a process of the flow chart shown in FIG. 11 and discriminates, prior to the display of the operation history details setting screen 101 shown in FIG. 5, whether a current operation is executed by an operation having an individual authentication (S801).

In case the main controller unit 5501 identifies an individual authentication in the step S801, the main controller unit 5501 reads an operation history information corresponding to the individually authenticated user from the individual operation history memory table (FIG. 9) in the HDD unit 5507 shown in FIG. 1 (S802), and executes a display process of displaying latest operation history information among the obtained operation history information on the operation history display screen 105 (S803).

The display process in this step S803 will be explained further with reference to a flow chart shown in FIG. 12.

In the display process of the step S803, main controller unit 5501 at first discriminates, as shown in FIG. 12, an effective/ineffective state of an indicating function for indicating a device-unusable operation history to the operator by confirming a setting of the control UI 109 for setting an effective/ineffective state of such function (S1401), then, in case of identifying that the indicating function is set in an effective state, obtains a current state of the image forming device (S1402) in continuation, and discriminates whether the setting information of the operation history to be displayed includes a setting item which is currently unusable for the image forming device (S1403).

In case the step S1403 identifies that the unusable setting item does not exist, the main controller unit 5501 executes a display in a normal manner of the setting information of the operation history corresponding to the history information display screen 105 (S1404) and in succession a display in a normal manner of a corresponding operation history number (S1405).

On the other hand, in case the step S1403 identifies that the currently unusable setting item exists, the main controller unit 5501 displays the setting information of the operation history corresponding to the history information display screen 105 and also shows the currently unusable setting item by a gray-out (or flashing or reversal) display thereby clearly indicating such non-reusable setting item to the operator (S1406).

Figure 13:
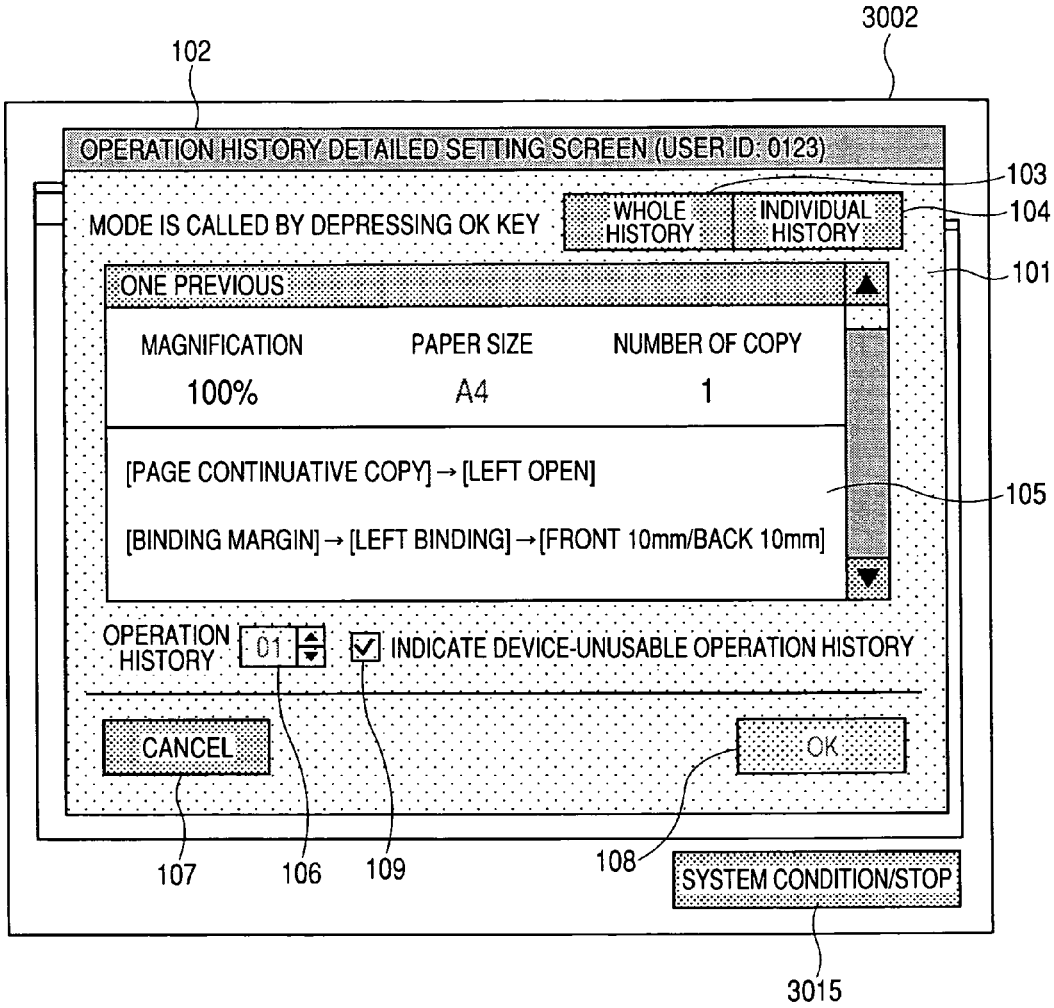
FIG. 13 is a schematic view showing a state of the operation history details setting screen shown in FIG. 5, in which an unusable history is indicated.

Then the main controller unit 5501 also provides a gray-out (or flashing or reversal) display for the corresponding operation history number (S1407), thereby clearly indicating to the operator that the operation history memorized in this operation history number is currently unusable, and also maintains the OK switch 108 in a gray-out state so as that the operator cannot select this operation history number, thereby avoiding selection of the unusable operation history. More specifically, for example an operation history "01" utilizing an A4-sized paper in the operation history details setting screen 102 shown in FIG. 13 is identified as currently unusable in the step S1403 because the A4-sized paper is not contained in the image forming device, a display portion "A4" of the paper size information on the history information display screen 105 is grayed out, and a number and an OK switch 108 on the operation history selection UI 106 are also grayed out whereby the display is so controlled as to disable the selection. It is thus made possible to securely prevent a situation where the operator executes a setting with the currently unusable operation history "01".

Now reference is made again to a step S1401 in FIG. 12.

In case the step S1401 identifies that the function of indicating the unusable operation history to the operator is set in an ineffective state, the main controller unit 5501 branches to a step S1404 to display the setting information and the history number in a normal manner as explained above, regardless whether the utilization is possible or not (S1404, S1405)

Now reference is made again to a step S803 in FIG. 11.

In the display process in the step S803 shown in FIG. 11, the operation history selecting UI 106 displays a number "01", indicating that the latest operation history is displayed. However, in case the operation history of the operator having the individual authentication does not exist at all (in case the authenticated individual operates the image forming device for the first time), it is desirable that the operation history selecting UI 106 displays a number "00" or a blank and that the history information display screen 105 displays a blank or a message indicating the absence of the operation history.

Also in case the step S801 identifies that the operation is executed by an unauthenticated user not having an individual authentication, the main controller unit 5501 reads the operation histories of all the users from the individual operation history memory table (FIG. 9) of the HDD unit 5507 and the unauthenticated operation history memory table (FIG. 10) (S804), then merges all the obtained operation history information, and, after a sorting in the order of time stamps, executes a display process of displaying the latest operation history information on the history information display screen 105 (S805).

The display process in the step S805 is similar to that in the step S803, which has already been explained with reference to the flow chart in FIG. 12, and will not therefore be explained again.

Also in the display process in the step S805 as in the step S803, the operation history selecting UI 106 displays a number "01", indicating the latest operation history. However, in case the operation history does not exist at all (case of first operation of the image forming device), it is desirable that the operation history selecting UI 106 displays a number "00" or a blank and that the history information display screen 105 displays a blank or a message indicating the absence of the operation history.

Then an operation of the operator is awaited, and, in a step S806, the main controller unit 5501 discriminates whether the whole history switch 103 has been depressed, and, if yes, the aforementioned process of the steps S804 and S805 are executed. This process is effective for example in case an operator having the individual authentication wishes to utilize, not limited to the individual operation history, the whole operation history.

On the other hand, in case the step S806 identifies that the whole history switch 103 has not been depressed, the main controller unit 5501 proceeds to a step S807 and discriminates whether the individual history switch 104 has been depressed.

In case the step S807 identifies that the individual history switch 104 has been depressed, the main controller unit 5501 executes a popup display of the individual authentication screen 401 on the LCD panel 3002 (S808) and requests an individual authentication to the operator, in order to display the operation history of a specified individual. Then authentication information is inputted by the operator and the main controller unit 5501 discriminates whether the individual authentication is made successfully (S809).

In case the step S809 identifies that the individual authentication has been made successfully, the main controller unit 5501 executes the process of the steps S802 and S803, and thereupon displays the operation history of the authenticated individual on the history information display screen 105.

On the other hand, in case the step S809 identifies that the individual authentication has not been successful, the main controller unit 5501 executes the process of the steps S804 and S805, and thereupon displays the whole operation history on the history information display screen 105.

Also in case the step S807 identifies that the individual history switch 104 has not been depressed, the main controller unit 5501 proceeds to a step S810 and discriminates whether the operation history UI 106 has been operated (S810).

In case the step S810 identifies that the operation history UI 106 has been operated, the main controller unit 5501 displays an increased or decreased number according to an operation of the up/down switch in the operation history UI 106, also reads an operation history corresponding to such operation history number from the individual operation history memory table (FIG. 9) or from the whole operation history table (FIG. 10) generated by sorting in the step S804 and executes a display process for displaying the setting information of such operation history (S811). The display process in the step S811 is similar to that in the step S803 or S805, which has already been explained with reference to the flow chart in FIG. 12, and will not therefore be explained again.

In the display process in the step S811, the number of the operation history selected by the operation of the up/down switch in the operation history UI 106 is displayed in the operation history selecting UI 106.

On the other hand, in case the step S810 identifies that the operation history UI 106 has not been operated, the main controller unit 5501 proceeds to a step 812 to discriminate whether the OK switch 108 has been depressed.

In case the step S812 identifies that the OK switch 108 has been depressed, the main controller unit 5501 sets the setting information currently displayed on the history information display screen 105 on the image forming device (S813), and then closes the operation history details setting screen 101 (S814) thereby terminating the process sequence utilizing the operation history. Thereafter, upon detecting the instruction of the start switch 3018 shown in FIG. 3, the main controller unit 5501 starts a print process based on the setting information set in the step S813.

On the other hand, in case the step S812 identifies that the OK switch 108 has not been depressed, the main controller unit 5501 proceeds to a step S815 and discriminates whether the cancel switch 107 has been depressed.

In case the step S815 identifies that the cancel switch 107 has been depressed, the main controller unit 5501 skips the process (S813) of setting on the image forming device, and closes the operation history details setting screen 101 (S814) thereby terminating the process sequence utilizing the operation history.

On the other hand, in case the step S815 identifies that the cancel switch 107 has not been depressed, the main controller unit 5501 returns the process to a state of the step S806 for awaiting an operation from the operator.

The above-described process enables the operator to refer to the whole operation history or the individual operation history and to reflect, whenever necessary, the setting information of the copy function, set in the past, on the image forming device. When the start switch 3018 is depressed by the operator after this process, the copy process of the step S315 in FIG. 7 is executed, based on thus set setting information.

The foregoing procedure executes the copy function of the image forming device utilizing the operation history details setting screen 101 of the present embodiment.

In the foregoing embodiment, the individual authentication is explained to be executed by a user ID (individual ID) and a password utilizing the details setting screen 401 explained in FIG. 9, but it is naturally possible to utilize any authenticating method such as an authentication with various cards such as an IC card, an ID card, or a memory card, an authentication with a voice, a fingerprint authentication, a capillary vein authentication, a venous pattern authentication, a corneal authentication, or a facial authentication.

As explained in the foregoing, it is made easily possible to select and set a desired operation history by the individual history, without the drawback in the prior technology that the entire operation histories are forcedly displayed even including the operation history of another person that has a low practical possibility of re-use whereby the operation history of the operator himself becomes difficult to find.

Also by memorizing the operation history for each individual and by setting an upper limit of the number of the memorized operation histories for each individual, it is possible to prevent, when the number of the memorized histories reaches an upper limit, that the history of a person is deleted by the history of another person.

Also in case a past operation memorized in the operation history becomes unusable at the time of display of such operation history, such situation is informed to the operator, thereby securely avoiding a productivity deteriorating factor that a setting based on an unusable operation history causes an error at the start of operation and necessitates a repeated setting operation.

The present embodiment has been explained by a local copy mode in which original data are inputted from the scanner unit of the own device and are printed in the print unit of the own device, but the aforementioned simplification of the setting operation of the image forming device by a re-use of the individual history or the whole history is naturally applicable also to a facsimile transmission mode, a box mode, or a remote copy mode in which original data are inputted from the scanner unit of the own device and are printed in the print unit of another device.

(Second Embodiment)

The foregoing first embodiment has explained a constitution of calling an individual history or a whole history stored in an image forming device from an operation history details setting screen displayed on the operation unit of the image forming device and re-using such history in the setting of a copy function, a fax function, a box function or the like in the image forming device, but it is also possible to call an individual history or a whole history stored in an image forming device from a setting screen of a printer driver functioning on an information processing device capable of communication with the image forming device and re-using such history for the resetting of a print function of the data transmitted from the information processing device. In the following, such embodiment will be explained.

Figure 14:
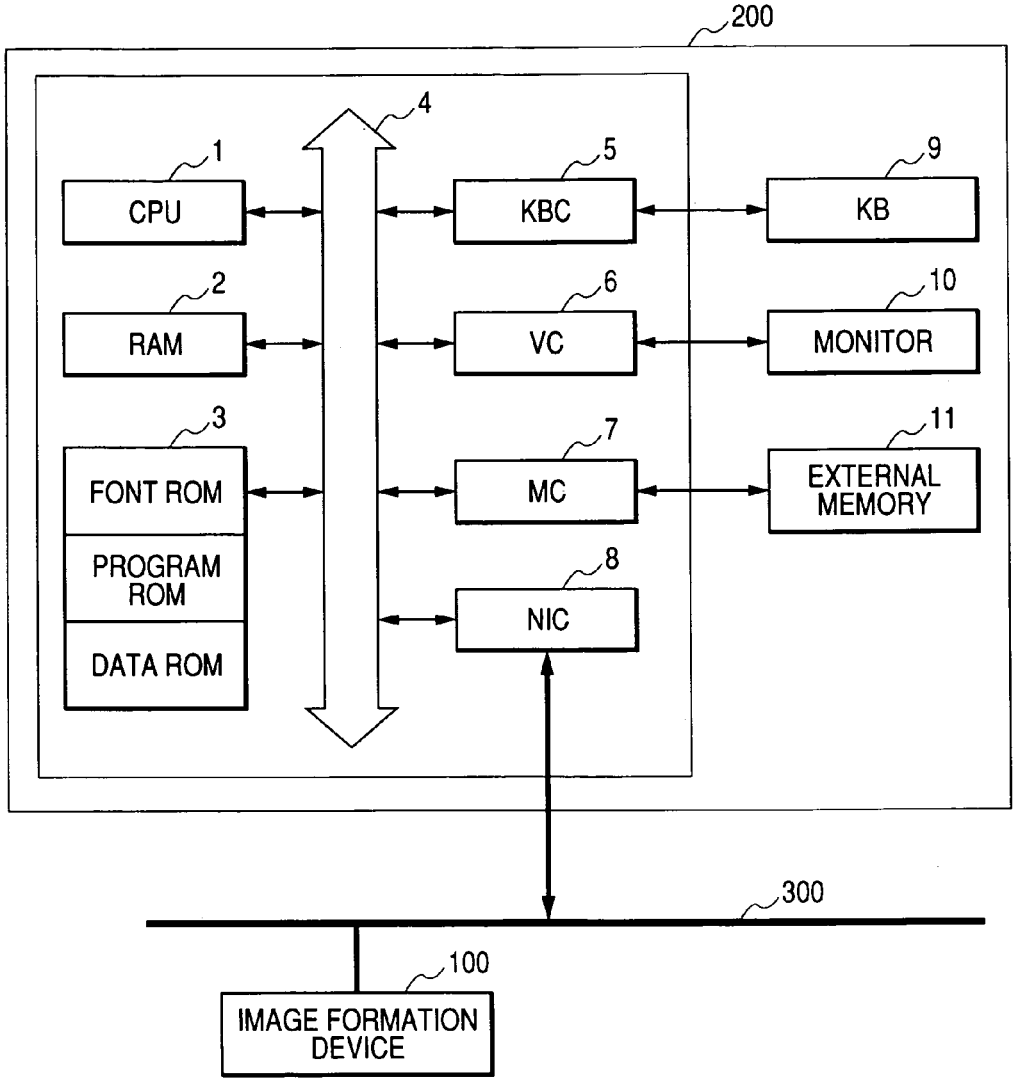
FIG. 14 is a block diagram showing a structure of a system including an information processing device and an image forming device and constituting a second embodiment of the present invention.

FIG. 14 is a block diagram showing a structure of a system including an information processing device and an image forming device, constituting a second embodiment of the present invention.

In FIG. 14, there are shown an image forming device 100 shown in FIG. 1 and an information processing device 200, which are connected by a LAN 300 and in which the information processing device 200 can function as a client PC of the image forming device 100. The structure of the image forming device 100 will not be explained as it is already explained in FIG. 1. In the following, structure of the information processing device 200 will be explained.

Referring to FIG. 14, a CPU 1 can execute a print process by the image forming device 100, by controlling devices connected to a system bus 4 based on a program (such as a printer driver program of the image forming device 100) stored in a program ROM of a ROM 3 or in an external memory 11.

Also a font ROM of the ROM 3 stores font data and the like, and a data ROM of the ROM 3 stores various data. A RAM 2 functions as a main memory and a work area of the CPU 1.

A keyboard controller (KBC) 5 controls inputs from a keyboard (KB) 9 and an unillustrated pointing device such as a mouse. A video controller (VC) 6 controls the display of a monitor 10.

A memory controller (MC) 7 controls an access to the external memory 11. The external memory 11 includes, for example, a hard disk (HD), a flexible disk (FD), a CD-ROM or a DVD-ROM.

A network interface card (NIC) 8 control a communication with a network such as internet through the LAN 300, utilizing a predetermined protocol.

Figure 15:
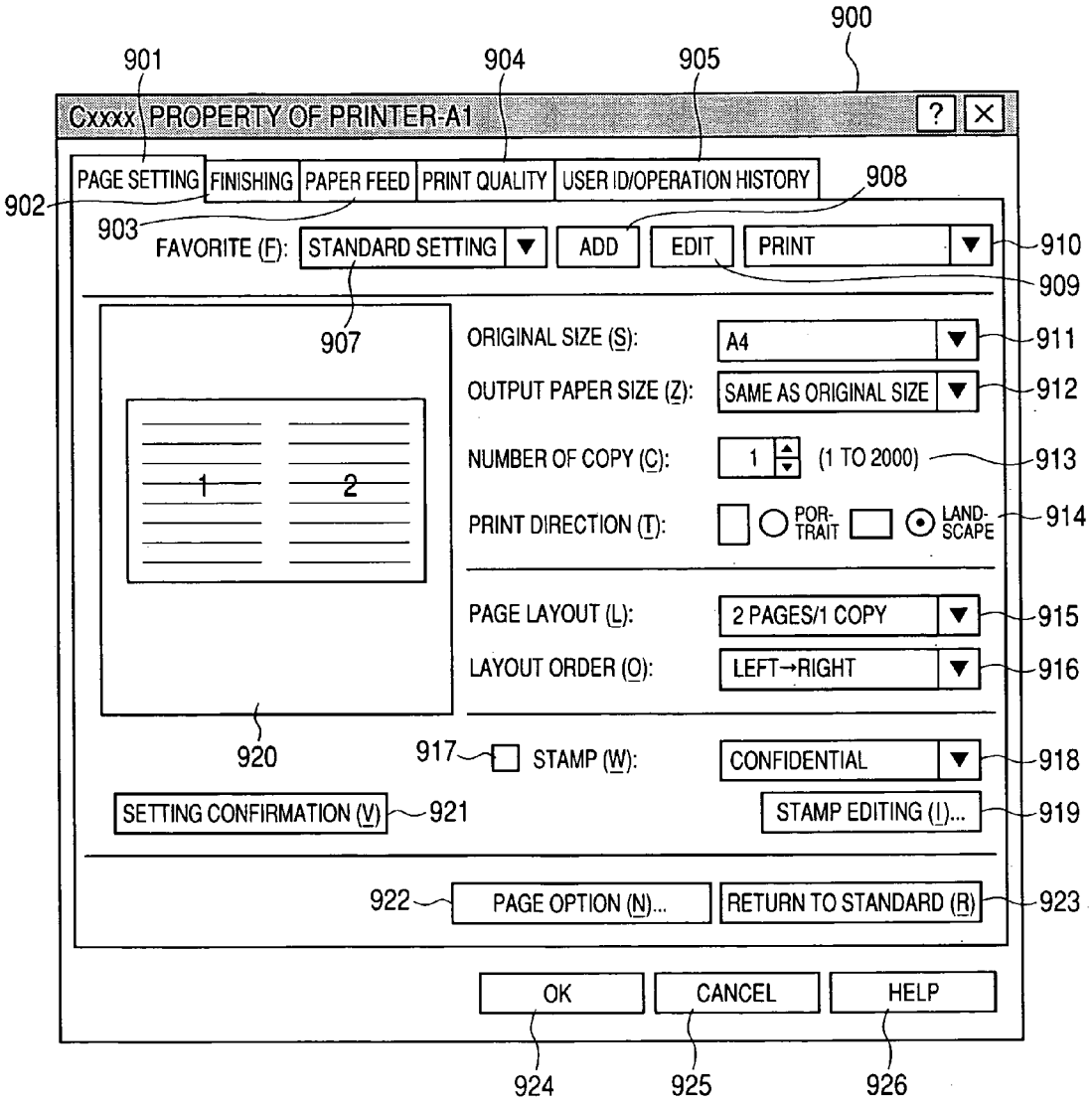
FIG. 15 is a schematic view showing an example of a UI image display of a printer driver to be executed on the information processing device shown in FIG. 14.
Figure 16:
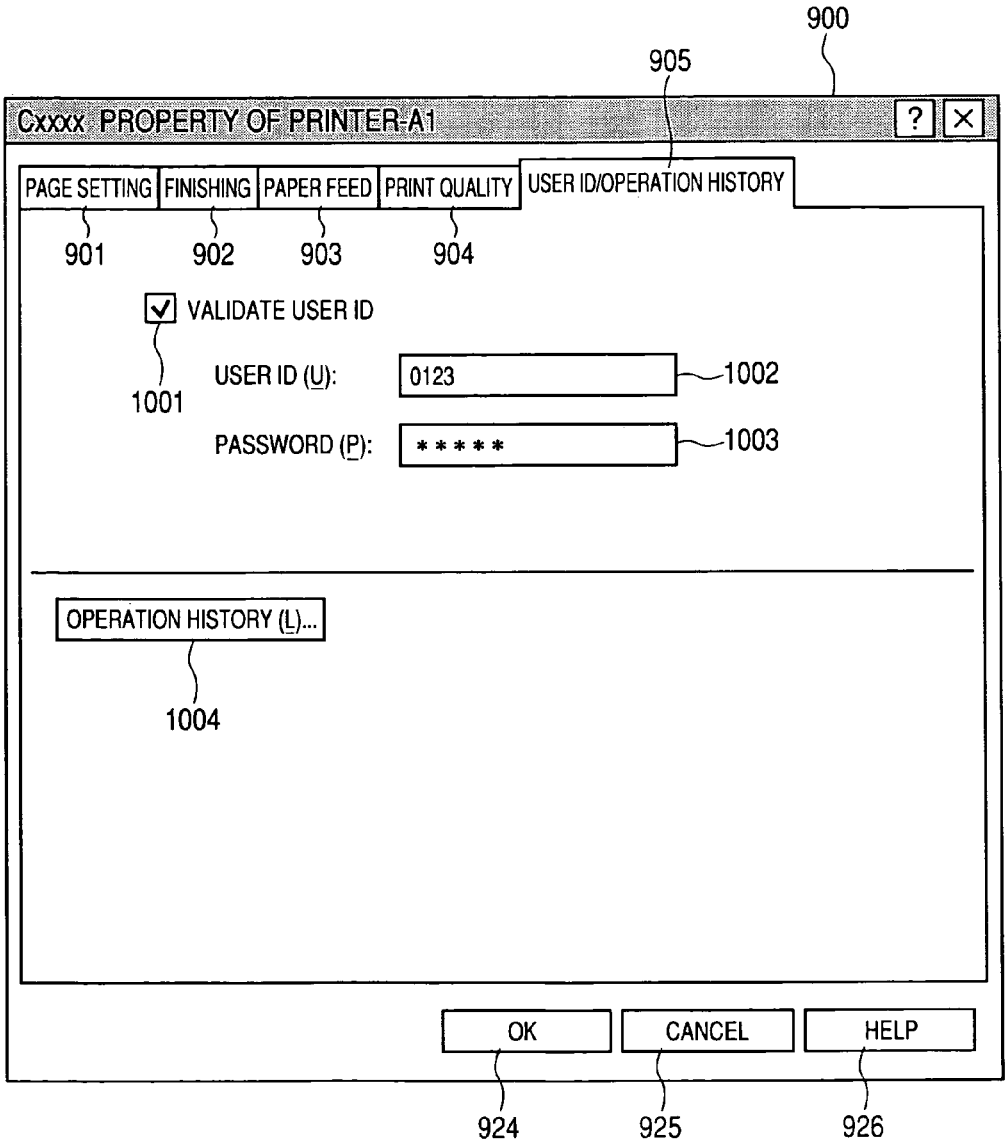
FIG. 16 is a schematic view showing an example of a UI image display of a printer driver to be executed on the information processing device shown in FIG. 14.

FIGS. 15 and 16 are schematic view showing an example of a UI screen display of a printer driver, executed on the information processing device 200 shown in FIG. 14, the display being given on the monitor 10.

FIGS. 15 and 16 show a printer driver UI screen 900, wherein FIG. 15 shows to a UI screen for page setting while FIG. 16 shows a UI screen for user ID/operation setting history in which same components as those in FIG. 15 are represented by corresponding symbols.

At first a page setting UI screen shown in FIG. 15 will be explained.

Referring to FIG. 15, a page setting tab 901 is used for page setting such as a paper size and a print direction. A finish tab 902 is used for a setting on print finish.

A paper feed tab 903 is used for a setting relating to paper feeding. A print quality tab 904 is used for a setting on the print quality. A user ID/operation history tab 905 is used for setting a user ID or executing an operation on the operation history. In case the user ID/operation history tab 905 is selected, the CPU shifts the printer driver UI screen displayed on the monitor 10 from the page setting UI screen shown in FIG. 15 to a user ID/operation setting history UI screen shown in FIG. 16.

A favorite setting UI 907 registers in advance a setting frequently utilized by the user, thereby enabling to change the setting by a simple operation. An addition switch 908 is used for adding a new setting to the favorite item. An editing switch 909 is used for changing the set content of the favorite item.

There are also shown an operation mode setting UI 910 for the printer driver, an original size setting UI 911, an output paper size setting UI 912, a copy number setting UI 913, and a print direction setting UI 914.

There are further shown a page layout setting UI 915, a layout order setting UI 916, a stamp print control UI 917, and a stamp data selecting UI 918. A stamp editing switch 919 is used for editing stamp data.

A preview screen 920 is used for visually showing a current setting. A setting confirmation switch 921 is used for confirming the setting in a list. A page option switch 922 is used for setting a page option such as a date or a page number. A return to standard switch 923 is used for initializing various settings to a standard setting.

An OK switch 924 is used for reflecting the setting information of the printer driver UI screen 900 on the image forming device and then closing the printer driver UI screen 900.

A cancel switch 925 is used for closing the printer driver UI screen 900 without reflecting the setting information of the printer driver UI screen 900 on the image forming device.

A help switch 926 is used for displaying an explanation screen for the setting method for the printer driver UI screen 900.

As the printer driver UI screen varies depending on the content of setting/selection, FIG. 15 merely shows an example of the UI which the printer driver can display and the UI is not limited to such example.

In the following, the user ID/operation setting history UI screen shown in FIG. 16 will be explained.

Referring to FIG. 16, a user ID control UI 1001 is used to control whether or not to utilize the user ID, set on the user ID/operation setting history UI screen, for printing.

A user ID input UI 1002 and a password input UI 1003 are used for inputting a user ID and a password into the image forming device 100. An operation history switch 1004 is used for displaying a printer driver operation history details setting screen shown in FIG. 17. In case this operation history switch 1004 is selected, the CPU 1 displays a printer driver operation history details setting screen shown in FIG. 17 on the monitor 10.

Figure 17:
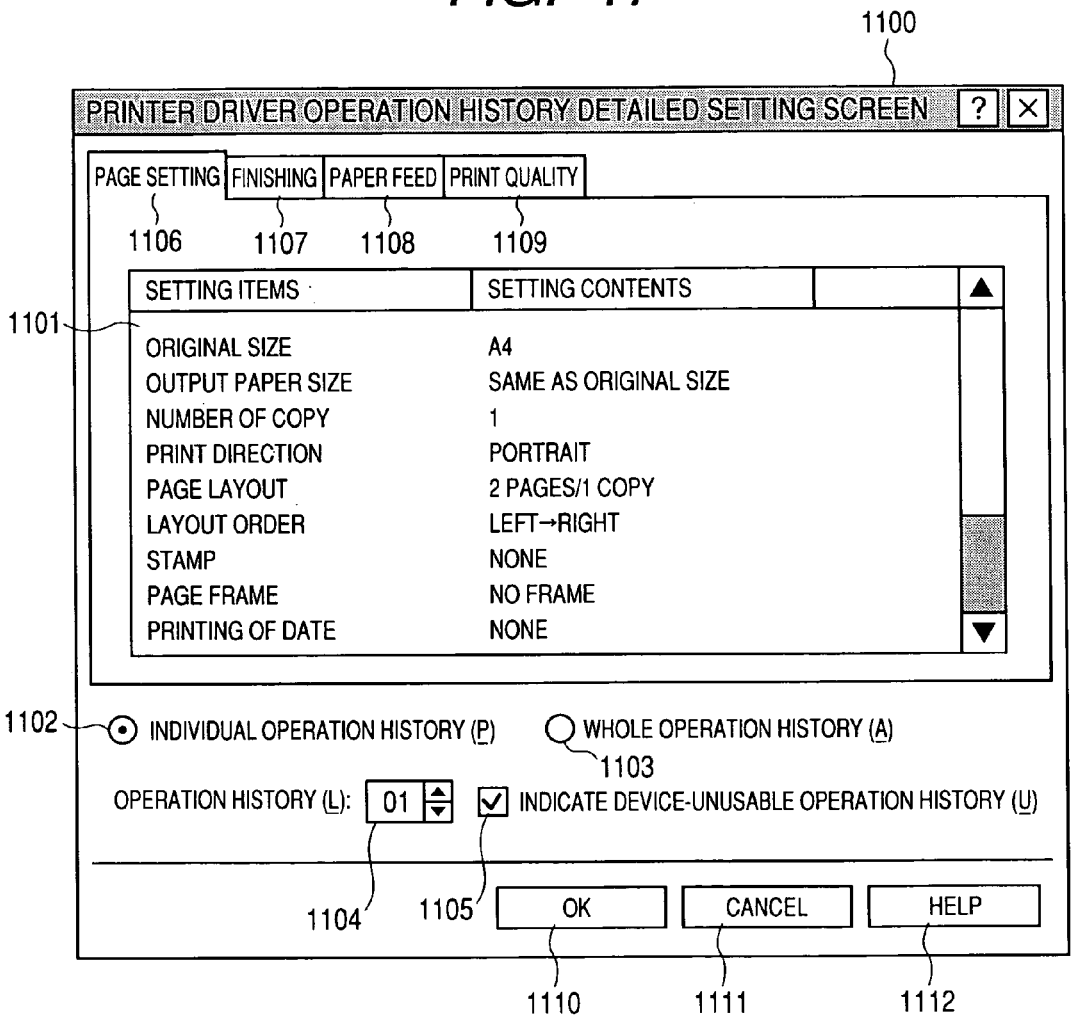
FIG. 17 is a schematic view showing an example of a printer driver operation history details setting screen to be executed on the information processing device shown in FIG. 14.

FIG. 17 is a schematic view showing an example of a printer driver operation history details setting screen to be executed on the information processing device 200 shown in FIG. 14 and displayed on the monitor 10 when the operation history switch 1004 is selected.

In FIG. 17, 1100 indicates a printer driver operation history details setting screen, in which a printer driver operation history information display screen 1101 displays information including time and date of operation (not shown), and setting information on image forming process including one or more of an image quality, an image drawing method, a print speed, a finishing process, a paper feed process and a paper discharge process.

An individual operation history selecting UI 1102 is used for designating the display of the individual operation history (namely setting the history mode at an individual history mode). A whole operation history selecting UI 1103 is used for designating the display of the whole operation history (namely setting the history mode at a whole history mode).

In case the whole history is displayed in the printer driver operation history details setting screen 1101 (in case of the whole history mode), an operation user name, indicating the user who has made the operation, may also be displayed in the printer driver operation history information displaying screen 1101.

A printer driver operation history selecting UI 1104 is used for selecting one from the past operation histories. A control UI 1105 is used for setting whether to activate or to deactivate a function of indicating an operation history a device-unusable operation history to the operator.

In case an individual authentication is already made at the time of display of the printer driver operation history details setting screen 1100, an individual history is set in the operation history, but in case an individual authentication is not yet made, a whole history is set in the operation history, and these are made switchable by the whole operation history switch 1103 and the individual operation history switch 1102.

Also in case the whole history is displayed on the printer driver history information display screen 1101, an operation user name, indicating the user who has made the operation, may also be displayed on the printer driver history information display screen. 1101.

A page setting tab 1106 is used for displaying the page setting such as a paper size and a print direction in the selected operation history on the printer driver operation history information display screen 1101. A finish tab 1107 is used for displaying a setting for the print finish in the selected operation history on the printer driver operation history information display screen 1101. A paper feed tab 1108 is used for displaying a setting relating to the paper feeding in the selected operation history on the printer driver operation history information display screen 1101. A print quality tab 1109 is used for displaying a setting for the print quality in the selected operation history on the printer driver operation history information display screen 1101.

An OK switch 1110 is used for reflecting the setting information, corresponding to the operation history selected in the printer driver operation history details setting screen 1100, on the printer driver UI screen 900 shown in FIG. 15 and then closing the printer driver operation history details setting screen 1100.

A cancel switch 1111 is used for closing the printer driver operation history details setting screen 1100, without reflecting the setting information selected in the printer driver operation history details setting screen 1100 on the image forming device.

A help switch 1112 is used for displaying an explanation screen for the operating method for the printer driver operation history details setting screen 1100.

In the following there will be explained, with reference to printer driver screens shown in FIGS. 15–17 and flow charts shown in FIGS. 18 and 19, a sequence of the print function of the image forming device utilizing the printer driver operation history details setting screen of the present embodiment.

Figure 18:
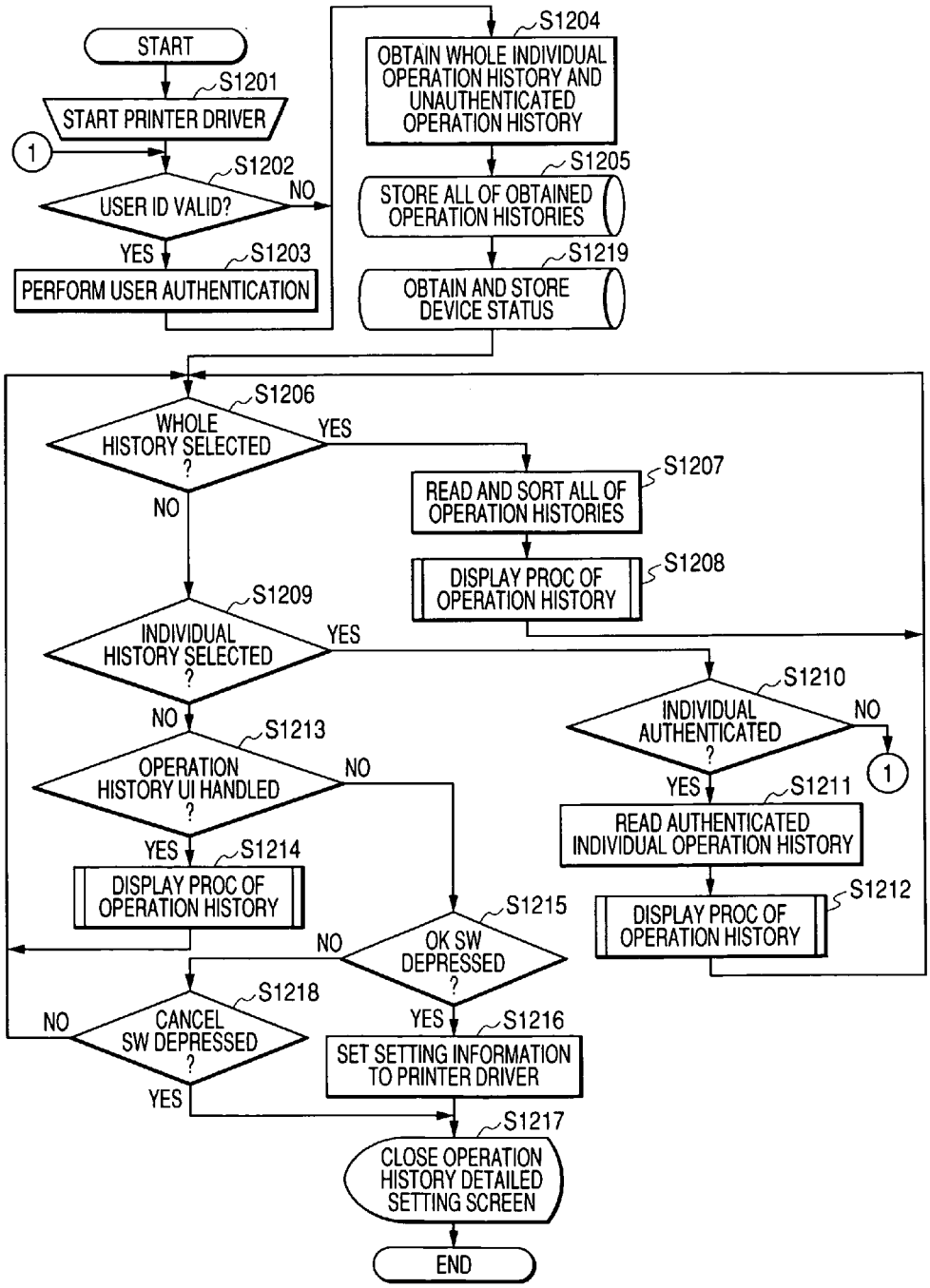
FIG. 18 is a flow chart showing an example of a second control process sequence in the present invention.
Figure 19:
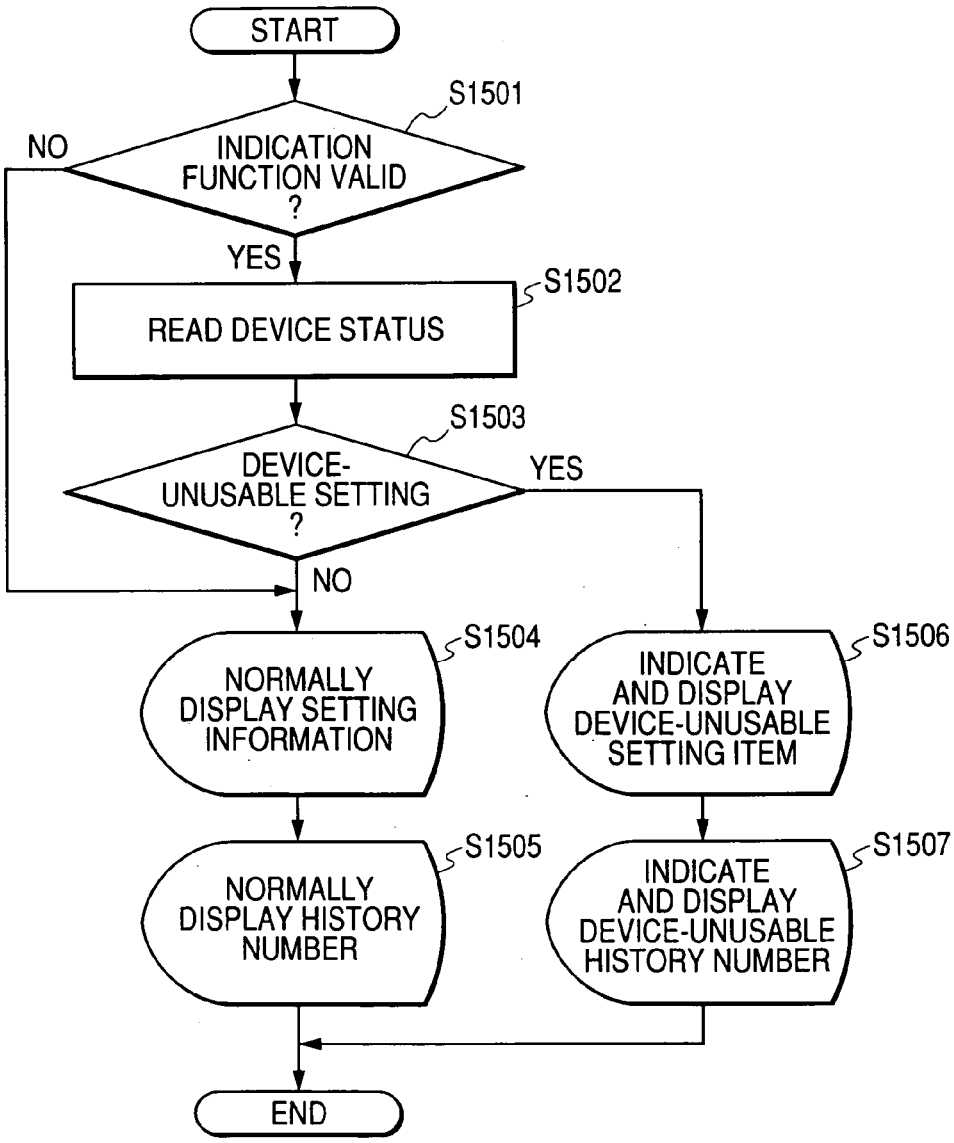
FIG. 19 is a flow chart showing an example of a second control process sequence in the present invention.
Figure 20:
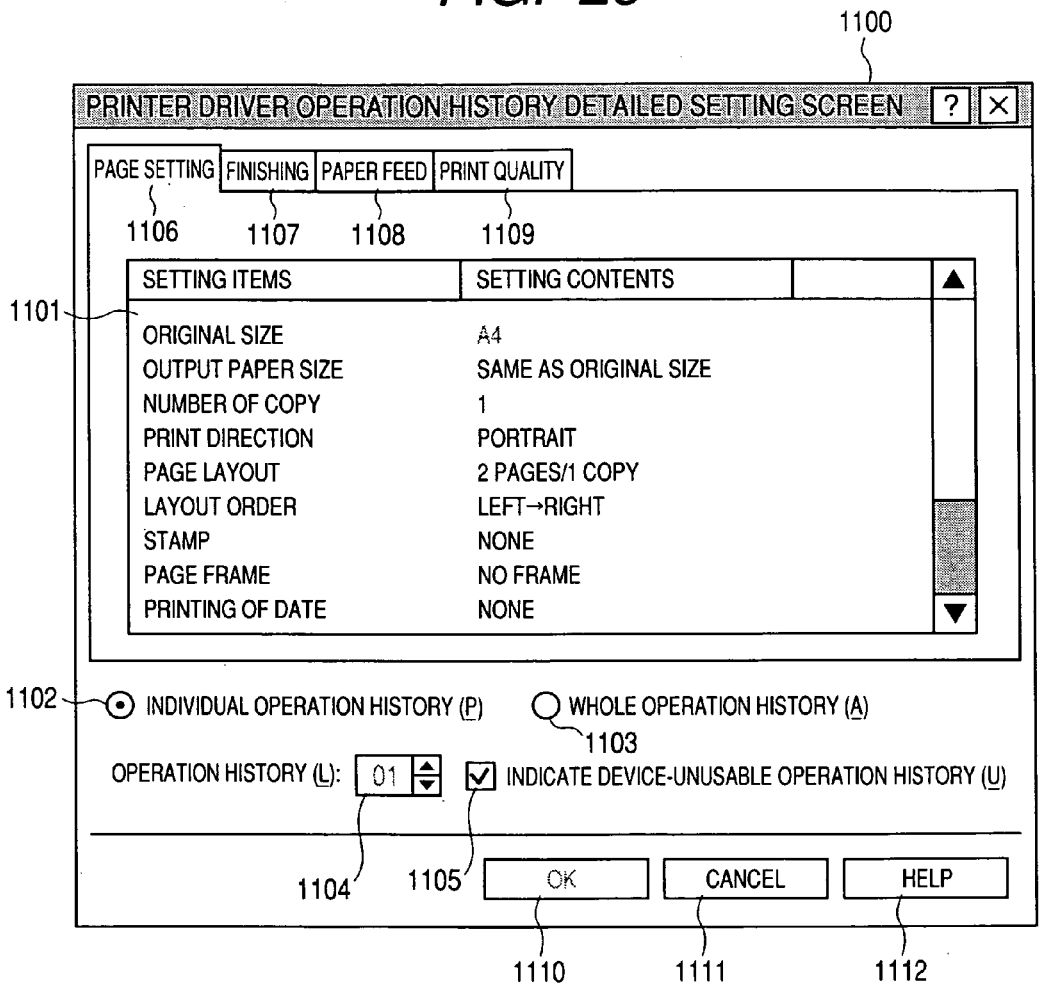
FIG. 20 is a schematic view showing a state of the printer driver operation history details setting screen shown in FIG. 17, in which an unusable history is indicated.

FIGS. 18 and 19 show flow charts indicating an example of a second control sequence in the present invention, executed by the CPU 1 of the information processing device 200 shown in FIG. 14, based on a program stored in the external memory 11 or another recording medium. S1201–S1218 in FIG. 18 and S1501–S1507 in FIG. 19 indicate process steps.

At first, when the CPU 1 detects that the operator instructs activation of the printer driver on the information processing device 200 serving as a print client, the CPU 1 activates the printer driver.

After the activation of the printer driver, the CPU 1 discriminates whether the user ID is effective, by checking that the user ID control UI 1001 provided in the user ID/operation history tab 905 shown in FIG. 16 is effectively set and that any value is set in the user ID input UI 1002 and the password input UI 1003 (S1202). In case the CPU 1 identifies that the user ID is effective, it executes a user authentication by communicating with the image forming device 100 based on the user ID and the password set in the user ID input UI 1002 and the password input UI 1003 (S1203), and then proceeds to a step S1204. In more details, it transmits the user ID, the password set in the user ID input UI 1002 and the password input UI 1003 and an authentication request to the image forming device 100, thereby requesting an authentication thereto. The image forming device 100 executes an authentication process by comparing the user ID and the password received from the information processing device 200 with the user ID table 501 shown in FIG. 8, and returns a result of authentication to the information processing device 200. The information processing device 200 receives the result of authentication from the image forming device 100, and the CPU 1 discriminates presence/absence of the authentication.

On the other hand, in case the step S1202 identifies that the user ID is not effective, the CPU 1 skips the user authentication in the step S1203 and proceeds to a step S1204.

Then the printer driver (CPU 1) communicates with the image forming device 100 to obtain the operation histories of all the users stored in the individual operation history memory table (FIG. 9) of the HDD unit 5507 and the unauthenticated operation history stored in the unauthenticated operation history memory table (FIG. 10) (S1204), and stores all the obtained operation histories in a memory area (for example RAM 2) on the client PC (information processing device 200) (S1205).

The printer driver (CPU 1) further communicates with the image forming device 100 to obtain the current state of the image forming device 100 (by a request from the information processing device 200 to the image forming device 100 and by a response from the image forming device 100 to the information processing device 200), and stores such state in a memory area (for example RAM 2) on the client PC (information processing device 200) (S1219). The stored state information of the image forming device 100 includes an error state of the image forming device 100, a constitution information of the image forming device 100 by an option or the like, size information of the paper medium and a remaining amount information.

Subsequently the printer driver (CPU 1) displays a printer driver UI screen as shown in FIG. 15 on the monitor 10, and awaits an operation from the operator. In case the operator is uncertain about the operation on the UI, a guidance on the operation can be popup displayed by a depression of the help switch 926.

Also the operator, in case of wishing a user ID setting, actuate the user ID/operation history tab 905 to display a printer driver screen as shown in FIG. 16. In succession the operator inputs a user ID in the user ID input UI 1002 and, if necessary, a password in the password input UI 1003, then checks the user ID control UI 1001 and depresses the OK switch 924, thereby validating the use of the user ID. In response to these operations of the operator, the printer driver executes a user authentication by an enquiry to the image forming device 100, and, in case of a proper authentication, the services provided only to the user with authentication can be enjoyed.

Also the operator, in case of wishing a setting of the printer driver utilizing the operation history thereof, depresses the printer driver operation history switch 1004 to display the printer driver operation history details setting screen 1100 shown in FIG. 17 and executes an operation on this screen. Also the process of the aforementioned step S1205 may be executed at the timing when the printer driver operation history switch 1004.

Then the printer driver (CPU 1) awaits an operation of the operator, then, in a step S1206, discriminates whether the whole operation history selecting UI 1103 has been depressed, and, if yes, reads all the operation histories stored in the memory area in the foregoing step S1205, then merges all the obtained operation history information, and, executes a sorting in the order of time stamps (corresponding to the time and date of operation of the operation history memory tables) (S1207), and executes a display process of displaying the latest operation history information on the printer driver operation history information display screen 1101 (S1208).

The display process in this step S1208 will be explained further with reference to a flow chart shown in FIG. 19.

In the display process of the step S1208, the CPU 1 at first discriminates an effective/ineffective state of an indicating function for indicating a device-unusable operation history to the operator by confirming a setting of the control UI 1105 for setting an effective/ineffective state of such function (S1501), then, in case of identifying that the indicating function is set in an effective state, reads out a current state of the image forming device 100 memorized in the step S1219 (S1502), and discriminates whether the setting information of the operation history to be displayed includes a setting item which is currently unusable for the image forming device 100 (S1503).

In case the step S1503 identifies that the unusable setting item does not exist, the CPU 1 proceeds to a step S1504.

Also the CPU 1 executes a display in a normal manner of the setting information of the operation history corresponding to the printer driver operation history information display screen 1101 (S1504) and in succession a display in a normal manner of a corresponding operation history number (S1505).

On the other hand, in case the step S1503 identifies that the currently unusable setting item exists, the CPU 1 displays the setting information of the operation history corresponding to the printer driver operation history information display screen 1101 and also shows the currently unusable setting item by a gray-out (or flashing or reversal) display thereby clearly indicating such non-reusable setting item to the operator (S1506).

Then the CPU 1 also provides a gray-out (or flashing or reversal) display for the operation history number corresponding to the currently unusable setting item (S1507), thereby clearly indicating to the operator that the operation history memorized in this operation history number is currently unusable, and also maintains the OK switch 1110 in a gray-out state so as that the operator cannot select this operation history number, thereby avoiding selection of the unusable operation history. More specifically, for example an operation history "01" utilizing an A4-sized paper as shown in FIG. 13 is identified as currently unusable in the step S1503 because the A4-sized paper is not contained in the image forming device, a display portion "A4" of the paper size information on the printer driver operation history information display screen 1101 is grayed out, and a number and an OK switch 1110 on the operation history selection UI 1104 are also grayed out whereby the display is so controlled as to disable the selection. It is thus made possible to securely prevent a situation where the operator executes a setting with the currently unusable operation history "01".

Also in case the step S1501 identifies that the function of indicating the unusable operation history to the operator is set in an ineffective state (indicating function ineffective), the CPU 1 branches to a step S1504 to display the setting information and the history number in a normal manner as explained above, regardless whether the utilization is possible or not (S1504, S1505).

Now reference is made again to a step S1208 in FIG. 18.

In the display process in the step S1208, the operation history selecting UI 1104 displays a number "01", indicating that the latest operation history is displayed. However, in case the operation history of the operator having the individual authentication does not exist at all (in case the authenticated individual operates the image forming device for the first time), it is desirable that the operation history selecting UI 1104 displays a number "00" or a blank and that the printer driver operation history information display screen 1101 displays a blank or a message indicating the absence of the operation history.

After the process of displaying the latest operation history information on the printer driver operation history information display screen 1101 in the step S1208, the printer driver (CPU 1) returns to the step S1206 to await an operation of the operator again.

On the other hand, in case the CPU 1 identifies in the step S1206 that the whole operation history selecting UI 1103 is not depressed, the CPU discriminates in a step S1209 whether the individual operation history selecting UI 1102 has been depressed, and, if yes, then discriminates whether the operator currently operating the printer driver already has an individual authentication (S1210), and, if not, the CPU 1 returns to the step S1202 for executing a process of individual authentication in cooperation with the image forming device.

On the other hand, in case the step S1210 identifies that the individual authentication has already been made, the CPU 1 reads operation history information corresponding to the authenticated user ID from all the operation histories stored in the memory area in the foregoing step S1205, then merges all the obtained operation history information, and, executes a sorting in the order of time stamps (corresponding to the time and date of operation of the operation history memory tables) (S1211), and executes a display process of displaying the latest operation history information on the printer driver operation history information display screen 1101 (S1212).

The display process in the step S1212 is similar to that in the step S1208, which has already been explained with reference to the flow chart in FIG. 19, and will not therefore be explained again.

Also in the display process in the step S1212, as in the step S1208, the operation history selecting UI 1104 displays a number "01", indicating the latest operation history. However, in case the operation history does not exist at all (case of first operation of the image forming device), it is desirable that the operation history selecting UI 1104 displays a number "00" or a blank and that the printer driver operation history information display screen 1101 displays a blank or a message indicating the absence of the operation history.

After the process of displaying the latest operation history information on the printer driver operation history information display screen 1101 in the step S1212, the printer driver (CPU 1) awaits an operation of the operator again.

Also in case the step S1209 identifies that the CPU 1 does not select the individual history, the CPU 1 proceeds to a step S1213 and discriminates whether the operation history selecting UI 1104 has been operated.

In case the step S1213 identifies that the operation history selecting UI 1104 has been operated, the CPU 1 displays an increased or decreased number according to an operation of the up/down switch in the operation history selecting UI 1104, and executes a display process for displaying an operation history corresponding to the operation history number on the printer driver operation history information display screen 1101 (S1214).

The display process in the step S1214 is similar to that in the step S1208, which has already been explained with reference to the flow chart in FIG. 19, and will not therefore be explained again.

In the display process in the step S1214, the number of the operation history selected by the operation of the up/down switch in the operation history selecting UI 1104 is displayed in the operation history selecting UI 1104.

On the other hand, in case the step S1213 identifies that the operation history selecting UI 1110 has not been operated, the CPU 1 proceeds to a step S1215 to discriminate whether the OK switch 924 has been depressed.

In case the step S1215 identifies that the OK switch 1110 has been depressed, the CPU 1 sets the setting information currently displayed on the printer driver operation history information display screen 1101 in a setting area (for example secured in the RAM 2) of the printer driver (thereby being reflected on the program operating screen 900 shown in FIG. 15) (S1216), and then closes the printer driver operation history details setting screen 1100 (S1217) thereby terminating the process sequence utilizing the operation history. Thereafter, upon detecting the instruction of the start of printing, the CPU 1 starts a print process by transmitting a print job based on the setting information set in the step S1216 to the image forming device 100.

On the other hand, in case the step S1215 identifies that the OK switch 1110 has not been depressed, the CPU 1 proceeds to a step S1218 and discriminates whether the cancel switch 1111 has been depressed, and, if depressed, the CPU 1 skips the process (S1216) of setting on the printer driver, and proceeds to a step S1217 to close the printer driver operation history details setting screen 1100 thereby terminating the process sequence utilizing the operation history.

On the other hand, in case the step S1218 identifies that the cancel switch 1111 has not been depressed, the CPU 1 returns the process to the step S1206 for awaiting an operation from the operator.

The above-described process enables the operator to obtain the whole operation history or the individual operation history stored in the image forming device and to reflect, whenever necessary, the setting information of the copy function, set in the past, on the image forming device. As explained in the foregoing, the present embodiment provides a constitution in which the setting information used by the printer driver in the past is memorized in the operation history memory table (FIGS. 9, 10) provided in the image forming device whereby the authenticated operator can obtain and reuse all such operation history even in case of operation from plural client PCs (information processing device 200), but it is naturally possible to construct a system in which the operation history memory table is provided in a client PC whereby the operator can obtain and reuse the operation history only from a client PC currently operated by the operator.

After the process sequence explained in FIGS. 18 and 19, the OK switch 924 of the printer driver shown in FIG. 15 is depressed and an OK switch (a switch for instructing the start of print execution) on an unillustrated print dialog is depressed, whereupon the CPU 1 transmits the setting information, set as explained above, and a print instruction in succession to the image forming device, thereby starting a print process therein. This print process will be explained in the following with reference to a flow chart in FIG. 21.

Figure 21:
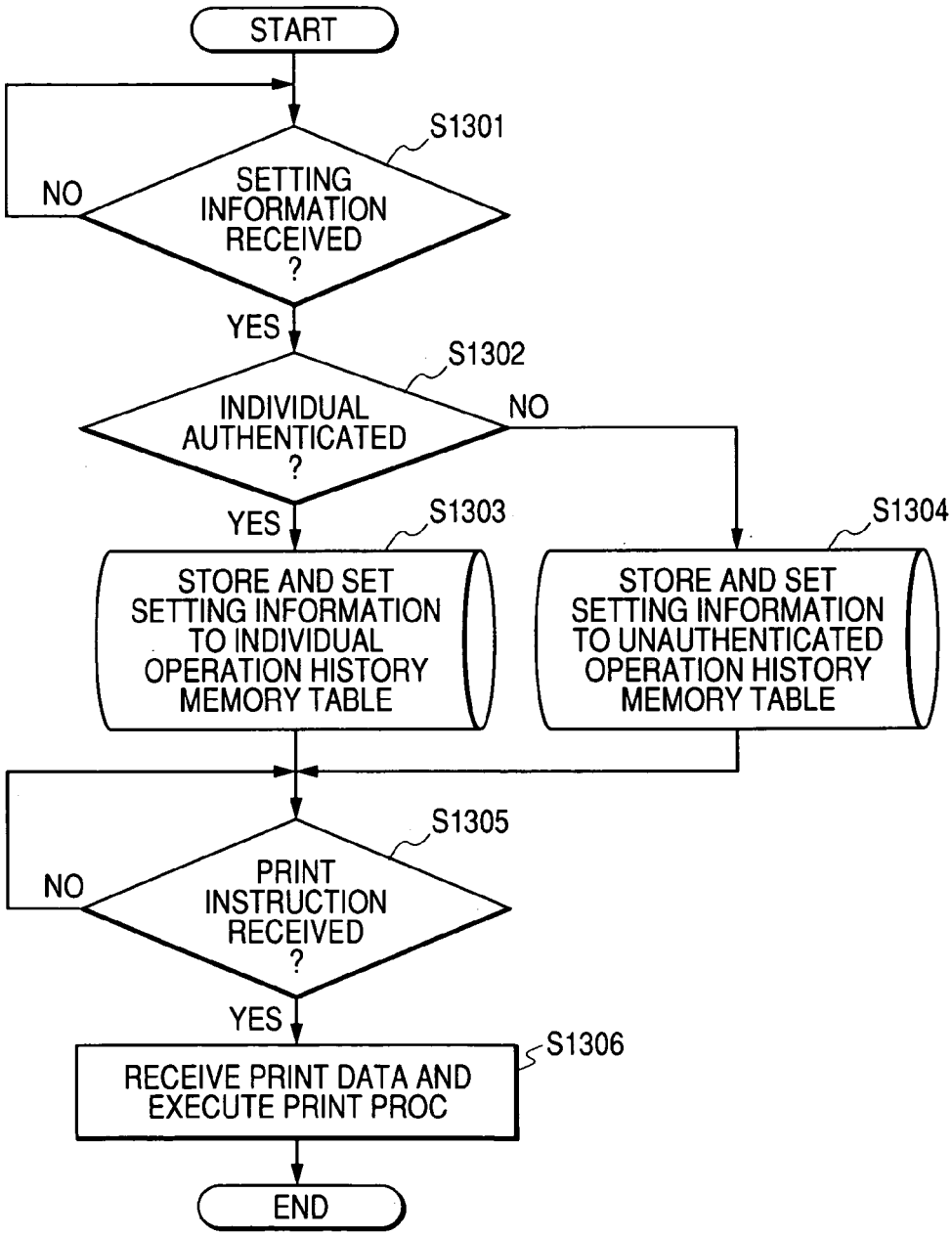
FIG. 21 is a flow chart showing an example of a third control process sequence in the present invention.

FIG. 21 is a flow chart indicating an example of a third control sequence in the present invention, corresponding to a print process in the image forming device. The process of the flow chart is executed by the main controller unit 5501 shown in FIG. 1 by a program stored in the HDD unit 5507 or the RON or another recording medium in the main controller unit 5501. S1301–S1306 indicate process steps.

The printer driver (CPU 1), upon detecting a depression of an OK switch (switch for instructing start of print process) on the aforementioned unillustrated print dialog, transmits the setting information of the printer driver to the image forming device 100 in synchronization with the timing of such detection.

In the image forming device 100, the main controller unit 5501 waits until the setting information of the printer driver is received (S1301), and when the reception of the printer driving setting information is identified as completed (reception completed), the main controller unit 5501 confirms whether the user currently in the print operation already has an individual authentication (S1302). The procedure of the individual authentication in the printer driver is as already explained in the flow chart of FIG. 18.

In case the step S1302 identifies that the user currently in the print operation already has an individual authentication, the main controller unit 5501 stores the setting information, received in the step S1301, in a table corresponding to an authenticated individual in the individual operation history memory table shown in FIG. 9, and sets such information in the image forming device 100 (step S1303). On the other hand, in case the step S1302 identifies that the print operation is from an operator not having an individual authentication, the main controller unit 5501 stores the setting information, received in the step S1301, in the unauthenticated operation history memory table shown in FIG. 10, and sets such information in the image forming device 100 (step S1304).

Since the printer driver, after the transmission of the setting information, in succession transmits a print execution instruction to the image forming device 100, the main controller unit 5501 therein awaits such print instruction (S1305), and upon receiving the print instruction, executes a reception of print data transmitted in succession and a print process (S1306).

In the following, operations of print data reception and print process in the step S1306 will be explained with reference to FIGS. 1 and 2.

The print data transmitted from the printer driver are received for example through the LAN, by the NIC unit 5510. In the NIC unit 5510, the signal received from the LAN is converted by the transformer unit 5512 into a signal processable by the image forming device, and is received by a LAN controller 5511. The print data received by the LAN controller 5511 are once supplied to the main controller unit 5501 through the expansion bus 5509.

The main controller unit 5501 converts various image formats and the print data of PDL language, transmitted from the printer driver, into a data format processable in the print unit 5513 of the image forming device, and transmits such data to the print unit 5513 thereby requesting a print process.

The image data inputted to the output process unit 5514 of the print unit 5513 are subjected to a gamma correction, a sharpness process and a smoothing process for conversion into density data matching density characteristics of a toner, and supplied to the PWM unit 5515. The PWM unit 5515 generates a laser driving signal, which is an analog signal, based on the inputted digital signal, and which is supplied to the printer unit 5516.

The laser driving signal drives a laser beam emission unit 210, which emits a laser beam corresponding to such signal. The laser beam irradiates a photosensitive drum 211, thereby forming a latent image corresponding to the laser beam.

A developer is deposited by a developing device 212 onto the photosensitive drum 211 in a portion of the latent image. Separately, at a timing in synchronization with the start of irradiation of the laser beam, a recording paper is fed from either of cassettes 213, 214 and is conveyed to a transfer unit 215, where the developer deposited on the photosensitive drum 211 is transferred onto the recording paper.

The recording paper bearing the developer is conveyed to a fixing unit 216, in which the developer is fixed to the recording paper by an application of heat and pressure in the fixing unit 216. The recording paper after passing the fixing unit 216 is discharged by discharge rollers 217, and a sorter 219 sorts the recording papers by storing in respective bins. The sorter 219 stores the recording papers in an uppermost bin in case a sorting is not selected.

In case a two-sided recording is selected, the recording paper is conveyed to the position of the discharge rollers 217, and is then guided to a re-feed conveying path by a reverse rotation of the discharge rollers 217 and by a function of a flapper 218. Also in case a multiple recording is selected, the recording paper is not conveyed to the position of the discharge roller 217 but to the re-feed conveying path by a function of the flapper 218. The recording paper guided to the re-feed conveying path is fed to the transfer unit 215 at a timing explained above.

The foregoing corresponds to operations of print data reception and print process executed in the step S1306.

Also the foregoing corresponding to the procedure of executing the print function of the image forming device, utilizing the printer driver operation history details setting screen (FIG. 17) of the present invention.

In the foregoing embodiment, the individual authentication is explained to be executed by a user ID (individual ID) and a password utilizing the user ID/operation history tab 905 shown in FIG. 16, but it is naturally possible to utilize any authenticating method such as an authentication with various cards such as an IC card, an ID card, or a memory card, an authentication with a voice, a fingerprint authentication, a capillary vein authentication, a venous pattern authentication, a corneal authentication, or a facial authentication.

As explained in the foregoing, it is made easily possible, also in a setting screen for an image forming device, displayed on an information processing device, to select and set (reuse) a desired operation history from the individual history or the whole history of the operation on such image forming device in the past.

Also in case a past operation memorized in the operation history becomes unusable at the time of display of such operation history, such situation is informed to the operator, in a setting screen for an image forming device, displayed on an information processing device, thereby securely avoiding a productivity deteriorating factor that a setting based on an unusable operation history causes an error at the start of operation and necessitates a repeated setting operation.

The present embodiment has been explained by a constitution in which a printer driver for an image forming device is activated on an information processing device and an individual operation history or a whole operation history in a print mode is selectively displayed on a setting screen of the printer driver for enabling reuse thereof for a print setting, but it is also possible to activate a scanner driver for the image forming device on the information processing device and to selectively display an individual operation history or a whole operation history in a scanner mode for enabling reuse thereof for a scanner setting.

Also the foregoing embodiments explain a constitution in which the histories are memorized in the image forming device regardless of presence/absence of the individual authentication, but it is also possible to memorize the histories in the image forming device only in case of presence of the individual authentication.

Also the foregoing embodiments explain a constitution in which the histories are memorized in an image forming device, but it is also possible, in case a user executes a setting for canceling the history mode by an unillustrated user interface (such setting being memorized in the HDD unit 5507), not to memorize the history of such user.

Another constitution is also possible where the user can select whether or not to memorize the history at every timing of the memory of the history.

(Third Embodiment)

The foregoing first embodiment has explained a constitution of calling an individual history stored in an image forming device and reusing such history in the function setting, but it is also possible to call not only an individual history stored in an own image forming device but also those stored in plural image forming devices connected through a network for reuse in a function setting. In the following, such embodiment will be explained.

Figure 22:
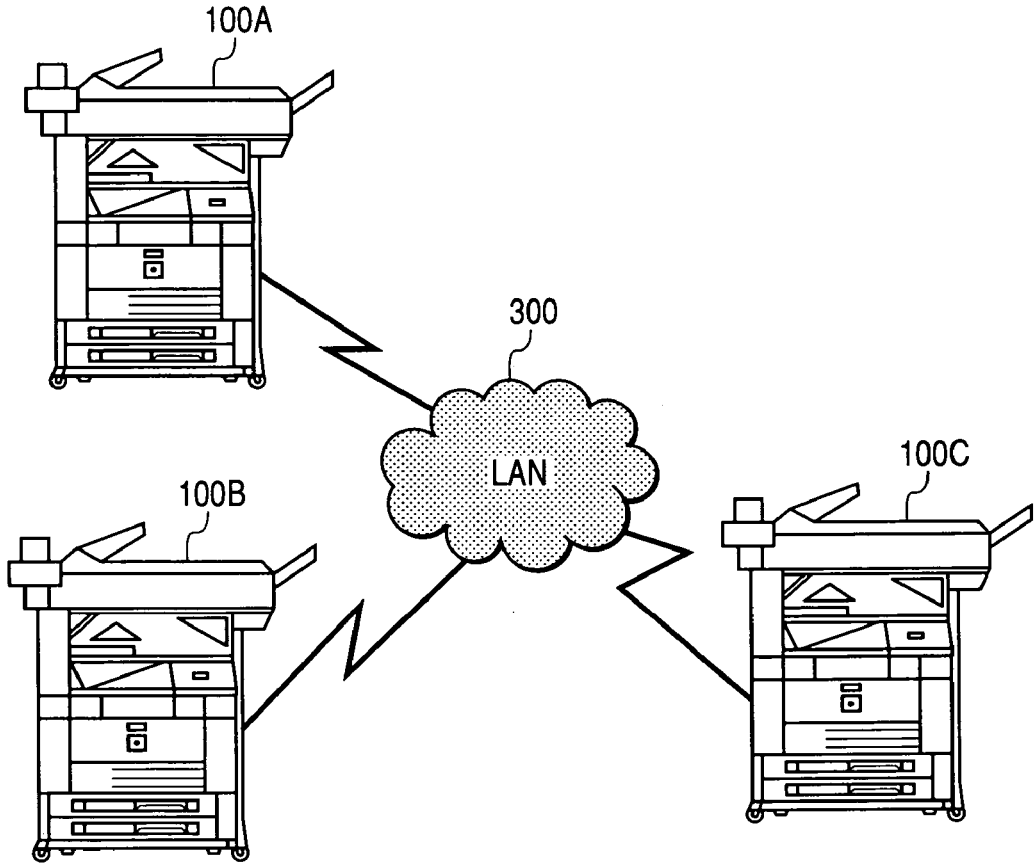
FIG. 22 is a block diagram showing a structure of a system including an image forming device and constituting a third embodiment of the present invention.

FIG. 22 is a block diagram showing a structure of a system including image forming devices in a third embodiment of the present invention.

In FIG. 22, there are shown image forming devices 100 (100A–100C) as shown in FIGS. 1 and 2, which are connected through a LAN 300 in a mutually communicable manner. The structure of the image forming devices 100A–100C is already shown in FIGS. 1 and 2 and will not be explained further.

Figure 23:
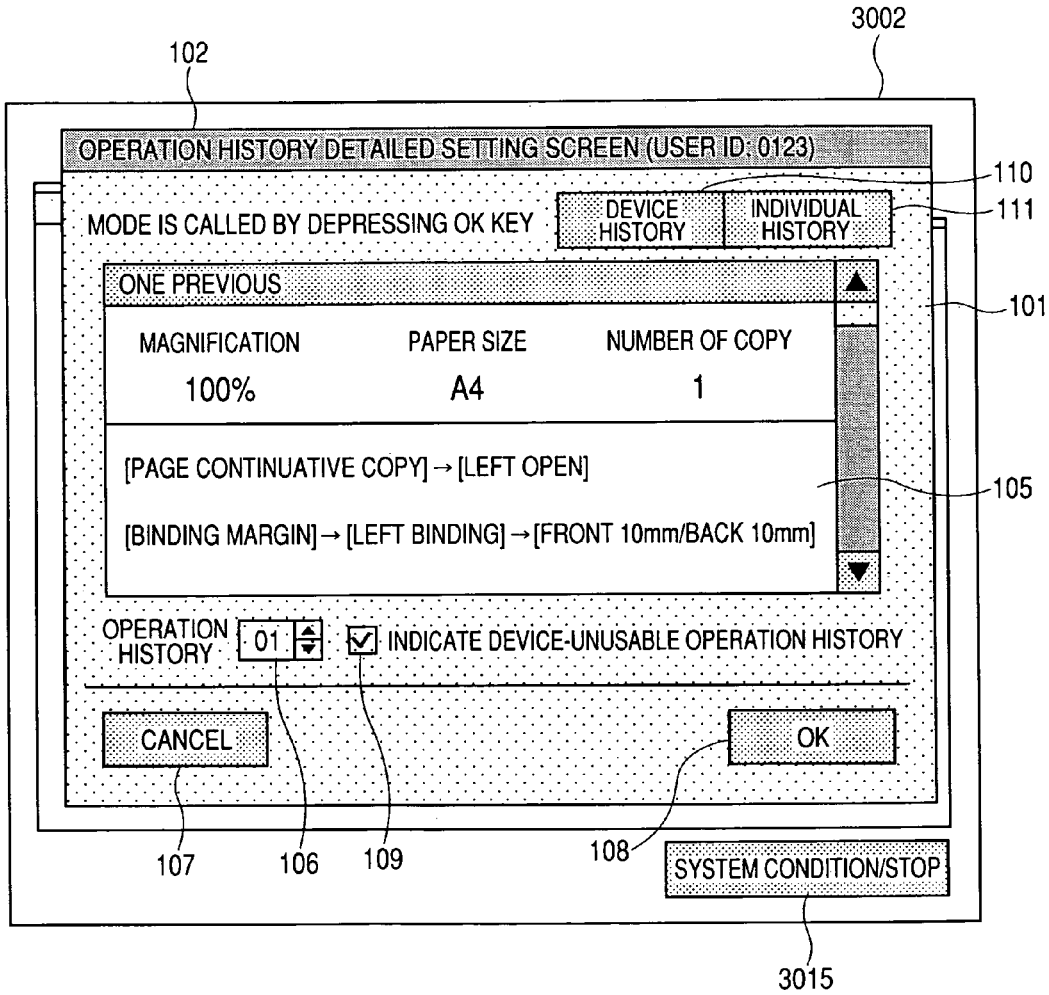
FIG. 23 is a schematic view showing a structure of an operation history details setting screen, popup displayed on an LCD panel of the image forming device shown in FIG. 22.

FIG. 23 is a schematic view showing a structure of an operation history details setting screen which is popup displayed on the LCD panel 3002 of the image forming device 100 shown in FIG. 22, wherein components same as those in FIG. 5 are represented by same symbols.

In FIG. 23, a device history switch 110 is used for setting the operation history of a whole device currently used as the object of use (namely setting the history mode at a device history mode).

An individual history switch 111 of the present embodiment is used for setting only the operation histories of an individual currently having an individual authentication, including those collected from other image forming devices, as the object of use (namely setting the history mode at a network individual history mode).

In case an individual authentication is already made at the time of display of the operation history details setting screen 101, a network individual history mode is set in the operation history, but in case an individual authentication is not yet made, a device history mode is set in the operation history, and these are made switchable by the device history switch 110 and the individual history switch 111.

Also in case the device history is displayed on the history information display screen 105 (in case of the device history mode), an operation user name, indicating the user who has made the operation, may also be displayed on the history information display screen 105.

Also in case the network individual history is displayed on the history information display screen 105 (in case of the network individual history mode), a device name, indicating the device which has made the operation, may also be displayed on the history information display screen 105.

When the individual history switch 111 is depressed (touched), under a control of the main controller unit 5501 shown in FIG. 1, an individual authentication screen 401 shown in FIG. 6 is popup displayed on the LCD panel 3002.

Also in case an authenticated user designates a specified operation history within the operation history of such authenticated user or a whole operation history of such authenticated user and actuates an unillustrated history deleting button, the main controller unit 5501 detects such operation and, in case such designated history information belong to the currently operated device, deletes thus designated history information from the HDD unit 5507, or, in case such designated history information belong to a device other than the currently operated device, instructs such another device to delete the designated history information from the HDD unit 5507 of the corresponding device. The main controller unit 5501 of the device receiving such instruction deletes the designated history information from the HDD unit 5507.

It is thus rendered possible to rearrange the individual histories of the whole image forming system constituted of plural image forming devices connected through a network, according to the necessity or to delete all the individual histories to an initial state.

Also a priority may be made selectable in order to preferentially display a predetermined operation history.

Furthermore a title desired by the user may be made settable to a predetermined operation history.

Also in case an authenticated manager designates a specified operation history or a specified device history within the whole operation history and actuates an unillustrated history deleting button, the main controller unit 5501 detects such operation and, in case such designated history information belong to the currently operated device, deletes thus designated history information from the HDD unit 5507, or, in case such designated history information belong to a device other than the currently operated device, instructs such another device to delete the designated history information from the HDD unit 5507 of the corresponding device. The main controller unit 5501 of the device receiving such instruction deletes the designated history information from the HDD unit 5507.

It is thus rendered possible to rearrange the history information (individual histories or unauthenticated operation histories) according to the necessity or to delete all the operation histories to an initial state.

It is also possible to store a frequency of re-use of each operation history in the HDD unit 5507 at every re-use of the operation history and to cause the main controller unit 5501 to delete each operation history based on the frequency of re-use of each operation history, at a predetermined period (for example a period of about 1 month). More specifically, it is possible to delete an operation history of a frequency of re-use lower than a predetermined threshold value or an operation history that has not been re-used for a predetermined period.

In the following there will be explained, with reference to a flow chart shown in FIG. 24, a process sequence of the copy function in case an operation history is used in the image forming devices of the third embodiment of the present invention.

FIG. 24 shows a flow chart indicating an example of a fourth control sequence in the present invention, executed by the main controller unit 5501 shown in FIG. 1, based on a program stored in the HDD unit 5507, in a ROM in the main controller unit 5501 or in another recording medium. S801–S805 and S808–S819 in FIG. 24 indicate process steps, and steps same as those in FIG. 11 are presented by same numbers and will not be explained further.

In case the main controller unit 5501 identifies an individual authentication in the step S801, the main controller unit 5501 reads operation history information corresponding to the individually authenticated user ID from the individual operation history memory table (FIG. 9) in the HDD unit 5507 shown in FIG. 1 into an unillustrated RAM in the main controller unit 5501 (S802), and also collects operation history information corresponding to the individually authenticated user ID from other image forming device connected through the network such as a LAN (S816). More specifically, the main controller unit 5501 requests history information to another image forming device, which in response transmits (returns) operation history information corresponding to such user ID to the requesting image forming device. The requesting image forming device obtains the operation history information corresponding to the user ID and returned from such another image forming device and stores the information in an unillustrated RAM of the main controller unit 5501. In the information collecting process of the step S816, it is possible to judge an image forming device of a same type (including a device of a same series, a same category and an interchangeable type) and to obtain the operation history information from the image forming device of the same type only.

Then, in a step S817, the main controller unit 5501 executes a process of integrating the operation history read in the step S802 and the operation history collected in the step S816. In this integrating process, the main controller unit 5501, after excluding (deleting) the operation history from an image forming device of a different type that is not usable in the currently used image forming device, executes a sorting in the order of time stamps based on the information of date and time of the operation. In case the integrated operation history, obtained as a result of such operation, exceeds a memory amount assigned in advance to a specified individual, the main controller unit 5501 leaves the histories from the latest one and deletes the older operation histories that cannot be memorized. Then the main controller unit 5501 executes a display process of displaying the latest operation history information, among thus integrated operation history information, on the history information display screen 105 (S803).

In the display process shown in the step S803, the operation history selecting UI 106 displays a number "01", indicating that the latest operation history is displayed. However, in case the operation history of the operator having the individual authentication does not exist at all (in case the authenticated individual operates the image forming device for the first time), it is desirable that the operation history selecting UI 106 displays a number "00" or a blank and that the history information display screen 105 displays a blank or a message indicating the absence of the operation history.

Also in case the step S801 identifies that the operation is executed by an unauthenticated user not having an individual authentication, the main controller unit 5501 reads, as in FIG. 11, the operation histories of all the users from the individual operation history memory table (FIG. 9) of the HDD unit 5507 and the unauthenticated operation history memory table (FIG. 10) (S804), then merges all the obtained operation history information, and, after a sorting in the order of time stamps, executes a display process of displaying the latest operation history information on the history information display screen 105 (S805).

Then an operation of the operator is awaited as in FIG. 11, and, in a step S818, the main controller unit 5501 discriminates whether the device history switch 110 has been depressed, and, if depressed, the aforementioned process of the steps S804 and S805 are executed. This process is effective for example in case an operator having the individual authentication wishes to utilize, not limited to the individual operation history, the operation histories of all the image forming devices currently in use.

On the other hand, in case the step S818 identifies that the device history switch 110 has not been depressed, the main controller unit 5501 proceeds to a step S819 and discriminates whether the individual history switch 111 has been depressed.

In case the step S819 identifies that the individual history switch 111 has been depressed, the main controller unit 5501 executes a popup display of the individual authentication screen 401 on the LCD panel 3002 (S808) and requests an individual authentication to the operator, thereby requesting an individual authentication to the operator, in order to display the operation history of a specified individual. Then authentication information is inputted by the operator and the main controller unit 5501 discriminates whether the individual authentication is made successfully (S809).

In case the step S809 identifies that the individual authentication has been made successfully, the main controller unit 5501 executes the process of the steps S816, S817 and S803, and thereupon displays the operation history of the authenticated individual on the history information display screen 105.

On the other hand, in case the step S809 identifies that the individual authentication has not been successful, the main controller unit 5501 executes the process of the steps S804 and S805, and thereupon displays the whole operation history on the history information display screen 105.

Also in case the step S819 identifies that the individual history switch 111 has not been depressed, the main controller unit 5501 proceeds to a step S810 and discriminates whether the operation history UI 106 has been operated (S810).

In case the step S810 identifies that the operation history UI 106 has been operated, the main controller unit 5501 displays an increased or decreased number according to an operation of the up/down switch in the operation history UI 106, also reads an operation history corresponding to such operation history number from the individual operation history generated by integration in the step S817 or from the whole operation history table (FIG. 10) generated by sorting in the step S804 and executes a display process for displaying the setting information of such operation history (S811). The display process in the step S811 is similar to that in the step S803 or S805, which has already been explained with reference to the flow chart in FIG. 12, and will not therefore be explained again. Also other steps will not be explained as they are similar to those in FIG. 11.

The above-described process enables the operator to refer to the whole operation history of the currently used image forming device or the individual operation history (including the operation history memorized in another image forming device and collected from the network) and to reflect, whenever necessary, the setting information of the copy function, set in the past, on the image forming device. When the start switch 3018 is depressed by the operator after this process, the copy process of the step S315 in FIG. 7 is executed, based on thus set setting information.

The foregoing procedure executes the copy function of the image forming device utilizing the operation history details setting screen 101 of the present embodiment.

As explained in the foregoing, even in case of using an image forming device that has not been used before (not storing the operation history), if an image forming device, of a type same as and capable of communication with the aforementioned image forming device, has been used before (operation history being stored in such image forming device of the same type), it is rendered possible to utilize the operation history stored in such image forming device of the same type whereby the work of executing all the setting from the beginning can be alleviated.

Also in case an operation history memorized in another image forming device is unusable in the image forming device to be used, the operation history details setting screen 101 is displayed excluding such operation history, thereby securely avoiding a productivity deteriorating factor that a setting based on an unusable operation history causes an error at the start of operation and necessitates a repeated setting operation.

The present embodiment has been explained by a local copy mode in which original data are inputted from the scanner unit of the own device and are printed in the print unit of the own device, but the aforementioned simplification of the setting operation of the image forming device by a re-use of the individual history or the whole history is naturally applicable also to a facsimile transmission mode, a box mode, or a remote copy mode in which original data are inputted from the scanner unit of the own device and are printed in the print unit of another device.

(Fourth Embodiment)

The foregoing second embodiment has explained a constitution of calling, from a setting screen of a driver printer functioning on an information processing device, an individual history stored in an image forming device capable of communication therewith and reusing such history in the setting of the print function for data transmitted to such image forming device from the information processing device, but it is also possible to call, from a setting screen of a driver printer functioning on an information processing device, an individual history stored in each of image forming devices capable of communication therewith and reusing such history in the setting of the print function for data transmitted to any of the image forming devices from the information processing device. In the following, there will be explained such embodiment.

Figure 25:
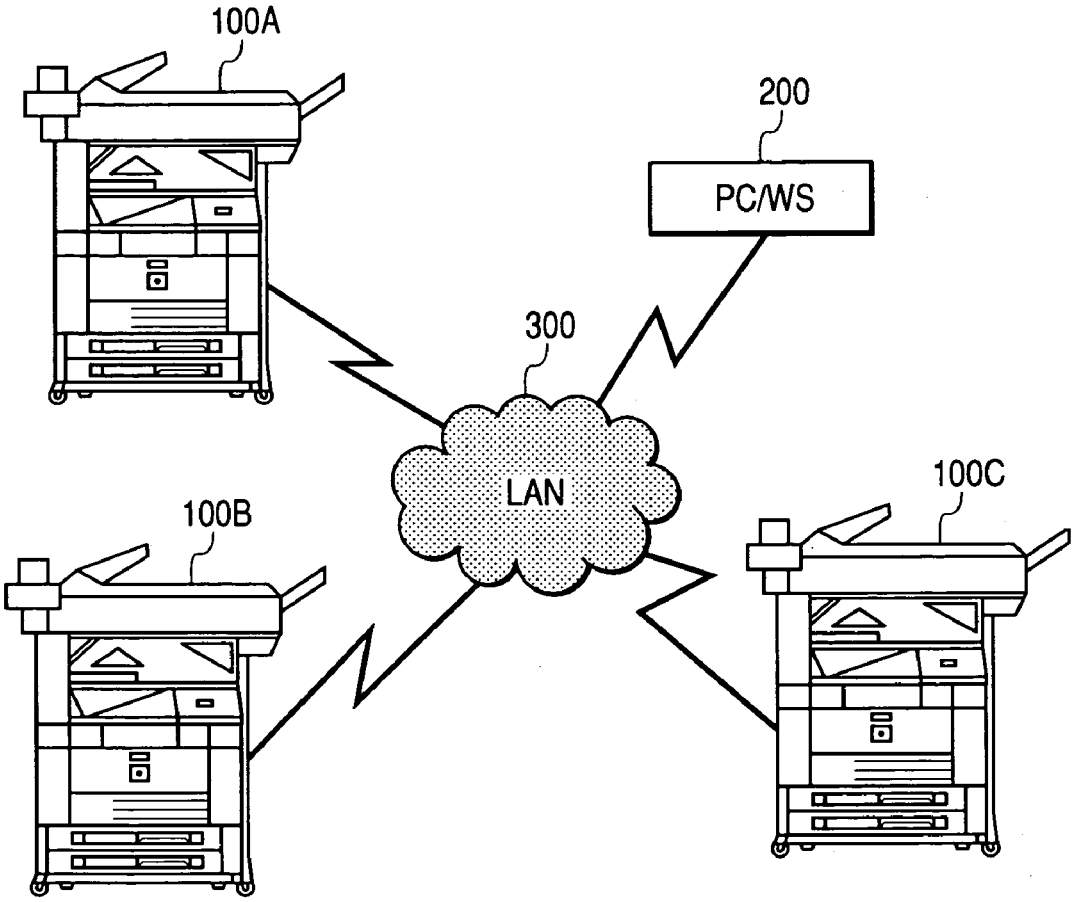
FIG. 25 is a block diagram showing a structure of a system including an image forming device and constituting a fourth embodiment of the present invention.

FIG. 25 is a block diagram showing a structure of a system including image forming devices in a fourth embodiment of the present invention, wherein components same as those in FIG. 22 are represented by same symbols.

As shown in FIG. 22, image forming devices 100 (100A–100C) and image processing devices 200 (for example PC/WS) are connected through a LAN 300 in a mutually communicable manner. The structure of the image forming devices 100A–100C is already shown in FIGS. 1 and 2 while the structure of the information processing device 200 is shown in FIG. 14, so that they will not be explained further.

Figure 26:
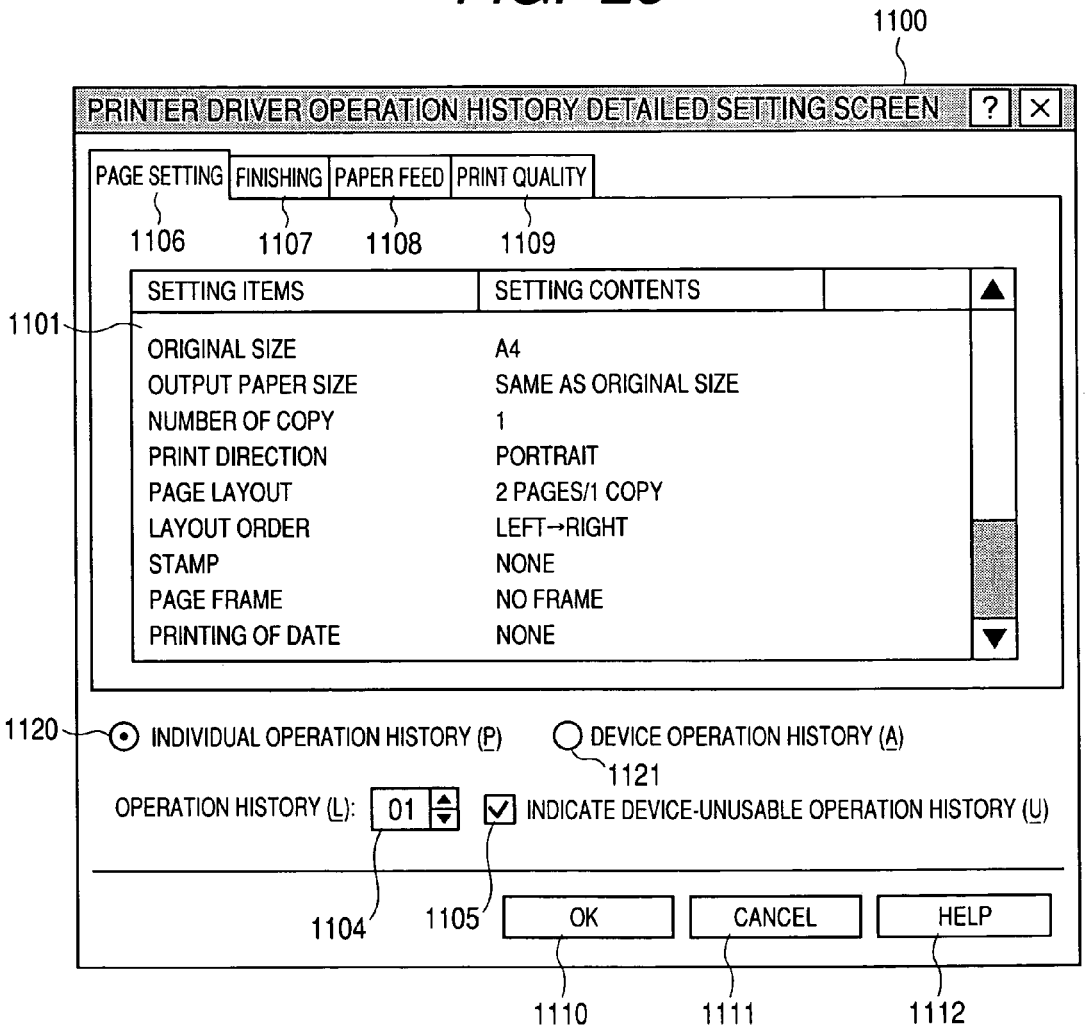
FIG. 26 is a schematic view showing an example of a printer driver operation history details setting screen to be executed on the information processing, device shown in FIG. 25.
Figure 29:
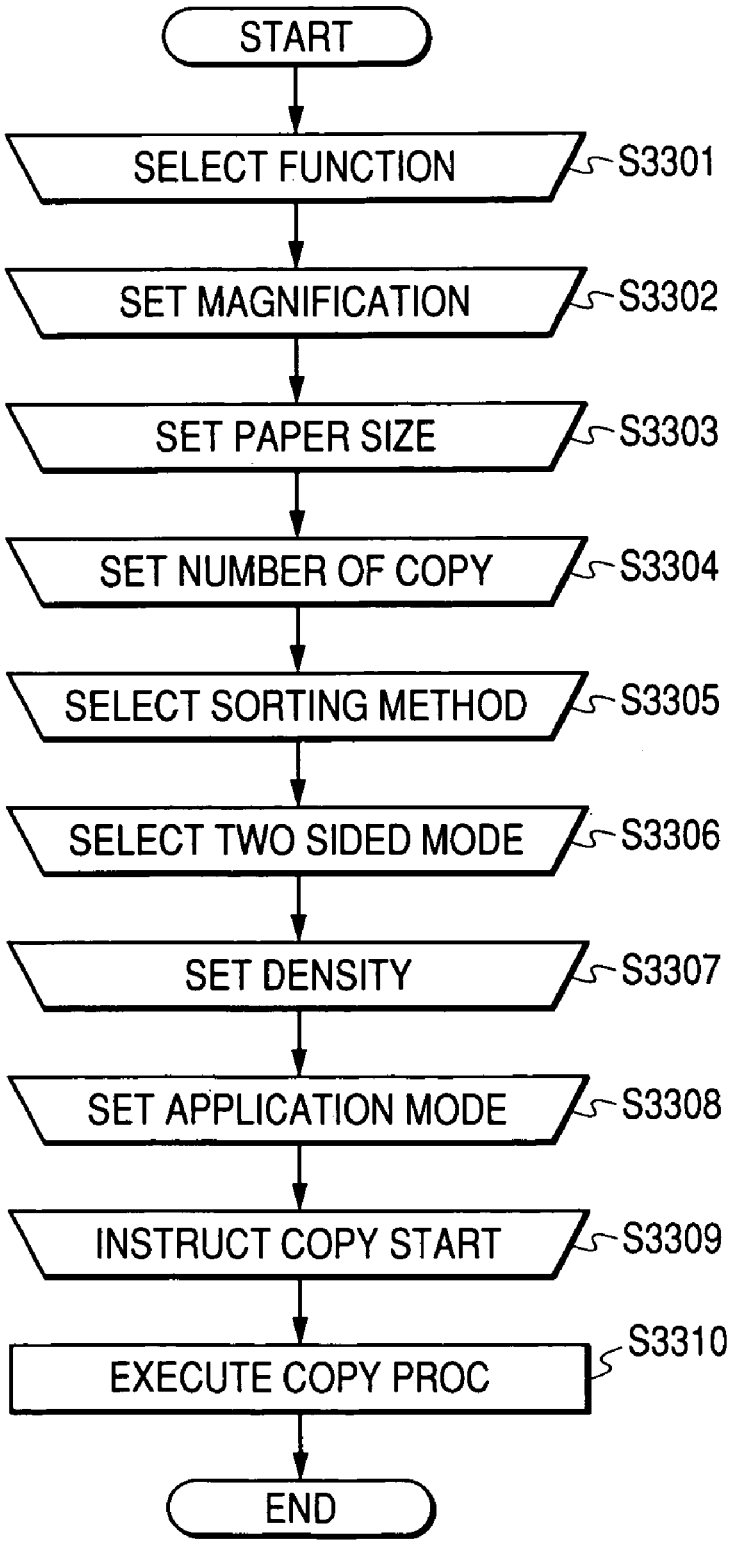
FIG. 29 is a flow chart showing an example of an operation sequence in case of a copy operation in a prior image forming device.
Figure 30:
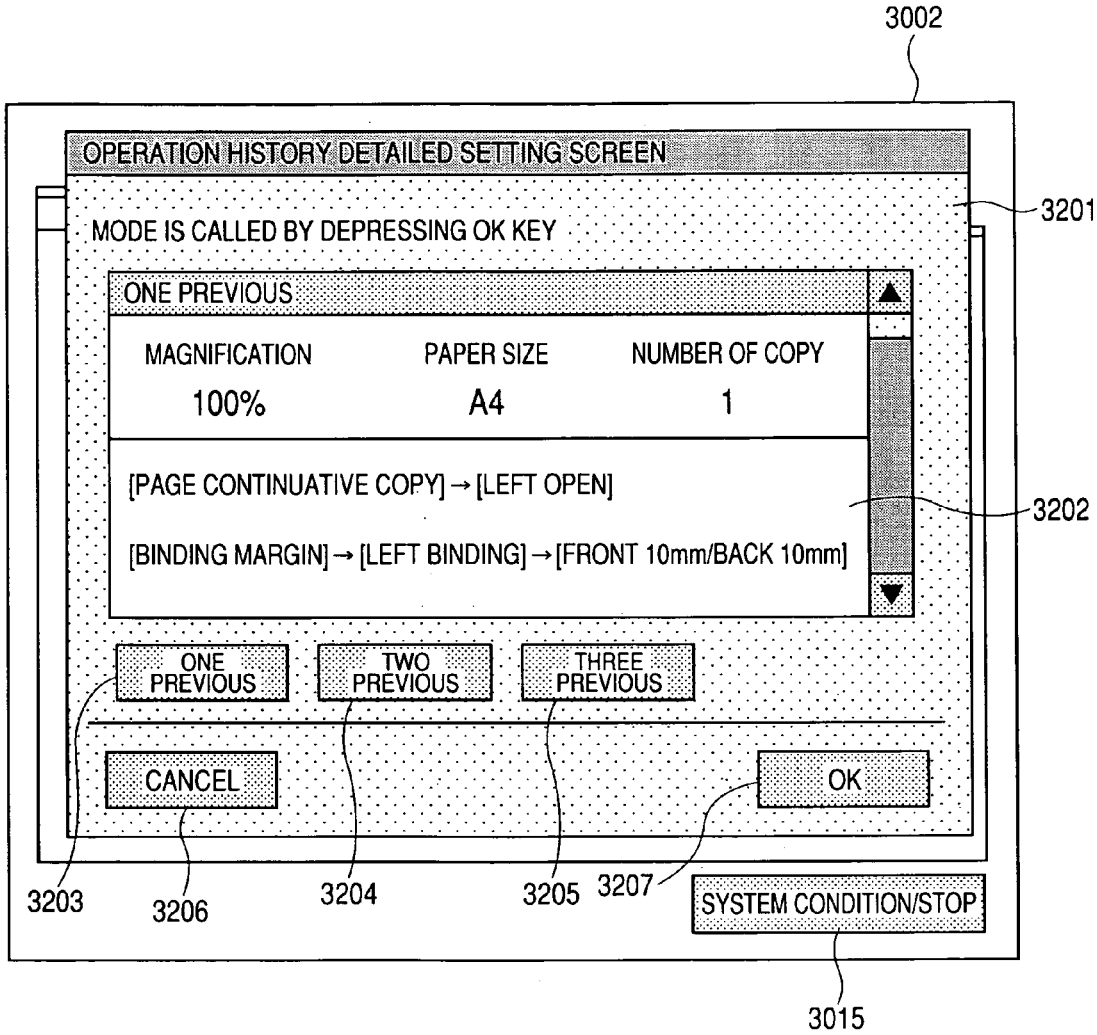
FIG. 30 is a schematic view showing an example of an operation history details setting screen in a prior image forming device.

FIG. 26 is a schematic view showing a structure of a printer driver operation history details setting screen which is executed on the image processing device 200 shown in FIG. 25 and is popup displayed on the monitor 10 shown in FIG. 14, wherein components same as those in FIG. 17 are represented by same symbols.

In FIG. 26, an individual operation history selecting UI 1120 of the present embodiment is used for collecting and displaying the individual operation history from plural image forming devices through the network (namely setting the history mode at a network individual history mode). A device operation history selecting UI 1121 of a currently selected image forming device is used for designating the display of the whole operation history of the currently selected image forming device (namely setting the history mode at a device history mode).

In case the device history is displayed in the printer driver operation history details setting screen 1110 (in case of the whole history mode), an operation user name, indicating the user who has made the operation, may also be displayed in the printer driver operation history information displaying screen 1101.

Also in case the network individual history is displayed on the printer driver history details setting screen 1110 (in case of network individual history mode), a device name, indicating the device which stores the history, may also be displayed on the printer driver history information display screen 1101.

In the following there will be explained, with reference to a printer driver screen shown in FIG. 26 and a flow chart shown in FIG. 27, a sequence of the print function of the image forming device utilizing the printer driver operation history details setting screen of the present embodiment.

FIG. 26 is a flow chart indicating an example of a fifth control sequence in the present invention, executed by the CPU 1 of the information processing device 200 shown in FIG. 14, based on a program stored in the external memory 11 or another recording medium. S1201–S1203, S1208, S1210, S1212–S1219 and S2701–S2709 in FIG. 27 indicate process steps, and steps same as those in FIG. 18 are represented by same step numbers.

At first, the operator selects an image forming device on an information processing device 200 serving as a print client, and, when the CPU 1 detects that the operator instructs activation of a printer driver corresponding to the selected image forming device (for example image forming device 100A), the CPU 1 activates the printer driver (S1201).

After the activation of the printer driver, the CPU 1 discriminates whether the user ID is effective, by checking that the user ID control UI 1001 provided in the user ID/operation history tab 905 shown in FIG. 16 is effectively set and that any value is set in the user ID input UI 1002 and the password input UI 1003 (S1202). In case the CPU 1 identifies that the user ID is effective, it executes a user authentication by communicating with the image forming device 100 based on the user ID and the password set in the user ID input UI 1002 and the password input UI 1003 (S1203), and then proceeds to a step S2701. In more details, it transmits the user ID and the password set in the user ID input UI 1002 and the password input UI 1003 and an authentication request to the image forming device (image forming device 100A in this case), thereby requesting an authentication thereto. The image forming device 100A executes an authentication process by comparing the user ID and the password received from the information processing device 200 with the user ID table 501 shown in FIG. 8, and returns a result of authentication to the information processing device 200. The information processing device 200 receives the result of authentication from the image forming device 100A, and the CPU 1 discriminates presence/absence of the authentication (whether the user authentication is successful).

On the other hand, in case the step S1202 identifies that the user ID is not effective, the CPU 1 skips the user authentication in the step S1203 and proceeds to a step S1204.

Then the printer driver (CPU 1) communicates with the selected image forming device (image forming device 100A in this case) to obtain the operation histories of all the users stored in the individual operation history memory table (FIG. 9) of the HDD unit 5507 of the image forming device 100A and the unauthenticated operation history stored in the unauthenticated operation history memory table (FIG. 10) (S2701), and stores all the obtained operation histories as "device operation history" in a memory area (for example RAM 2) of the client PC (information processing device 200) (S2702).

Then in a step S1219, the printer driver (CPU 1) further communicates with the selected image forming device 100A to obtain the current state of the image forming device 100A (by a request from the information processing device 200 to the image forming device 100A and by a response from the image forming device 100A to the information processing device 200), and stores such state in a memory area (for example RAM 2) on the client PC (information processing device 200). The stored state information of the image forming device 100 includes an error state of the image forming device 100, a constitution information of the image forming device 100 by an option or the like, size information of the paper medium and a remaining amount information.

Then, in a step S2703, the printer driver (CPU 1) discriminates whether the authentication of the user is completed (successful) in the step S1203, and, if not, proceeds to a step S2706.

On the other hand, in case the step S2703 identifies that the authentication of the user is completed, the printer driver (CPU 1) communicates in a step S2704 with another image forming device (other than image forming device 100A, namely image forming device 100B or 100C) to obtain the operation history of the user having the user authentication, stored in the individual operation history memory table (FIG. 9) of the HDD unit 5507 of the image forming device 100B or 100C and, in a step S2705, merges the operation history of the user having the user authentication obtained in the step 2701 from the selected image forming device, and the operation history of the user having the user authentication obtained in the step S2704 from as "individual operation history" and stores it in the memory area (for example RAM 2) in the client PC (information processing device 200). More specifically, the printer driver (CPU 1) transmits a request for the history information to the image forming device 100. The image forming device, having received the request, transmits (returns) operation history information corresponding to the corresponding user ID to the requesting information processing device 200. Then the requesting information processing device obtains and stores, in the RAM 2, the operation history information corresponding to the user ID returned from the image forming device.

In such merging process, according to the state of the device obtained in the step S1219, the CPU 1, after excluding (deleting) the operation history from an image forming device of a different type that is not usable in the image forming device 100A, executes a sorting in the order of time stamps based on the information of date and time of the operation.

Then the printer driver (CPU 1) awaits an operation from the operator, then discriminates in a step S2706 whether the device operation history selecting UI 1120 has been depressed, and, if depressed, reads all the operation histories S2702, then merges these, executes a sorting in the order of time stamps (corresponding to time and date of the operation history memory tables) (S2707), and executes a display process of displaying the latest operation history information on the printer driver operation history information display screen 1101 (S1208).

On the other hand, in case the CPU 1 identifies in the step S2706 that the whole operation history selecting UI 1103 is not depressed, the CPU 1 discriminates in a step S2708 whether the individual operation history selecting UI 1121 has been depressed, and, if depressed, then discriminates whether the operator currently operating the printer driver already has an individual authentication (S1210), and, if not, the CPU 1 returns to the step S1202 for executing a process of individual authentication in cooperation with the image forming device.

On the other hand, in case the step S1210 identifies that the individual authentication has already been made, the CPU 1 reads the individual operation history stored in the memory area in the foregoing step S2705, then merges these, executes a sorting in the order of time stamps (corresponding to the time and date of operation of the operation history memory tables) (S2709), and executes a display process of displaying the latest operation history information on the printer driver operation history information display screen 1101 (S1212). Other steps will not be explained as they are similar to those shown in FIG. 18.

In the information collecting process of the step S2704, it is possible to judge an image forming device of a same type (including a device of a same series, a same category and an interchangeable type) as the selected image forming device and to obtain the individual operation history from the image forming device of the same type only.

The above-described process allows the operator to obtain the device operation history stored in the selected image forming device or the individual operation history corresponding to the authenticated user, stored in the communicable image forming devices, and to reflect, whenever necessary the setting information of the print function set in the past on the printer driver. The present embodiment, as explained in the foregoing, provides a constitution in which the setting information used by the printer driver in the past is memorized in the operation history memory tables (FIGS. 9, 10) provided in the image forming device whereby the authenticated operator can obtain all the operation histories and reuse them even in case such operator executes operation from plural client PCs (information processing device 200), but it is naturally possible to construct a system in which the operation history memory table is provided in the client PC whereby the operator can obtain and reuse the operation history only from the operated client PC.

After the process sequence explained in FIG. 27, the OK switch 924 of the printer driver shown in FIG. 15 is depressed and an OK switch (a switch for instructing the start of print execution) on an unillustrated print dialog is depressed, whereupon the CPU 1 transmits the setting information, set as explained above, and a print instruction in succession to the image forming device, thereby starting a print process therein.

The foregoing procedure executes the print function of the image forming device utilizing the printer driver operation history details setting screen of the present embodiment.

As explained in the foregoing, also in a printer driver setting screen displayed on an information processing device corresponding to a specified image forming device, it is easily possible to select and set (reuse) a desired operation history from the individual history operated in the past in all the communicable image forming devices.

Also in case an operation history memorized in the image forming devices is unusable at the time of the display of the operation history, such situation is informed to the operator (or such operation history not being displayed) on the printer driver setting image for the image forming device displayed in the information processing device, thereby securely avoiding a productivity deteriorating factor that a setting based on an unusable operation history causes an error at the start of operation and necessitates a repeated setting operation.

The present embodiment has been explained by a constitution of activating a printer driver for an image forming device on an information processing device and selectively displaying an individual operation history or a whole operation history in the print mode on a setting screen of such printer driver, but it is also possible to activate a scanner driver for the image forming device on the information processing device and to selectively display an individual operation history or a whole operation history in a scanner mode for enabling reuse thereof for a scanner setting.

Also the foregoing embodiments explain a constitution in which the histories are memorized in the image forming device regardless of presence/absence of the individual authentication, but it is also possible to memorize the histories in the image forming device only in case of presence of the individual authentication.

Also the foregoing embodiments explain a constitution in which the histories are memorized in an image forming device, but it is also possible, in case a user executes a setting for canceling the history mode by an unillustrated user interface (such setting being memorized in the HDD unit 5507), not to memorize the history of such user.

Another constitution is also possible where the user can select whether or not to memorize the history at every timing of the memory of the history.

The screens shown in FIGS. 3–6, 13, 15–17, 20, 23 and 26 and structures and contents of the data shown in FIGS. 8–10 are not restrictive and can naturally be modified with various structures or contents according to application and purpose.

In the foregoing, the present invention has been explained by embodiments thereof, but the present invention can be realized in embodiments for example of a system, a device, a method, a program or a memory medium, and can more specifically be applied to a system constituted of plural equipment or a device constituted of a single equipment.

As explained in the foregoing, an embodiment is realized by executing an individual authentication for authenticating an operator, memorizing an operation history based on an inputted operation instruction in a memory for each authenticated individual, controlling a display of the operation history of the authenticated individual among the memorized operation history of each individual, selecting an arbitrary operation history among the displayed operation history and setting an image forming device based on the selected operation history, thereby solving prior drawbacks that even operation histories of other persons having a low possibility of re-use are also displayed and the operation history of the operator himself becomes difficult to find and that an older operation history is deleted by an operation of another person when the memory of the operation history reaches an upper limit of the memory, whereby the operator can easily select and re-use a desired operation history.

Also an embodiment is realized by obtaining a state of an image forming device and controlling the display of an operation history based on thus obtained state of the image forming device, thereby solving a prior drawback that the operator does not easily notice a situation where an operation set with a past operation history is not usable at the time of setting but notices an improper setting for the first time by an error message displayed on the image forming device, at the start of the actual copy operation, and executes the setting again thus resulting in a deteriorated productivity, and also securely preventing an erroneous setting of an unusable operation history by the operator thereby avoiding a deterioration of productivity by a re-setting.

Also an embodiment is realized by requesting an authentication of an operator from an in formation processing device to an image forming device thereby authenticating the operator, obtaining an operation history of an individual authenticated by the image forming device from the image forming device for a display on the information processing device, selecting an arbitrary operation history from thus displayed operation history in the information processing device, transmitting setting information of the image forming device based on thus selected operation history to the image forming device, storing the setting information received from the information processing device in a memory in the image forming device as an operation history for each authenticated individual, and setting the image forming device based on the setting information received from the information processing device, thereby enabling to easily select and reuse a desired operation history from the individual operation history of the operator, even in case of utilizing the image forming device from the information processing device.

Also an embodiment is realized by obtaining a state of an image forming device in an information processing device from the image forming device, and controlling the display of an operation history based on thus obtained state of the image forming device, thereby securely avoiding a situation where the operator erroneously set an operation history which is unusable at the time of setting, and, as a result, preventing a deterioration in the productivity by re-setting.

Also an embodiment is realized by executing an individual authentication for authenticating an operator, memorizing an operation history based on an inputted operation instruction in a memory for each authenticated individual, executing a data communication with another image forming device connected to a network, collecting through the communication an operation history of a specified individual authenticated by means for individual authentication, integrating the operation history for each individual stored in the memory and the collected operation history of the specified individual, then rearranging these histories in the order of time stamps, executing a control of leaving the operation histories from the latest one corresponding to a memory amount assigned to the operation history of the specified individual and deleting the older histories, displaying the operation history of the authenticated individual from the integrated operation history for each individual, selecting an arbitrary operation history among the displayed operation history, and setting the image forming device based on thus selected operation history, thereby solving prior drawbacks that even operation histories of other persons having a low possibility of re-use are also displayed and the operation history of the operator himself becomes difficult to find, also that an older operation history is deleted by an operation of another person when the memory of the operation history reaches an upper limit of the memory, and also enabling an operator, even when using an image forming device that has not been operated before (not storing an operation history), in case such image forming device is capable of communication with an image forming device of a same type which the operator has operated (storing an operation history therein), to utilize the operation history stored in the image forming device of the same type in the image forming device which the operator has not operated, thereby alleviating the works of all the setting from the beginning even in an image forming device to be used for the first time and solving a drawback that the image forming device used for the first time requires all the setting from the beginning as the operation history in another image forming device cannot be utilized, whereby the operator can easily select and re-use a desired operation history.

Therefore, the present invention provides an effect of providing an image forming device, an image forming system, capable of providing, in consideration of an environment of use by plural operators and an installation state at operation, an image forming environment capable of effectively utilizing operation histories stored in each image forming device and providing improved operability and productivity.

Also constitutions uniting any or all of the foregoing embodiments and variations thereof are also included in the present invention.

In the following, there will be given a comparison of the aforementioned embodiments of the present invention and the patent reference 1 explained in the prior technology.

In the aforementioned embodiments, the individual operation history and the unauthenticated operation history are respectively stored, and the individual operation history or the whole operation history itself is selectively utilized by the operator. Also in the third and fourth embodiments of the present invention, an individual operation history stored in an image forming device of a same type other than the device used for image formation is also collected and utilized by the operator. Further, the individual operation history is processed according to the state of the image forming device, and an unusable history is masked to avoid an erroneous unusable setting by the user.

On the other hand, in the patent reference 1, the image forming device holds an individual operation history, but such held individual operation history is used for changing the operation mode to the user and for customizing the operation of the image forming device, and there are not described characteristic constitutions of the embodiments of the present invention, such as that the operation history itself is utilized for setting by the operator and that the operation history is processed according to the current state of the device for masking unusable equipment. In this point, the embodiments of the present invention are fundamentally different form the patent reference 1.

These points are worth particular attention in considering the difference between the embodiments of the present invention and the image forming device described in the patent reference 1.

In the following there will be explained, with reference to a memory map shown in FIG. 28, a data processing program readable by the image forming apparatus or the information processing apparatus of the present invention.

FIG. 28 is a view showing a memory map of a memory medium (recording medium) storing various data processing programs readable by the image forming apparatus or the information processing apparatus of the present invention.

Although not particularly illustrated, there may also be stored information for managing programs stored in the memory medium, such as version information or a preparing person, and information dependent on an OS of the program reading side such as an icon for identifying the program.

Also data belonging to various programs are managed by the directory. Also there may be stored a program for installing various programs into a computer, and a thawing program in case the installed program is compressed.

The functions of the present invention shown in FIGS. 11, 12, 18, 19, 21, 24 and 27 may be realized by externally installed programs executed by a host computer. In such situation, the present invention is applicable also in case information including programs is supplied to an output device from a memory medium such as a CD-ROM, a flash memory or an FD, or from an external memory medium through a network.

The objects of the present invention can naturally be attained also by supplying a system or an apparatus with a memory medium storing program codes of a software realizing the functions of the aforementioned embodiments and by reading and executing the program codes stored in the memory medium by a computer (or CPU or MPU) of such system or apparatus.

In such case, the program codes themselves read from the memory medium realize the novel functions of the present invention, and the memory medium storing such program codes constitute the present invention.

The program is not restricted in its form as long as it has a function as a program, and includes object codes, a program executed by an interpreter or script data supplied to an OS.

A memory medium for supplying the program can be, for example, a flexible disk, a hard disk, an optical disk, a magnetooptical disk, an MO, a CD-ROM, a CD-R, a CD-RW, a magnetic tape, a non-volatile memory card, a ROM, or a DVD.

In such case, the program codes themselves read from the memory medium realize the novel functions of the present invention, and the memory medium storing such program codes constitute the present invention.

A program can also be supplied by making a connection to a home page on the internet utilizing browser of a client computer, and downloading, from such home page, a computer program itself of the present invention or a compressed file having an auto installing function into a memory medium such as a hard disk. Such supply can also be realized by dividing the program codes, constituting the program of the invention, into plural files and downloading the respective files from different home pages. Thus a www server and a ftp server for downloading a program file, for realizing the functions of the present invention by a computer, to plural users are also included in the claims of the present invention.

Such supply can also be realized distributing a memory medium such as a CD-ROM storing the program of the invention in an encrypted form to users, downloading decrypting key information to users who have cleared certain conditions from the home page through the internet, and installing the encrypted program by such key information into a computer.

The present invention includes not only a case where the functions of the aforementioned embodiments are realized by the execution of the read program codes by the computer, but also a case where an OS (operating system) or the like functioning on the computer executes all the actual processes or a part thereof under the instruction of such program codes, thereby realizing the functions of the aforementioned embodiments.

The present invention further includes a case where the program codes read from the memory medium are once stored in a memory provided in a function expansion board inserted into the computer or a function expansion unit connected to the computer and a CPU or the like provided on such function expansion board or function expansion unit executes all the actual processes or a part thereof under the instruction of such program codes, thereby realizing the functions of the aforementioned embodiments.

Also the present invention may be applied to a system constituted of plural equipment or a device constituted of a single equipment. The invention is naturally applicable also to a case where it is realized by supplying a system or a device with a program. In such case, such system or device can enjoy the effects of the present invention, by reading, from a memory medium, a program represented by a software for realizing the present invention.

The present invention is not limited to the foregoing embodiments but is subject to various modifications (including combinations of the embodiments) within the scope of the invention, and such modifications are also included within the scope of the invention.

The present invention has been explained by embodiments and examples thereof, but it will be easily understood to those skilled in that art that the spirit and scope of the present invention are not restricted to any particular description in the specification.

The first and third embodiments have been explained by a local copy mode in which original data are inputted from the scanner unit of the own device and are printed in the print unit of the own device, but the aforementioned simplification of the setting operation of the image forming device by a re-use of the individual history or the whole history is naturally applicable also to a facsimile transmission mode, a box mode, or a remote copy mode in which original data are inputted from the scanner unit of the own device and are printed in the print unit of another device.

The second and fourth embodiments have been explained by a constitution of activating a printer driver for an image forming device on an information processing device and selectively displaying an individual operation history or a whole operation history in the print mode on a setting screen of such printer driver, but it is also possible to activate a scanner driver for the image forming device on the information processing device and to selectively display an individual operation history or a whole operation history in a scanner mode for enabling reuse thereof for a scanner setting.

As explained in the foregoing, the present invention provides an image forming environment which can easily simplify setting operations by an operation history utilizing environment, excellent from the standpoint of the operator taking a situation of use by plural users and a status of the device at the operation into consideration.

Also the present invention can solve prior drawbacks that even operation histories of other persons having a low possibility of re-use are also displayed and the operation history of the operator himself becomes difficult to find and that an older operation history is deleted by an operation of another person when the memory of the operation history reaches an upper limit of the memory, whereby the operator can easily select and re-use a desired operation history.

Also the present invention can enable an operator, even when using an image forming device that has not been operated before (not storing an operation history), in case such image forming device is capable of communication with an image forming device of a same type which the operator has operated (storing an operation history therein), to utilize the operation history stored in the image forming device of the same type in the image forming device which the operator has not operated, thereby alleviating the works of all the setting from the beginning even in an image forming device to be used for the first time and solving the drawback that the image forming device used for the first time requires all the setting from the beginning as the operation history in another image forming device cannot be utilized, whereby the operator can easily select and re-use a desired operation history, thus improving the operability and the productivity through effective utilization of the operation history stored in each image forming device.

Also the present invention can solve a prior drawback that the operator does not easily notice a situation where an operation set with a past operation history is not usable at the time of setting or where a setting in another image forming device is not usable in the image forming device to be used, but notices an improper setting for the first time by an error message displayed on the image forming device, at the start of the actual copy operation, and executes the setting again thus resulting in a deteriorated productivity, and can securely prevent an erroneous setting of an unusable operation history by the operator thereby avoiding a deterioration of productivity by a re-setting, and can further provide an image forming environment which can easily simplify setting operations by an operation history utilizing environment, excellent from the standpoint of the operator taking a situation of use by plural users and a status of the device at the operation into consideration.

Also the present invention can enable an operator, in case of image formation from any of image forming devices available from an information processing device, to easily select and re-use a desired operation history from the operation histories of the image forming devices.

Also the present invention allows, in case of image formation from any of image forming devices available from an information processing device, to securely prevent an operator from an erroneous setting of an operation history not usable at the time of setting or an operation history of another image forming device not usable in the image forming device to be used, thereby avoiding a deterioration in the productivity resulting from a re-setting.

In this manner, the present invention can resolve the drawbacks anticipated in the prior technology and can provide a convenient environment comfortable for use taking operability and productivity in consideration.

This application claims priority from Japanese Patent Application Nos. 2003-395849 filed on Nov. 26, 2003, and 2004-120454 filed on Apr. 15, 2004, which are hereby incorporated by reference herein.

What is claimed is:

1. An image forming device including input means which inputs an operation instruction from an operator and display means which provides said operator with information and with said input means, the device comprising:

individual authentication means which is used for authenticating said operator;

operation history memory means which stores an operation history, based on an operation instruction inputted by said input means, for each individual authenticated by said individual authentication means;

operation history display means which displays, in said display means, an operation history of an individual authenticated by said individual authentication means, from the operation history of each individual memorized in said operation history memory means;

operation history selection means which selects an arbitrary operation history among the operation histories displayed on said display means;

setting means which executes a setting on said image forming device, based on the operation history selected by said operation history selection means;

device state obtaining means which obtains a state of said image forming device; and display control function setting means, wherein said operation history display means controls the display of the operation history on said display means according to the state of said image forming device obtained by said device state obtaining means, wherein said operation history display means has an indicating function for indicating an unusable operation history, according to the state of said image forming device obtained by said device state obtaining means, wherein said display control function setting means activates or deactivates the indicating function of said operation history display means, and wherein said operation history display means controls an active/inactive state of said indicating function, according to the setting state of said display control function setting means.

2. An image forming device according to claim 1, wherein said operation history memory means, at a timing of an input of a start instruction of an image forming process by said input means, memorizes a setting information on said image forming process as an operation history.

3. An image forming device according to claim 1, wherein said operation history includes one or more setting information of a time and date of operation, an image quality, an image drawing method, a print speed, a finish process, a paper feed process and a paper discharge process of the image forming process.

4. An image forming device according to claim 1, further comprising setting information display means which displays the setting information of the image forming device, corresponding to the operation history selected by said operation history selection means, on said display means.

5. An image forming device according to claim 1, further comprising:

history mode selection means which selects a whole history mode for displaying all the operation histories memorized in said operation history memory means on the display means or an individual history mode for displaying, from the individual operation history memorized in said operation history memory means, an operation history of an individual authenticated by said individual authentication means on the display means, wherein said operation history display means switches the operation history displayed on said display means, according to the history mode selected by said history mode selection means, to all the operation histories memorized in said operation history memory means or to an operation history of an individual specified by said individual authentication means from the individual operation history memorized in said operation history memory means.

6. An image forming device according to claim 1, wherein the indicating function of said operation history display means indicates a setting item constituting a cause for which said operation history is unusable.

7. An image forming device including input means which inputs an operation instruction from an operator and display means which provides said operator with information and with said input means, the device comprising:

individual authentication means which is used for authenticating said operator;

operation history memory means which stores an operation history, based on an operation instruction inputted by said input means, for each individual authenticated by said individual authentication means;

operation history display means which displays, in said display means, an operation history of an individual authenticated by said individual authentication means, from the operation history of each individual memorized in said operation history memory means;

operation history selection means which selects an arbitrary operation history among the operation histories displayed on said display means; and setting means which executes a setting on said image forming device, based on the operation history selected by said operation history selection means, wherein said operation history memory means memorizes an operation history of an operator unauthenticated by said authentication means as an unauthenticated operation history.

8. An image forming device including input means which inputs an operation instruction from an operator and display means which provides said operator with information and with said input means, the device comprising:

individual authentication means which is used for authenticating said operator;

operation history memory means which stores an operation history, based on an operation instruction inputted by said input means, for each individual authenticated by said individual authentication means;

operation history display means which displays, in said display means, an operation history of an individual authenticated by said individual authentication means, from the operation history of each individual memorized in said operation history memory means;

operation history selection means which selects an arbitrary operation history among the operation histories displayed on said display means;

setting means which executes a setting on said image forming device, based on the operation history selected by said operation history selection means; and device state obtaining means which obtains a state of said image forming device, wherein said operation history display means controls the display of the operation history on said display means according to the state of said image forming device obtained by said device state obtaining means, wherein said operation history display means has an indicating function for indicating an unusable operation history, according to the state of said image forming device obtained by said device state obtaining means, and wherein the indicating function of said operation history display means indicates an unusable setting item in a form unselectable by said operation history selection means, according to the state of said image forming device obtained by said device state obtaining means.

9. An image forming system constituted by an information processing device and an image forming device capable of communication through a predetermined communication medium, wherein:

said information processing device comprises:

input means which inputs an operation instruction from an operator;

display means which provides said operator with information;

individual authentication request means which requests an authentication of the operator to said image forming device;

operation history display means which obtains an operation history of an individual authenticated by said image forming device from said image forming device and displays it on said display means;

operation history selection means which selects an arbitrary operation history among the operation histories displayed on said display means;

transmission means which transmits a setting information of said image forming device, based on the operation history selected by said operation history selection means, to said image forming device;

device state obtaining means which obtains a state of said image forming device; and display control function setting means; and said image forming device comprises:

individual authentication means which authenticates the operator of said information processing device according to an authentication request from said information processing device;

operation history memory means which memorizes a setting information, received from said information processing device, as an operation history for each individual authenticated by said individual authentication means;

setting means which executes a setting of said image forming device, based on the setting information received from said information processing device; and device state transmission means which obtains a state of said image forming device in response to a request from said information processing device and transmits it to said information processing device, wherein said operation history display means controls the display of the operation history on said display means, according to the state of said image forming device obtained by said device state obtaining means, wherein said operation history display means has an indicating function for indicating an unusable operation history, according to the state of said image forming device obtained by said device state obtaining means, wherein said display control function setting means activates or deactivates the indicating function of said operation history display means, and wherein said operation history display means controls an active/inactive state of said indicating function, according to the setting state of said display control function setting means.

10. An image forming system according to claim 9, wherein:

said transmission means, at a timing of an input of a start instruction of an image forming process by said input means, transmits a setting information on said image forming process to said image forming device.

11. An image forming system according to claim 9, wherein:

said operation history includes one or more setting information of a time and date of operation, an image quality, an image drawing method, a print speed, a finish process, a paper feed process and a paper discharge process of the image forming process.

12. An image forming system according to claim 9, wherein:

said information processing device further comprises setting information display means which displays the setting information of the image formation, corresponding to the operation history selected by said operation history selection means, on said display means.

13. An image forming system according to claim 9, wherein:

said image forming device further comprises history mode selection means which selects a whole history mode for displaying all the operation histories memorized in said operation history memory means on the display means or an individual history mode for displaying, from the individual operation history memorized in said operation history memory means, an operation history of an individual authenticated by said individual authentication means on the display means; and said operation history display means switches the operation history displayed on said display means, according to the history mode selected by said history mode selection means, to all the operation histories memorized in said operation history memory means or to an operation history of an individual specified by said individual authentication means from the individual operation history memorized in said operation history memory means.

14. An image forming system according to claim 9, wherein:

the indicating function of said operation history display means indicates a setting item constituting a cause for which said operation history is unusable.

15. An image forming system constituted by an information processing device and an image forming device capable of communication through a predetermined communication medium, wherein:

said information processing device comprises:

input means which inputs an operation instruction from an operator;

display means which provides said operator with information;

individual authentication request means which requests an authentication of the operator to said image forming device;

operation history display means which obtains an operation history of an individual authenticated by said image forming device from said image forming device and displays it on said display means;

operation history selection means which selects an arbitrary operation history among the operation histories displayed on said display means; and transmission means which transmits a setting information of said image forming device, based on the operation history selected by said operation history selection means, to said image forming device; and said image forming device comprises:

individual authentication means which authenticates the operator of said information processing device according to an authentication request from said information processing device;

operation history memory means which memorizes a setting information, received from said information processing device, as an operation history for each individual authenticated by said individual authentication means; and setting means which executes a setting of said image forming device, based on the setting information received from said information processing device, wherein said operation history memory means memorizes an operation history of an operator unauthenticated by said authentication means as an unauthenticated operation history.

16. An image forming system constituted by an information processing device and an image forming device capable of communication through a predetermined communication medium, wherein:

said information processing device comprises:

input means which inputs an operation instruction from an operator;

display means which provides said operator with information;

individual authentication request means which requests an authentication of the operator to said image forming device;

operation history display means which obtains an operation history of an individual authenticated by said image forming device from said image forming device and displays it on said display means;

operation history selection means which selects an arbitrary operation history among the operation histories displayed on said display means;

transmission means which transmits a setting information of said image forming device, based on the operation history selected by said operation history selection means, to said image forming device; and device state obtaining means which obtains a state of said image forming device; and said image forming device comprises:

individual authentication means which authenticates the operator of said information processing device according to an authentication request from said information processing device;

operation history memory means which memorizes a setting information, received from said information processing device, as an operation history for each individual authenticated by said individual authentication means;

setting means which executes a setting of said image forming device, based on the setting information received from said information processing device; and device state transmission means which obtains a state of said image forming device in response to a request from said information processing device and transmits it to said information processing device, wherein said operation history display means controls the display of the operation history on said display means, according to the state of said image forming device obtained by said device state obtaining means, wherein said operation history display means has an indicating function for indicating an unusable operation history, according to the state of said image forming device obtained by said device state obtaining means, and wherein the indicating function of said operation history display means indicates an unusable setting item in a form unselectable by said operation history selection means, according to the state of said image forming device obtained by said device state obtaining means.

17. An image forming device including input means which inputs an operation instruction and display means which provides an information display and said input means, the device comprising:

operation history memory means which memorizes an operation history based on the operation instruction inputted by said input means;

communication means which executes a data communication with one or plural other image forming devices communicable through a predetermined network;

operation history collection means which collects an operation history from said one or plural other image forming devices utilizing said communication means;

operation history integration means which integrates the operation history memorized by said operation history memory means and the operation history collected by said operation history collection means from said one or plural other image forming devices;

operation history display means which displays the operation history integrated by said operation history integrating means on said display means;

operation history selection means which selects an arbitrary operation history from the operation histories displayed on said display means;

setting means which executes a setting of said image forming device based on the operation history selected by said operation history selection means;

device state obtaining means which obtains a state of said image forming device; and display control function setting means, wherein said operation history display means controls the display of the operation history on said display means according the state of said image forming device obtained by said device state obtaining means, wherein said operation history display means has an indicating function for indicating an unusable operation history, according to the state of said image forming device obtained by said device state obtaining means, wherein said display control function setting means activates or deactivates the indicating function of said operation history display means, and wherein said operation history display means controls an active/inactive state of said indicating function, according to the setting state of said display control function setting means.

18. An image forming device according to claim 17, further comprising:

individual authentication means which executes an authentication process based on user information;

wherein said operation history memory means memorizes an operation history, based on an operation instruction inputted by said input means, for each user information authenticated by said individual authentication means;

said operation history collection means collects, from said one or plural other image forming devices utilizing said communication means, an operation history corresponding to the user information authenticated by said individual authentication means;

said operation history integration means integrates the operation history memorized by said operation history memory means and corresponding to the user information authenticated by said individual authentication means, and the operation history collected by said operation history collection means from said one or plural other image forming devices and corresponding to the user information authenticated by said individual authentication means; and said operation history display means displays the operation history integrated by said operation history integrating means and corresponding to the user information authenticated by said individual authentication means on said display means.

19. An image forming device according to claim 17, wherein:

said operation history memory means, at a timing of an input of a start instruction of an image forming process by said input means, memorizes a setting information on said image forming process as an operation history.

20. An image forming device according to claim 17, wherein:

said operation history includes one or more setting information of a time and date of operation, an image quality, an image drawing method, a print speed, a finish process, a paper feed process and a paper discharge process of the image forming process.

21. An image forming device according to claim 17, further comprising:

setting information display means which displays the setting information of the image forming device, corresponding to the operation history selected by said operation history selection means, on said display means.

22. An image forming device according to claim 18, further comprising:

history mode selection means which selects a whole history mode for displaying all the operation histories memorized in said operation history memory means on the display means or an individual history mode for displaying, from the individual operation history memorized in said operation history memory means, an operation history corresponding to a user information authenticated by said individual authentication means on the display means;

wherein said operation history display means switches the operation history displayed on said display means, according to the history mode selected by said history mode selection means, to all the operation histories memorized in said operation history memory means or to an operation history corresponding to a user information specified by said individual authentication means from the individual operation history memorized in said operation history memory means.

23. An image forming device according to claim 17, wherein:

the indicating function of said operation history display means indicates a setting item constituting a cause for which said operation history is unusable.

24. An image forming device including input means which inputs an operation instruction and display means which provides an information display and said input means, the device comprising:

operation history memory means which memorizes an operation history based on the operation instruction inputted by said input means;

communication means which executes a data communication with one or plural other image forming devices communicable through a predetermined network;

operation history collection means which collects an operation history from said one or plural other image forming devices utilizing said communication means;

operation history integration means which integrates the operation history memorized by said operation history memory means and the operation history collected by said operation history collection means from said one or plural other image forming devices;

operation history display means which displays the operation history integrated by said operation history integrating means on said display means;

operation history selection means which selects an arbitrary operation history from the operation histories displayed on said display means; and setting means which executes a setting of said image forming device based on the operation history selected by said operation history selection means, wherein said operation history memory means memorizes an operation history not correlated with a user information authenticated by said authentication means.

25. An image forming device including input means which inputs an operation instruction and display means which provides an information display and said input means, the device comprising:

operation history memory means which memorizes an operation history based on the operation instruction inputted by said input means;

communication means which executes a data communication with one or plural other image forming devices communicable through a predetermined network;

operation history collection means which collects an operation history from said one or plural other image forming devices utilizing said communication means;

operation history integration means which integrates the operation history memorized by said operation history memory means and the operation history collected by said operation history collection means from said one or plural other image forming devices;

operation history display means which displays the operation history integrated by said operation history integrating means on said display means;

operation history selection means which selects an arbitrary operation history from the operation histories displayed on said display means;

setting means which executes a setting of said image forming device based on the operation history selected by said operation history selection means; and device state obtaining means which obtains a state of said image forming device, wherein said operation history display means controls the display of the operation history on said display means according to the state of said image forming device obtained by said device state obtaining means, wherein said operation history display means has an indicating function for indicating an unusable operation history, according to the state of said image forming device obtained by said device state obtaining means, and wherein the indicating function of said operation history display means indicates an unusable setting item in a form unselectable by said operation history selection means, according to the state of said image forming device obtained by said device state obtaining means.

26. An image forming system constituted by an information processing device and one or plural image forming devices capable of communication through a predetermined communication medium, wherein;

said information processing device comprises:

input means which inputs an operation instruction;

display means which provides an information display;

operation history collection means which collects an operation history from said image forming devices;

operation history display means which integrates the operation history from said image forming devices and executes a display on said display means;

operation history selection means which selects an arbitrary operation history among the operation histories displayed on said display means;

transmission means which transmits a setting information, based on the operation history selected by said operation history selection means, to one of said image forming devices; and device state obtaining means which obtains a state of said image forming device; and said image forming device comprises:

operation history memory means which memorizes the setting information, received from said information processing device, as an operation history;

operation history transmission means which transmits an operation history memorized in said operation history memory means in response to a request from said information processing device;

setting means which executes a setting, based on the setting information received from said information processing device; and device state transmission means which obtains a state of said image forming device in response to a request from said information processing device and transmits it to said information processing device, wherein said operation history display means controls the display of the operation history on said display means, according to the state of said image forming device obtained by said device state obtaining means, wherein said operation history display means has an indicating function for indicating an unusable operation history, according to the state of said image forming device obtained by said device state obtaining means, and wherein the indicating function of said operation history display means indicates an unusable setting item in a form unselectable by said operation history selection means, according to the state of said image forming device obtained by said device state obtaining means.

27. An image forming system according to claim 26, wherein:

said information processing device further comprises:

individual authentication request means which transmits a user information to said image forming device and requests an authentication process based on said user information, wherein said operation history collection means collects an operation history corresponding to the user information authenticated by said image forming devices from said image forming devices; and each said image forming device further comprises:

individual authentication means which executes an authentication process based on the user information transmitted from said information processing device, in response to an authentication request from said information processing device, wherein said operation history memory means memorizes the setting information, received from said information processing device as an operation history, for each user information authenticated by said individual authentication means.

28. An image forming system according to claim 26, wherein:

said transmission means, at a timing of an input of a start instruction of an image forming process by said input means, transmits a setting information on said image forming process to said image forming device.

29. An image forming system according to claim 26, wherein:

said operation history includes one or more setting information of a time and date of operation, an image quality, an image drawing method, a print speed, a finish process, a paper feed process and a paper discharge process of the image forming process.

30. An image forming system according to claim 26, further comprising:

setting information display means which displays the setting information of the image forming device, corresponding to the operation history selected by said operation history selection means, on said display means.

31. An image forming system according to claim 26, further comprising:

history mode selection means which selects a whole history mode for displaying all the operation histories memorized in the operation history memory means in any of the image forming devices on the display means or an individual history mode for displaying, from the individual operation history memorized in the operation history memory means of the image forming devices, an operation history corresponding to a user information authenticated by said individual authentication means on the display means;

wherein said operation history display means switches the operation history displayed on said display means, according to the history mode selected by said history mode selection means, to all the operation histories memorized in said operation history memory means of any of the image forming devices or to an operation history corresponding to a user information authenticated by said image forming devices from said image forming devices.

32. An image forming system according to claim 26, wherein:

the indicating function of said operation history display means indicates a setting item constituting a cause for which said operation history is unusable.

33. An image forming system constituted by an information processing device and one or plural image forming devices capable of communication through a predetermined communication medium, wherein:

said information processing device comprises:

input means which inputs an operation instruction;

display means which provides an information display;

operation history collection means which collects an operation history from said image forming devices;

operation history display means which integrates the operation history from said image forming devices and executes a display on said display means;

operation history selection means which selects an arbitrary operation history among the operation histories displayed on said display means; and transmission means which transmits a setting information, based on the operation history selected by said operation history selection means, to one of said image forming devices; and said image forming device comprises:

operation history memory means which memorizes the setting information, received from said information processing device, as an operation history;

operation history transmission means which transmits an operation history memorized in said operation history memory means in response to a request from said information processing device; and setting means which executes a setting, based on the setting information received from said information processing device, wherein said operation history memory means memorizes an operation history not correlated with a user information authenticated by authentication means.

34. A computer readable memory medium storing a program for executing a control method for an image forming device including input means which inputs an operation instruction from an operator and display means which provides said operator with information and with said input means, the method comprising:

an individual authentication step which is used for authenticating said operator;

an operation history memory step which stores an operation history, based on an operation instruction inputted by said input means, for each individual authenticated in said individual authentication step;

an operation history display step which displays, in said display means, an operation history of an individual authenticated by said individual authentication step, from the operation history of each individual memorized in said operation history memory step;

an operation history selection step which selects an arbitrary operation history among the operation histories displayed on said display means;

a setting step which executes a setting on said image forming device, based on the operation history selected in said operation history selection step;

a device state obtaining step which obtains a state of said image forming device; and a display control function setting step, wherein said operation history display step controls the display of the operation history on said display means according to the state of said image forming device obtained in said device state obtaining step, wherein said operation history display step has an indicating function for indicating an unusable operation history, according to the state of said image forming device obtained in said device state obtaining step, wherein said display control function setting step activates or deactivates the indicating function of said operation history display step, and wherein said operation history display step controls an active/inactive state of said indicating function, according to the setting state of said display control function setting step.

35. A computer readable memory medium storing a program for executing a control method for an image forming device including input means which inputs an operation instruction from an operator and display means which provides said operator with information and with said input means, the method comprising:

an individual authentication step which is used for authenticating said operator;

an operation history memory step which stores an operation history, based on an operation instruction inputted by said input means, for each individual authenticated in said individual authentication step;

an operation history display step which displays, in said display means, an operation history of an individual authenticated in said individual authentication step, from the operation history of each individual memorized in said operation history memory step;

an operation history selection step which selects an arbitrary operation history among the operation histories displayed on said display means;

a setting step which executes a setting on said image forming device, based on the operation history selected in said operation history selection step; and a device state obtaining step which obtains a state of said image forming device, wherein said operation history display step controls the display of the operation history on said display means according to the state of said image forming device obtained in said device state obtaining step, wherein said operation history display step has an indicating function for indicating an unusable operation history, according to the state of said image forming device obtained in said device state obtaining step, and wherein the indicating function of said operation history display step indicates an unusable setting item in a form unselectable in said operation history selection step, according to the state of said image forming device obtained in said device state obtaining step.

36. A control method for an image forming system constituted by an information processing device and an image forming device capable of communication through a predetermined communication medium, wherein:

said information processing device performs:

an input step which inputs an operation instruction from an operator;

a display step which provides said operator with information;

an individual authentication request step which requests an authentication of the operator to said image forming device;

an operation history display step which obtains an operation history of an individual on authenticated by said image forming device from said image forming device and displays it in said display step;

an operation history selection step which selects an arbitrary operation history among the operation histories displayed in said display step; and a transmission step which transmits a setting information of said image forming device, based on the operation history selected in said operation history selection step, to said image forming device;

a device state obtaining step which obtains a state of said image forming device; and a display control function setting step; and said image forming device performs:

an individual authentication step which authenticates the operator of said information processing device according to an authentication request from said information processing device;

an operation history memory step which memorizes a setting information, received from said information processing device, as an operation history for each individual authenticated in said individual authentication step;

a setting step which executes a setting of said image forming device, based on the setting information received from said information processing device; and a device state transmission step which obtains a state of said image forming device in response to a request from said information processing device and transmits it to said information processing device, wherein said operation history display step controls the display of the operation history in said display step, according to the state of said image forming device obtained in said device state obtaining step, wherein said operation history display step has an indicating function for indicating an unusable operation history, according to the state of said image forming device obtained in said device state obtaining step, wherein said display control function setting step activates or deactivates the indicating function of said operation history display step, and wherein said operation history display step controls an active/inactive state of said indicating function, according to the setting state of said display control function setting step.

37. A control method for an image forming system constituted by an information processing device and an image forming device capable of communication through a predetermined communication medium, wherein:

said information processing device performs:

an input step which inputs an operation instruction from an operator;

a display step which provides said operator with information;

an individual authentication request step which requests an authentication of the operator to said image forming device;

an operation history display step which obtains an operation history of an individual authenticated by said image forming device from said image forming device and displays it in said display step;

an operation history selection step which selects an arbitrary operation history among the operation histories displayed in said display step;

a transmission step which transmits a setting information of said image forming device, based on the operation history selected in said operation history selection step, to said image forming device; and a device state obtaining step which obtains a state of said image forming device; and said image forming device performs:

an individual authentication step which authenticates the operator of said information processing device according to an authentication request from said information processing device;

an operation history memory step which memorizes a setting information, received from said information processing device, as an operation history for each individual authenticated by said individual authentication step;

a setting step which executes a setting of said image forming device, based on the setting information received from said information processing device; and a device state transmission step which obtains a state of said image forming device in response to a request from said information processing device and transmits it to said information processing device, wherein said operation history display step controls the display of the operation history in said display step, according to the state of said image forming device obtained in said device state obtaining step, wherein said operation history display step has an indicating function for indicating an unusable operation history, according to the state of said image forming device obtained in said device state obtaining step, and wherein the indicating function of said operation history display step indicates an unusable setting item in a form unselectable in said operation history selection step, according to the state of said image forming device obtained in said device state obtaining step.

38. A computer readable memory medium storing a program for executing a control method for an image forming device including input means which inputs an operation instruction from an operator and display means which provides said operator with information and with said input means, the method comprising:

an individual authentication step which is used for authenticating said operator;

an operation history memory step which stores an operation history, based on an operation instruction inputted by said input means, for each individual authenticated in said individual authentication step;

an operation history display step which displays, in said display means, an operation history of an individual authenticated in said individual authentication step, from the operation history of each individual memorized in said operation history memory step;

an operation history selection step which selects an arbitrary operation history among the operation histories displayed on said display means; and a setting step which executes a setting on said image forming device, based on the operation history selected in said operation history selection step, wherein said operation history memory step memorizes an operation history of an operator unauthenticated in said authentication step as an unauthenticated operation history.

39. A control method for an image forming system constituted by an information processing device and an image forming device capable of communication through a predetermined communication medium, wherein:

said information processing device performs:

an input step which inputs an operation instruction from an operator;

a display step which provides said operator with information;

an individual authentication request step which request an authentication of the operator to said image forming device;

an operation history display step which obtains an operation history of an individual authenticated by said image forming device from said image forming device and displays it in said display step;

an operation history selection step which selects an arbitrary operation history among the operation histories displayed in said display step; and a transmission step which transmits a setting information of said image forming device, based on the operation history selected in said operation history selection step, to said image forming device; and said image forming device performs:

an individual authentication step which authenticates the operator of said information processing device according to an authentication request from said information processing device;

an operation history memory step which memorizes a setting information, received from said information processing device, as an operation history for each individual authenticated in said individual authentication step; and a setting step which executes a setting of said image forming device, based on the setting information received from said information processing device, wherein said operation history memory step memorizes an operation history of an operator unauthenticated in said authentication step as an unauthenticated operation history.

40. A computer readable memory medium storing a program for executing a control method for an image forming system constituted by an information processing device and an image forming device capable of communication through a predetermined communication medium, wherein:

said information processing device performs:

an input step which inputs an operation instruction from an operator;

a display step which provides said operator with information;

an individual authentication request step which requests an authentication of the operator to said image forming device;

an operation history display step which obtains an operation history of an individual authenticated by said image forming device from said image forming device and displays it in said display step;

an operation history selection step which selects an arbitrary operation history among the operation histories displayed in said display step;

a transmission step which transmits a setting information of said image forming device, based on the operation history selected in said operation history selection step, to said image forming device;

a device state obtaining step which obtains a state of said image forming device; and a display control function setting step; and said image forming device performs:

an individual authentication step which authenticates the operator of said information processing device according to an authentication request from said information processing device;

an operation history memory step which memorizes a setting information, received from said information processing device, as an operation history for each individual authenticated in said individual authentication step;

a setting step which executes a setting of said image forming device, based on the setting information received from said information processing device; and a device state transmission step which obtains a state of said image forming device in response to a request from said information processing device and transmits it to said information processing device, wherein said operation history display step controls the display of the operation history in said display step, according to the state of said image forming device obtained in said device state obtaining step, wherein said operation history display step has an indicating function for indicating an unusable operation history, according to the state of said image forming device obtained in said device state obtaining step, wherein said display control function setting step activates or deactivates the indicating function of said operation history display step, and wherein said operation history display step controls an active/inactive state of said indicating function, according to the setting state of said display control function setting step.

41. A computer readable memory medium storing a program for executing a control method for an image forming system constituted by an information processing device and an image forming device capable of communication through a predetermined communication medium, wherein:

said information processing device performs:

an input step which inputs an operation instruction from an operator;

a display step which provides said operator with information;

an individual authentication request step which requests an authentication of the operator to said image forming device;

an operation history display step which obtains an operation history of an individual authenticated by said image forming device from said image forming device and displays it in said display step;

an operation history selection step which selects an arbitrary operation history among the operation histories displayed in said display step;

a transmission step which transmits a setting information of said image forming device, based on the operation history selected in said operation history selection step, to said image forming device; and a device state obtaining step which obtains a state of said image forming device; and said image forming device performs:

an individual authentication step which authenticates the operator of said information processing device according to an authentication request from said information processing device;

an operation history memory step which memorizes a setting information, received from said information processing device, as an operation history for each individual authenticated in said individual authentication step;

a setting step which executes a setting of said image forming device, based on the setting information received from said information processing device; and a device state transmission step which obtains a state of said image forming device in response to a request from said information processing device and transmits it to said information processing device, wherein said operation history display step controls the display of the operation history in said display step, according to the state of said image forming device obtained in said device state obtaining step, wherein said operation history display step has an indicating function for indicating an unusable operation history, according to the state of said image forming device obtained by said device state obtaining step, and wherein the indicating function of said operation history display step indicates an unusable setting item in a form unselectable in said operation history selection step, according to the state of said image forming device obtained in said device state obtaining step.

42. A computer readable memory medium storing a program for executing a control method for an image forming device including input means which inputs an operation instruction from an operator and display means which provides said operator with information and with said input means, the method comprising:

an operation history memory step which memorizes an operation history based on the operation instruction inputted by said input means;

a communication step which executes a data communication with one or plural other image forming devices communicable through a predetermined network;

an operation history collection step which collects an operation history from said one or plural other image forming devices utilizing said communication step;

an operation history integration step which integrates the operation history memorized in said operation history memory step and the operation history collected in said operation history collection step from said one or plural other image forming devices;

an operation history display step which displays the operation history integrated in said operation history integrating step on said display means;

an operation history selection step which selects an arbitrary operation history from the operation histories displayed on said display means;

a setting step which executes a setting of said image forming device based on the operation history selected in said operation history selection step;

a device state obtaining step which obtains a state of said image forming device; and a display control function setting step, wherein said operation history display step controls the display of the operation history on said display means according the state of said image forming device obtained in said device state obtaining step, wherein said operation history display step has an indicating function for indicating an unusable operation history, according to the state of said image forming device obtained in said device state obtaining step, wherein said display control function setting step activates or deactivates the indicating function of said operation history display step, and wherein said operation history display step controls an active/inactive state of said indicating function, according to the setting state of said display control function setting step.

43. A computer readable memory medium storing a program for executing a control method for an image forming device including input means which inputs an operation instruction from an operator and display means which provides said operator with information and with said input means, the method comprising:

an operation history memory step which memorizes an operation history based on the operation instruction inputted by said input means;

a communication step which executes a data communication with one or plural other image forming devices communicable through a predetermined network;

a operation history collection step which collects an operation history from said one or plural other image forming devices utilizing said communication step;

an operation history integration step which integrates the operation history memorized in said operation history memory step and the operation history collected in said operation history collection step from said one or plural other image forming devices;

an operation history display step which displays the operation history integrated in said operation history integration step on said display means;

an operation history selection step which selects an arbitrary operation history from the operation histories displayed on said display means;

a setting step which executes a setting of said image forming device based on the operation history selected in said operation history selection step; and a device state obtaining step which obtains a state of said image forming device, wherein said operation history display step controls the display of the operation history on said display means according the state of said image forming device obtained in said device state obtaining step, wherein said operation history display step has an indicating function for indicating an unusable operation history, according to the state of said image forming device obtained in said device state obtaining step, and wherein the indicating function of said operation history display step indicates an unusable setting item in a form unselectable in said operation history selection step, according to the state of said image forming device obtained in said device state obtaining step.

44. A control method for an image forming system constituted by an information processing device and one or plural image forming devices capable of communication through a predetermined communication medium, wherein:

said information processing device performs;

an input step which inputs an operation instruction;

a display step which provides an information display;

an operation history collection step which collects an operation history from said image forming devices;

an operation history display step which integrates the operation history from said image forming devices and executes a display in said display step;

an operation history selection step which selects an arbitrary operation history among the operation histories displayed in said display step;

a transmission step which transmits a setting information, based on the operation history selected in said operation history selection step, to one of said image forming devices; and a device state obtaining step which obtains a state of said image forming device; and said image forming device performs:

an operation history memory step which memorizes the setting information, received from said information processing device, as an operation history;

an operation history transmission step which transmits an operation history memorized in said operation history memory step in response to a request from said information processing device;

a setting step which executes a setting, based on the setting information received from said information processing device; and a device state transmission step which obtains a state of said image forming device in response to a request from said information processing device and transmits it to said information processing device, wherein said operation history display step controls the display of the operation history in said display step, according to the state of said image forming device obtained in said device state obtaining step, wherein said operation history display step has an indicating function for indicating an unusable operation history, according to the state of said image forming device obtained in said device state obtaining step, and wherein the indicating function of said operation history display step indicates an unusable setting item in a form unselectable in said operation history selection step, according to the state of said image forming device obtained in said device state obtaining step.

45. A control method for an image forming system constituted by an information processing device and one or plural image forming devices capable of communication through a predetermined communication medium, wherein:

said information processing device performs:

an input step which inputs an operation instruction;

a display step which provides an information display;

an operation history collection step which collects an operation history from said image forming devices;

an operation history display step which integrates the operation history from said image forming devices and executes a display on said display means;

an operation history selection step which selects an arbitrary operation history among the operation histories displayed on said display step; and a transmission step which transmits a setting information, based on the operation history selected in said operation history selection step, to one of said image forming devices; and said image forming device performs:

an operation history memory step which memorizes the setting information, received from said information processing device, as an operation history;

an operation history transmission step which transmits an operation history memorized in said operation history memory step in response to a request from said information processing device; and a setting step which executes a setting, based on the setting information received from said information processing device, wherein said operation history memory step memorizes an operation history not correlated with a user information authenticated in an authentication step.

46. A computer readable memory medium storing a program for executing a control method for an image forming system constituted by an information processing device and one or plural image forming devices capable of communication through a predetermined communication medium, wherein:

said information processing device performs:

an input step which inputs an operation instruction;

a display step which provides an information display;

an operation history collection step which collects an operation history from said image forming devices;

an operation history display step which integrates the operation history from said image forming devices and executes a display in said display step;

an operation history selection step which selects an arbitrary operation history among the operation histories displayed in said display step;

a transmission step which transmits a setting information, based on the operation history selected in said operation history selection step, to one of said image forming devices; and a device state obtaining step which obtains a state of said image forming device; and said image forming device performs:

an operation history memory step which memorizes the setting information, received from said information processing device, as an operation history;

an operation history transmission step which transmits an operation history memorized in said operation history memory step in response to a request from said information processing device;

a setting step which executes a setting, based on the setting information received from said information processing device; and a device state transmission step which obtains a state of said image forming device in response to a request from said information processing device and transmits it to said information processing device, wherein said operation history display step controls the display of the operation history in said display step, according to the state of said image forming device obtained in said device state obtaining step, wherein said operation history display step has an indicating function for indicating an unusable operation history, according to the state of said image forming device obtained in said device state obtaining step, and wherein the indicating function of said operation history display step indicates an unusable setting item in a form unselectable in said operation history selection step, according to the state of said image forming device obtained in said device state obtaining step.

47. A computer readable memory medium storing a program for executing a control method for an image forming system constituted by an information processing device and one or plural image forming devices capable of communication through a predetermined communication medium, wherein:

said information processing device performs:

an input step which inputs an operation instruction;

a display step which provides an information display;

an operation history collection step which collects an operation history from said image forming devices;

an operation history display step which integrates the operation history from said image forming devices and executes a display in said display step;

an operation history selection step which selects an arbitrary operation history among the operation histories displayed in said display step;

a transmission step which transmits a setting information, based on the operation history selected in said operation history selection step, to one of said image forming devices; and a device state obtaining step which obtains a state of said image forming device; and said image forming device performs:

an operation history memory step which memorizes the setting information, received from said information processing device, as an operation history;

an operation history transmission step which transmits an operation history memorized in said operation history memory step in response to a request from said information processing device;

a setting step which executes a setting, based on the setting information received from said information processing device; and a device state transmission step which obtains a state of said image forming device in response to a request from said information processing device and transmits it to said information processing device, wherein said operation history display step controls the display of the operation history in said display step, according to the state of said image forming device obtained in said device state obtaining step, wherein said operation history display step has an indicating function for indicating an unusable operation history, according to the state of said image forming device obtained in said device state obtaining step, and wherein the indicating function of said operation history display step indicates an unusable setting item in a form unselectable in said operation history selection step, according to the state of said image forming device obtained in said device state obtaining step.

48. A computer readable memory medium storing a program for executing a control method for an image forming system constituted by an information processing device and one or plural image forming devices capable of communication through a predetermined communication medium, wherein:

said information processing device performs:

an input step which inputs an operation instruction;

a display step which provides an information display;

an operation history collection step which collects an operation history from said image forming devices;

an operation history display step which integrates the operation history from said image forming devices and executes a display in said display step;

an operation history selection step which selects an arbitrary operation history among the operation histories displayed in said display step; and a transmission step which transmits a setting information, based on the operation history selected in said operation history selection step, to one of said image forming devices; and said image forming device performs:

an operation history memory step which memorizes the setting information, received from said information processing device, as an operation history;

an operation history transmission step which transmits an operation history memorized in said operation history memory step in response to a request from said information processing device; and a setting step which executes a setting, based on the setting information received from said information processing device, wherein said operation history memory means memorizes an operation history not correlated with a user information authenticated in an authentication step.

* * * * *

UNITED STATES PATENT AND TRADEMARK OFFICE

CERTIFICATE OF CORRECTION

PATENT NO. : 7,221,885 B2
APPLICATION NO. : 10/992691
DATED : May 22, 2007
INVENTOR(S) : Eiichi Sato It is certified that error appears in the above-identified patent and that said Letters Patent is hereby corrected as shown below:

ON THE TITLE PAGE:
At Item (56), References Cited, Foreign Patent Documents, Line 1, "JP 10079819 A * 3/1998" should read --JP 10-079819 A * 3/1998-- and Line 3, "JP 2003208291 A * 7/2003" should read --JP 2003-208291 * A 7/2003--.

At Item (57), Abstract, Line 3, "displayed and" should read --displayed,--.

IN THE DRAWINGS:
Sheet No. 1, Figure 1, "EXTRACTIOIN UNIT" should read --EXTRACTION UNIT--.

COLUMN 3:
Line 47, "setting" should read --settings--.
Line 52, "setting" should read --settings--.

COLUMN 5:
Line 54, "processing," should read --processing--.

COLUMN 9:
Line 33, "is" should read --are--.

COLUMN 11:
Line 55, "indicates" should read --indicate--.

COLUMN 15:
Line 21, "as" should be deleted.

COLUMN 18:
Line 60, "control" should read --controls--.

COLUMN 19:
Line 2, "to" should be deleted.

COLUMN 20:
Line 31, "history a" should read --history of a--.
Line 45, "screen." should read --screen--.

UNITED STATES PATENT AND TRADEMARK OFFICE

CERTIFICATE OF CORRECTION

PATENT NO. : 7,221,885 B2
APPLICATION NO. : 10/992691
DATED : May 22, 2007
INVENTOR(S) : Eiichi Sato It is certified that error appears in the above-identified patent and that said Letters Patent is hereby corrected as shown below:

COLUMN 22:
Line 13, “actuate” should read --actuates--.
Line 30, “when” should read --of--.

COLUMN 26:
Line 64, “corresponding” should read --corresponds--.

COLUMN 28:
Line 46, “belong” should read --belongs--.
Line 48, “belong” should read --belongs--.

COLUMN 29:
Line 2, “belong” should read --belongs--.
Line 4, “belong” should read --belongs--.

COLUMN 30:
Line 39, “are” should read --is--.

COLUMN 36:
Line 23, “history” should read --histories--.
Line 46, “in formation” should read --information--.

COLUMN 37:
Line 24, “history,” should read --histories,--.
Line 40, “setting” should read --settings--.
Line 43, “setting” should read --settings--.

COLUMN 38:
Line 17, “form” should read --from--.
Line 57, “constitute” should read --constitutes--.

COLUMN 39:
Line 4, “constitute” should read --constitutes--.

UNITED STATES PATENT AND TRADEMARK OFFICE

CERTIFICATE OF CORRECTION

PATENT NO. : 7,221,885 B2
APPLICATION NO. : 10/992691
DATED : May 22, 2007
INVENTOR(S) : Eiichi Sato It is certified that error appears in the above-identified patent and that said Letters Patent is hereby corrected as shown below:

COLUMN 40:
Line 37, "setting" should read --settings--.
Line 40, "setting" should read --settings--.

COLUMN 47:
Line 62, "means;" should read --means,--.

COLUMN 49:
Line 20, "wherein;" should read --wherein:--.

COLUMN 50:
Line 55, "means;" should read --means,--.

COLUMN 52:
Line 65, "on" should be deleted.

COLUMN 53:
Line 3, "and" should be deleted.

COLUMN 55:
Line 1, "request" should read --requests--.

COLUMN 58:
Line 9, "a" should read --an--.

Signed and Sealed this

Twenty-fourth Day of June, 2008

JON W. DUDAS
*Director of the United States Patent and Trademark Office*